US011536053B2

(12) United States Patent
Ashcroft et al.

(10) Patent No.: US 11,536,053 B2
(45) Date of Patent: Dec. 27, 2022

(54) INDICATOR LOCK

(71) Applicant: Sargent Manufacturing Company, New Haven, CT (US)

(72) Inventors: Phillip Ashcroft, New Haven, CT (US); Brian R. Fournier, Canton, CT (US); Lee Griswold, Bethel, CT (US); Christine Voelker, East Hampton, CT (US)

(73) Assignee: Sargent Manufacturing Company, New Haven, CT (US)

( * ) Notice: Subject to any disclaimer, the term of this patent is extended or adjusted under 35 U.S.C. 154(b) by 53 days.

(21) Appl. No.: 17/339,257

(22) Filed: Jun. 4, 2021

(65) Prior Publication Data

US 2021/0388641 A1 Dec. 16, 2021

Related U.S. Application Data

(60) Provisional application No. 63/034,656, filed on Jun. 4, 2020.

(51) Int. Cl.

| | |
|---|---|
| ***E05B 55/00*** | (2006.01) |
| ***E05B 13/10*** | (2006.01) |
| ***E05B 13/00*** | (2006.01) |

(52) U.S. Cl.
CPC ..... *E05B 55/005* (2013.01); *E05B 13/004* (2013.01); *E05B 13/106* (2013.01)

(58) Field of Classification Search
CPC ..... E05B 55/00; E05B 55/005; E05B 13/00; E05B 13/002; E05B 13/004; E05B 13/10; E05B 13/101; E05B 13/103; E05B 13/105; E05B 13/106; E05B 47/00; E05B 47/0657
USPC ..... 70/210
See application file for complete search history.

(56) References Cited

U.S. PATENT DOCUMENTS

| | | | | |
|---|---|---|---|---|
| 9,845,620 | B2 * | 12/2017 | Bronner | E05B 63/0017 |
| 2005/0039504 | A1 * | 2/2005 | Smith | E05B 13/004 70/134 |
| 2014/0311197 | A1 * | 10/2014 | Abel | E05B 15/02 70/432 |
| 2018/0066450 | A1 * | 3/2018 | Voelker | E05B 17/10 |

* cited by examiner

*Primary Examiner* — Nathan Cumar
(74) *Attorney, Agent, or Firm* — Wolf, Greenfield & Sacks, P.C.

(57) ABSTRACT

Disclosed herein are cylindrical door locks configured to indicate the lock status of the door lock to nearby persons. In some instances, the lock status is indicated on a first side of the door. In other instances, the lock status is indicated on both a first side and a second side of the door.

14 Claims, 60 Drawing Sheets

INDICATOR LOCK

CROSS-REFERENCE TO RELATED APPLICATIONS

This Application claims the benefit under 35 U.S.C. § 119(e) of U.S. Provisional Application Ser. No. 63/034,656, titled "BORED LOCK INDICATOR IN HANDLE" filed on Jun. 4, 2020, which is incorporated herein in its entirety.

FIELD

Disclosed embodiments are related to indicator door locks configured to indicate whether the door lock is in a locked or unlocked state.

BACKGROUND

Door locks are used to secure entryways such that only those with proper credentials (e.g., a physical or electronic key, security token, RFID card, passcode, biometric, etc.) may gain access through the entryway. Door locks may be in an unlocked state, wherein a latch of the door lock is actuatable from both sides of the door enabling access from both sides of the door regardless of the presence of proper credentials. Door locks may also be in a locked state, wherein a latch of the door lock is not actuatable from one or both sides of the door such that access from one or both sides of the door is prevented unless proper credentials are presented. In some instances, a button on an interior handle of the door may be used to transition the door lock from an unlocked state to a locked stated, or from a locked state to an unlocked state.

SUMMARY

Disclosed herein are cylindrical door locks configured to indicate the lock status of the door lock to nearby persons. In some instances, the lock status is indicated on a first side of the door. In other instances, the lock status is indicated on both a first side and a second side of the door.

In accordance with some embodiments, a cylindrical door lock includes an exterior handle including an indicator configured to display a locked status of the door lock and an interior handle including a lock. The cylindrical door lock also includes a locking bar aligned along a lock axis extending between the interior handle and the exterior handle, wherein the locking bar is coupled to the lock such that axial motion of the lock causes the locking bar to move axially. The cylindrical door lock also includes a locking piece configured to rotate about the locking bar and to move axially with the locking bar, wherein the locking piece includes a locking arm that extends radially from the lock axis. The cylindrical door lock also includes a first bar operatively coupled to the locking piece, the first bar being configured to engage the locking arm of the locking piece such that axial motion of the locking arm causes the first bar to move axially. The cylindrical door lock also includes a second bar operatively coupled to the first bar, the second bar configured to engage the first bar such that axial motion of the first bar causes the second bar to move axially, and wherein the second bar is operatively coupled to the indicator in the exterior handle and wherein axial motion of the second bar causes the indicator to move.

In accordance with some embodiments, a cylindrical door lock configured to display a lock status on an exterior handle includes an exterior handle having a first portion extending in a direction of a lock axis, wherein the first portion includes at least one opening that extends through a surface of the first portion. The cylindrical door lock also includes a first indicator disposed within the first portion and configured to display a status of the door lock through the at least one opening, wherein the first indicator is configured to move axially along the lock axis upon a change in the status. The cylindrical door lock also includes a lock on an interior side of the door lock and operatively coupled to the first indicator, wherein the first indicator is configured to move axially upon motion of the lock.

In accordance with some embodiments, a cylindrical door lock includes an external handle having a housing disposed along a lock axis, at least one opening in a surface of the housing, and an indicator disposed within the housing and configured to indicate a status of the door lock through the at least one opening, wherein the indicator is configured to move rotationally about the lock axis upon a change in the status. The cylindrical door lock also includes a lock on an interior side of the door lock and operatively coupled to the indicator, wherein the indicator is configured to rotate about the lock axis upon axial motion of the lock.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Specific non-limiting embodiments are now described in further detail with reference to the figures. It should be understood that the various systems, components, features, and methods described relative to these embodiments may be used either individually and/or in any desired combination as the disclosure is not limited to only the specific embodiments described herein.

Figure 15:
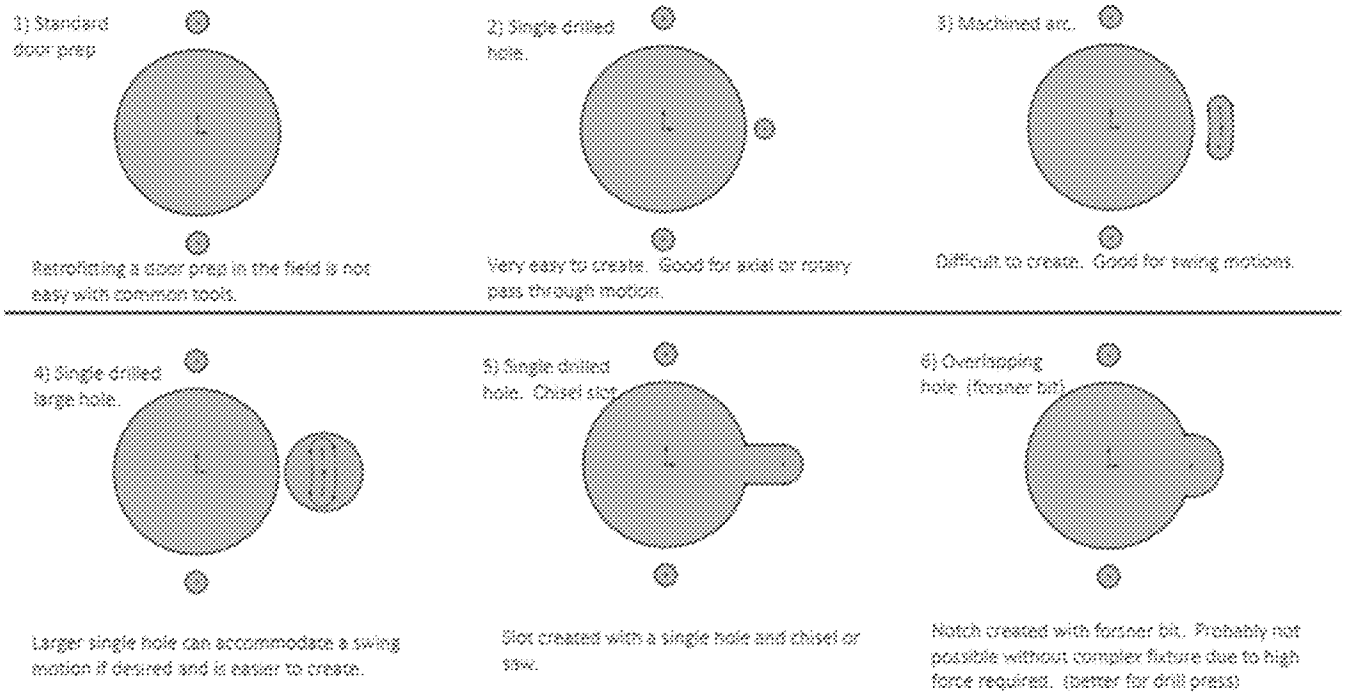
FIG. 15 shows standard and modified door prep configurations that may be used with an indicator or dual indicator door lock.

FIGS. 1A-12C show multiple embodiments of an indicator door lock 100 mounted to a door 102. In each embodiment, the door lock 100 is a cylindrical door lock configured to be mounted to a door 102 using standard cylindrical lock door preparation without requiring additional modification to the door 102 (e.g., the boring of additional holes, arcs, slots, channels, or other modifications). FIG. 15, which will be discussed in detail below, shows standard cylindrical lock door preparation and several examples of modified cylindrical lock door preparation.

In each embodiment, indicator door lock 100 comprises an interior handle 106 coupled to an interior shank 108 and an interior rose 110 mounted on an interior surface of a door 102. Each indicator door lock 100 additionally comprises an exterior handle 112 coupled to an exterior shank 114 and an exterior rose 116 mounted on an exterior surface of the door 102. The interior components may be located on an interior of an entryway, such as the interior of a room or building, and the exterior components may be located on an exterior of an entryway, such as the exterior of a room or building. In the embodiments shown, the interior and exterior handles 106 and 112 are lever handles, although it should be appreciated that any suitable handle configuration may be used. For example, in alternate embodiments, door lock 100 may comprise knobs instead of lever handles. The interior handle 106 and/or the exterior handle 112 may be configured to display lock status. In some embodiments, interior shank 108 may be unitary with interior handle 106, and in other embodiments interior shank 108 may be a separate component. In some embodiments, the interior shank 108 and/or the exterior shank 114 may be configured to display lock status in addition to or instead of interior handle 106. Interior and exterior roses 110 and 116 are shown to be circular, although it should be appreciated that any suitable rose configuration may be used. For example, in some embodiments, it may be desirable to configure either or both roses with one or more additional components (e.g., cameras, microphones/speakers, PCBs, keypads, biometric sensors, etc.). Additionally, in some embodiments, the interior rose 110 and/or the exterior rose 116 may be configured to display lock status. In such embodiments, either or both roses may be configured differently than shown to suit the one or more additional components.

In each embodiment of the indicator door lock 100, the interior handle 106 and the exterior handle 112 are in communication with a latch 104. Interior handle 106 additionally comprises a lock button 120, lock slide 122, or other suitable arrangement of components in communication with a locking bar 124, which passes through a bore hole 103 of the door 102 to the exterior handle 112. Actuation of the lock button 120, lock slide 122, or other suitable arrangement of components as will be described in detail for each individual embodiment actuates the locking bar 124, transitioning the door lock 100 from an unlocked state to a locked state or from a locked state to an unlocked state. In certain embodiments, the exterior handle 112 may comprise a keyway operatively coupled with the locking bar 124. In such embodiments, actuation of the keyway may transition the door lock 100 from an unlocked state to a locked state or from a locked state to an unlocked state. When the door lock 100 is in an unlocked state, rotating either the interior handle 106 or the exterior handle 112 retracts the latch 104 enabling the door 102 to be opened. When the door lock 100 is in a locked state, the interior handle 106 and/or the exterior handle 112 are prevented from rotating. Thus, when in the locked state, the latch 104 cannot be retracted, and the door 102 cannot be opened. In some instances, such as is the case with privacy locks and many classroom locks, it may be desirable for the door 102 to always be openable from the interior side allowing for immediate egress, for example, in the case of an emergency, while being locked from the exterior. In such instances, the door lock 100 may be configured such that regardless of unlocked or locked state, the interior handle 106 may always be rotated allowing the latch 104 to be retracted and the door 102 to be opened.

In some embodiments, for example, in embodiments where the interior handle 106 is always rotatable to allow for immediate egress regardless of lock status, it may be desirable for the door lock 100 to have one or more indicators configured to visually communicate lock status to nearby persons. The embodiments of FIGS. 1A-12C each include an unlocked indicator 140 and a locked indicator 144. Each indicator is configured to provide a clear visual indication of the lock status of the door lock 100 to persons located in an interior of the entryway. In the configurations shown in FIGS. 1A-12C, the unlocked indicator 140 is green and the locked indicator 144 is red, although it should be appreciated that any colors may be used as the disclosure is not limited in this respect. Furthermore, additional visual indicators including symbols, text, patterns, electronics (e.g., lights, LEDs, displays, etc.), or any other means of visually communicating lock status may be used. In certain embodiments, non-visual means such as brail or other raised or extruded symbols or patterns may be used. Any of the indication means described above may be used individually and/or in any desired combination as the disclosure is not limited in this respect.

Figure 1A:
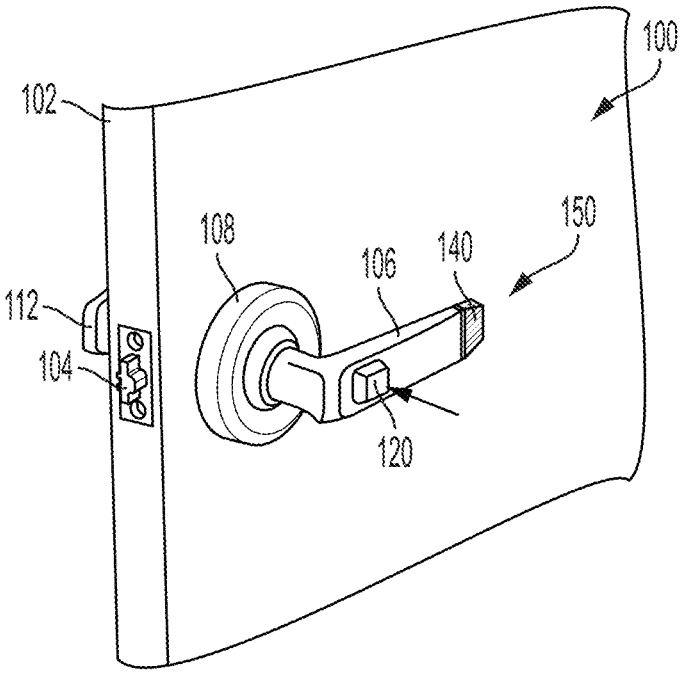
FIG. 1A shows a first embodiment of an indicator door lock in an unlocked state.
Figure 1B:
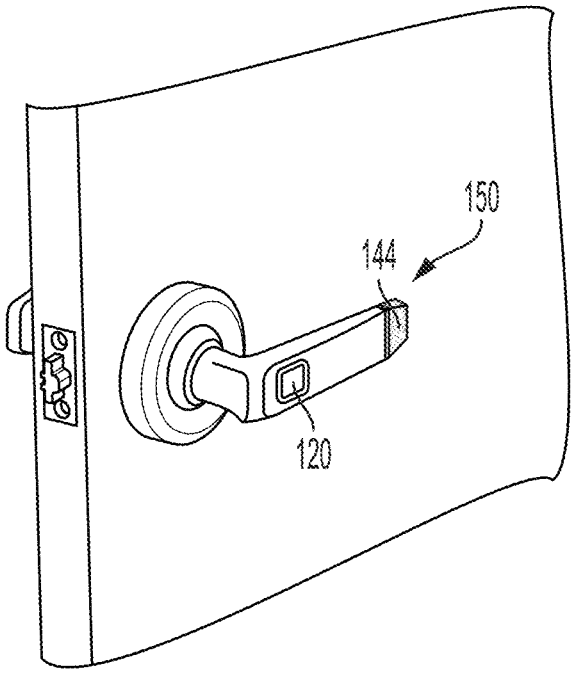
FIG. 1B shows the first embodiment of an indicator door lock in a locked state.
Figure 1C:
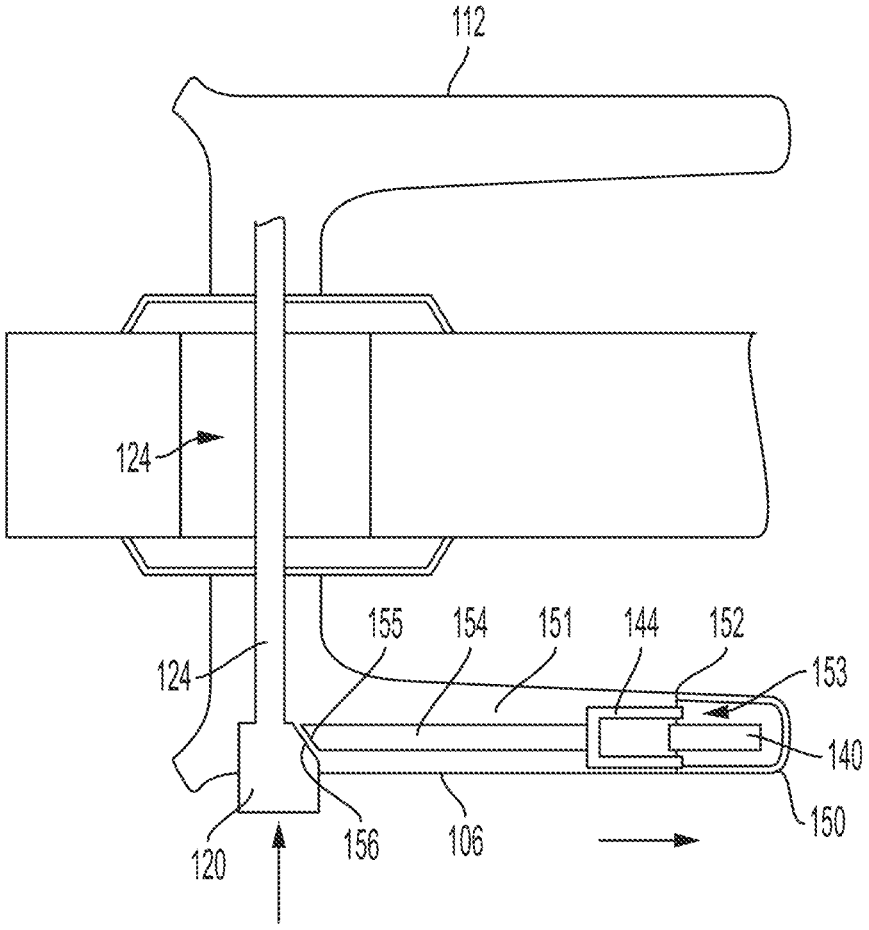
FIG. 1C shows a top section view of the first embodiment of an indicator door lock.

FIGS. 1A-1C show a first embodiment of an indicator door lock 100. In this embodiment, a distal portion of the interior door handle 106 comprises an endcap 150 through which the unlocked indicator 140 and the locked indicator 144 visually communicate the lock status of the door lock 100. The endcap 150 consists of a transparent or translucent material. For example, the endcap 150 may be a transparent or translucent plastic (e.g., ABS, acrylic, or nylon) or glass. In the embodiments shown, the entirety of endcap 150 is translucent, such that the lock status indictors are viewable across multiple view angles. This may be the case, for example, in embodiments where endcap 150 is a single injection molded component. In alternate embodiments, the endcap 150 may comprise translucent and opaque portions, such that lock status indicators are only viewable from certain view angles and are hidden from other view angles. This may be the case, for example, in embodiments in which endcap 150 comprises an opaque metal housing and an outward-facing transparent window. In such an embodiment, the lock status may only be viewable when viewing the lock directly from the front. The endcap 150 may be connected to the interior handle 106 via snap fits, press fits, adhesives or fastening hardware such as screws.

FIG. 1C shows a section view of the first embodiment of an indicator door lock 100. This view reveals a cavity 151, which extends through the inside of the interior handle 106 from a proximal end near the lock button 120 to a distal end near the endcap 150. Cavity 151 terminates in a wall 152 containing slots 153. The unlocked indicator 140 is configured as a rectangular post coupled to the wall 152 between the slots 153. The unlocked indicator 140 extends into the translucent endcap 150 along the longitudinal axis of the interior door handle 116. The locked indicator 144 is U-shaped with two sufficiently vertical faces that extend along the longitudinal axis of the interior door handle 106. The locked indicator 144 is coupled to the distal portion of a spring biased rod 154, which also extends along the longitudinal axis of the interior handle 106. The rod 154 comprises an angled surface 155 at its opposite, proximal end, which interfaces with a corresponding angled surface 156 on the lock button 120.

When in an unlocked state, the lock button 120 is in an extended position wherein at least a portion of the button extends past the outer surface of interior handle 106 in along a longitudinal axis of shank 108. Additionally, when the door lock 100 is in a locked state, the locked indicator 144 is retracted within the cavity 151 such that it is hidden by the opaque handle and only the unlocked indicator 140 is visible through the endcap 150. To lock the door 102, lock button 120 is pushed inward towards the door 102 along a longitudinal axis of shank 108. As lock button 120 is pushed inward, the angled surface 156 of lock button 120 pushes against the angled surface 155 of the spring biased rod 154, causing it to translate towards the distal end of the interior handle 106 along the longitudinal axis of the handle against a spring force. This motion results in a corresponding translation of the locked indicator 144 through the slots 153 of the wall 152 into the endcap 150 such that it envelopes and hides the unlocked indicator 140. As such, in the locked state, only the locked indicator 144 is visible. When the door is unlocked, the lock button 120 returns to its extended position, enabling the spring biased rod 154 to retract, enabling the locked indicator 144 to retract back into the cavity 151 of the interior handle 106 such that the locked indicator 144 is hidden and the unlocked indicator 140 is visible through the endcap 150.

FIGS. 2A-2D show a second embodiment of an indicator door lock 100. The door lock 100 is similar to the lock of the first embodiment, with the exception of the lock status indication mechanism. In the second embodiment, an outward face of the interior door handle 106 comprises a transparent or translucent window 160. In the embodiment shown, this window 160 is configured to be oblong and parallel to a longitudinal axis of the interior handle 106, although it should be appreciated that any desired shape may be utilized. As with the first embodiment, the window 160 many include a transparent or translucent material such that a portion of the unlocked indicating face 140 or the locked indicating face 144 may be seen through it. The window 160 may be connected to the interior door handle 106 by any conventional means including snap fits, press fits, adhesives, or fastening hardware.

Figure 2A:
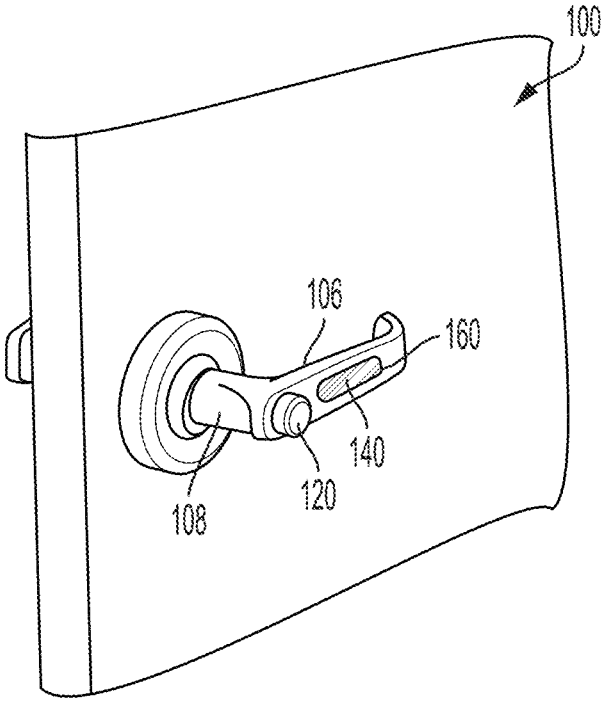
FIG. 2A shows a second embodiment of an indicator door lock in an unlocked state.
Figure 2B:
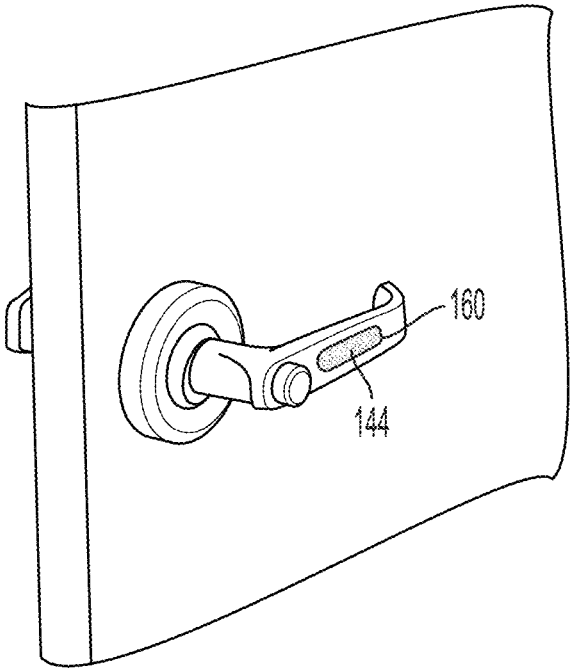
FIG. 2B shows the second embodiment of an indicator door lock in a locked state.
Figure 2C:
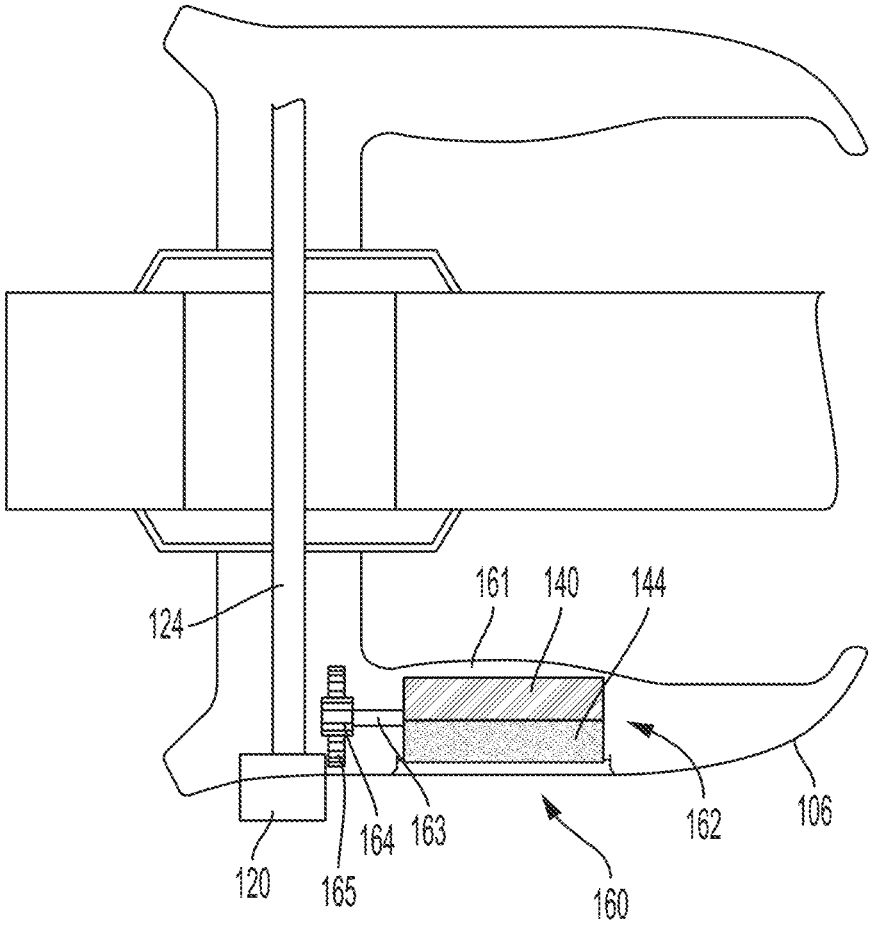
FIG. 2C shows a top section view of the second embodiment of an indicator door lock.
Figure 2D:
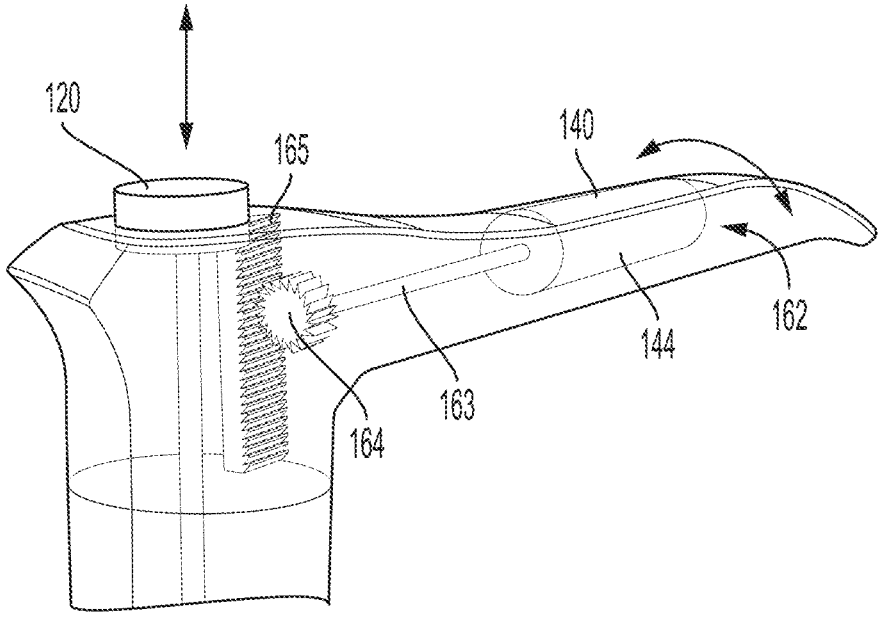
FIG. 2D shows an isometric section view of the second embodiment of an indicator door lock.

FIG. 2C-2D show section views of the second embodiment of the indicator door lock 100 from two different perspectives. These views reveal a cavity 161, which extends through the inside of interior handle 106 from a proximal end near the lock button 120 to a distal end opposite the proximal end. A cylinder 162 is rotatably mounted within the cavity 161 on an axle 162 such that a portion of the exterior surface of the cylinder 162 is visible through the window 160 as shown. Cylinder 162 comprises an unlocked indicating face 140 and a locked indicating face 144. As with the first embodiment, while unlocked indicating face 140 is shown to be green and a locked indicating face 144 is shown to be red, it should be appreciated that any of the aforementioned alternate indications may be used as the design is not limited in this respect. A pinion 164 is fixedly coupled to a proximal end of axle 163. The pinion is in communication with the rack 165 which is coupled to the lock button 120.

As with the first embodiment, when in an unlocked state, the lock button 120 of the second embodiment shown in FIGS. 2A-2D extends past the outer surface of the interior handle 106 along a longitudinal axis of shank 108. Additionally, when the door lock 100 is in the unlocked state, the cylinder 162 is rotated such that the unlocked indicating face 140 is visible through the window 160. When the lock button 120 is pressed inwards to transition the door lock 100 from an unlocked to a locked state, the rack 165 also translates inwards. The inward translation of the rack 165 rotates the pinion 164, the axle 163, and finally the cylinder 162 in a first direction. Rotating the cylinder 162 changes which indicating face is visible through window 160. Thus, when the lock has been fully transitioned to the locked state, and the cylinder 162 has been fully rotated in the first direction, the locked indicating face 144 is visible through window 160. When the door lock 100 is transitioned back to an unlocked state, the lock button 120 returns to its extended state, retracting the rack 165, which rotates the pinion 164, the axle 163, and finally the cylinder 162 in a second direction opposite the first direction such that the unlocked indicating face 140 is visible through the window 160. Certain door lock 100 embodiments may be configured with a torsion spring or a main spring to assist or resist rotation of the cylinder as the door lock 100 transitions from a locked state to an unlocked state or vice versa. Additionally, certain embodiments may be configured with bearings to reduce friction and ease rotation of the pinion 164, the axle 163, and the cylinder 162.

Figure 3A:
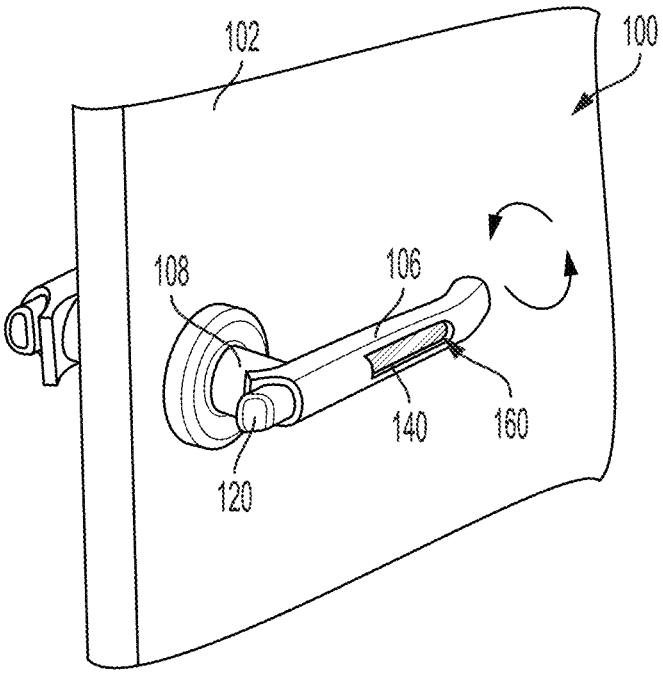
FIG. 3A shows a third embodiment of an indicator door lock in an unlocked state.
Figure 3B:
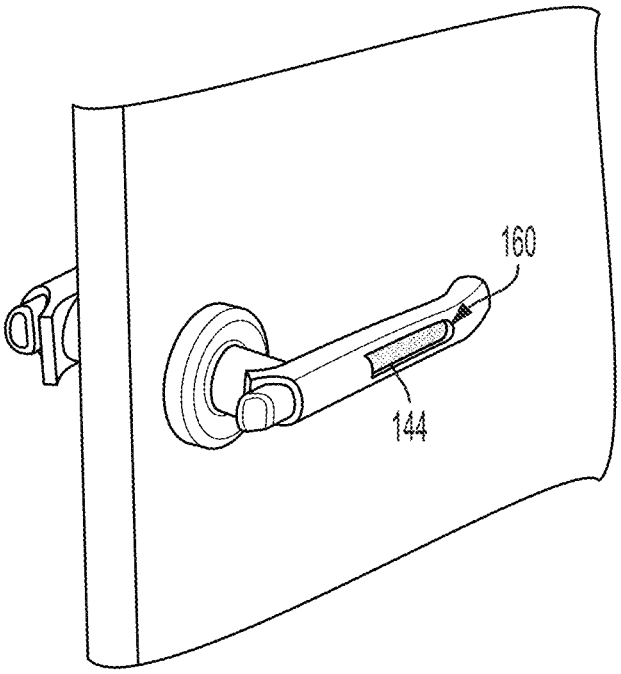
FIG. 3B shows the third embodiment of an indicator door lock in a locked state.
Figure 3C:
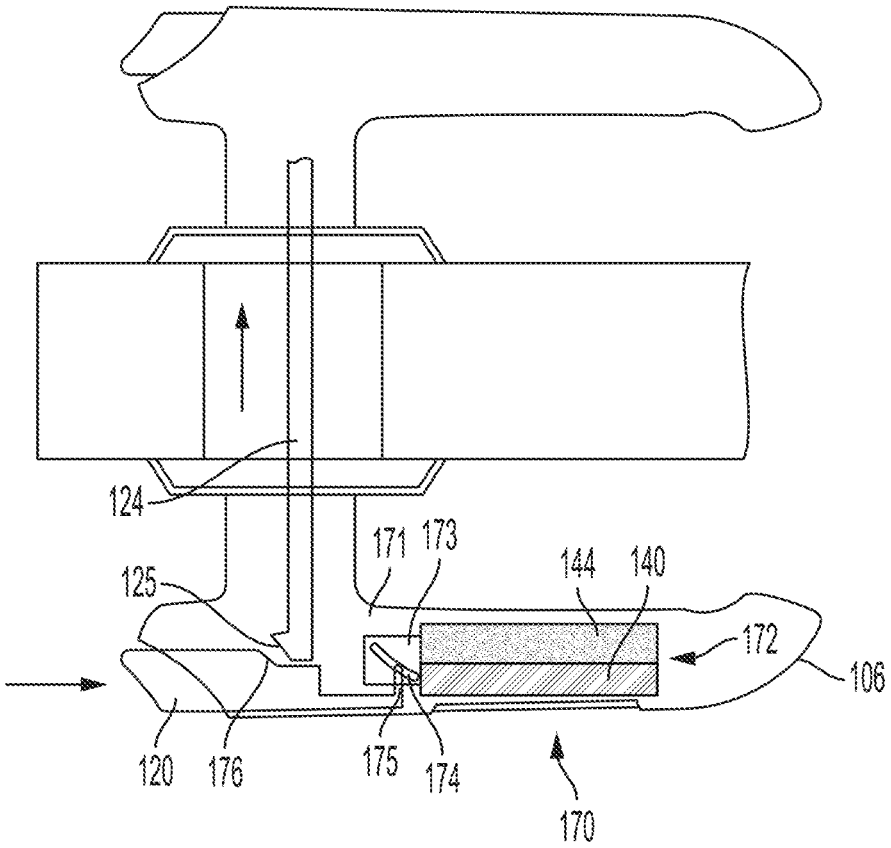
FIG. 3C shows a top section view of the third embodiment of an indicator door lock.

FIGS. 3A-3C show a third embodiment of an indicator door lock 100. The door lock 100 is similar to the previous embodiments, with the exception of the lock button 120 and the lock status indication mechanism. In the third embodiment, a portion of the lock button 120 extends outwards from the surface of interior door handle 106 along a longitudinal axis of the interior door handle 106. When configured as such, the door is transitioned to a locked state by pressing the lock button 120 into the interior door handle 106 along the longitudinal axis of the interior handle 106 in a direction sufficiently parallel to the interior face of the door 102. When the door 100 is unlocked, the lock button translates back to the extended position along the same axis. This arrangement may be desirable for ergonomic or aesthetic purposes. The third embodiment of the indicator door lock 100 additionally comprises a window 170 on an exterior surface of interior door handle 106 through which the lock status is displayed as shown. As described above and as shown in FIGS. 3A and 3B, the lock status indicators may include text. For example, in the third embodiment, the unlocked indicating face 140 reads "OPEN" and the locked indicating face 144 reads "LOCKED".

FIG. 3C shows a section view of the third embodiment of the indicator lock 100. This view reveals a cavity 171, which extends through the inside of interior handle 106 from a proximal end near the lock button 120 to a distal end opposite the proximal end. A cylinder 172 is rotatably mounted within the cavity 171 such that a portion of the exterior surface of cylinder 172 is visible through the window 170 as shown. As with the second embodiment, the cylinder 162 comprises an unlocked indicating face 140 and a locked indicating face 144. A cam plate 173 comprising an arcuate slot 174 extends from a proximal end of the cylinder 173 in a direction parallel with the longitudinal axis of the interior door handle 106. A pin 175 is coupled to lock button 120 and extends into slot 174. In the third embodiment, the lock button comprises an angled surface 176, which interfaces an angled surface 125 on the locking bar 124.

As described above, when indicating door lock 100 is in a locked state, lock button 120 extends outwards from an exterior surface of interior door lock 106. Additionally, cylinder 172 is rotated such that the unlocked indicating face 140 is visible through window 170. When the locked button 120 is pressed inwards to transition the door lock 100 from an unlocked state to a locked state, the angled surface 176 of lock button 120 pushes against the angled surface 125 of locking bar 124 resulting in translation of locking bar 124 in a direction perpendicular to the lock button 120. This translation of locking bar 124 locks the door 102. Additionally, as the locking button 120 is pressed inwards as shown, pin 175 also moves inwards, traversing slot 174 in a distal direction. As the pin 175 moves through slot 174, it applies a force to cam plate 173 which causes the cam plate 173 and the cylinder 172 to rotate in a first direction. When the lock button has been fully pressed, the corresponding rotation of the cylinder 172 in the first direction changes the indicating face visible through window 170 from the unlocked indicating face 140 to the locked indicating face 144. When the door 102 is transitioned to an unlocked state, the lock button translates along the longitudinal axis of the interior door handle 106 to its extended state. As the locking button 120 is translates outwards, pin 175 also translates outwards, traversing slot 174 in a proximal direction. As the pin 175 moves through slot 174, it applies a force to cam plate 173 which causes the cam plate 173 and the cylinder 172 to rotate in a second direction. When the lock button has been fully extended, the corresponding rotation of the cylinder 172 in the second direction changes the indicating face visible through window 170 from the locked indicating face 144 to the unlocked indicating face 140. In such an embodiment, the locking bar 124 may be configured with a spring bias such that it naturally resides in the unlocked state unless the lock button 120 is blocking it from doing so.

Figure 4A:
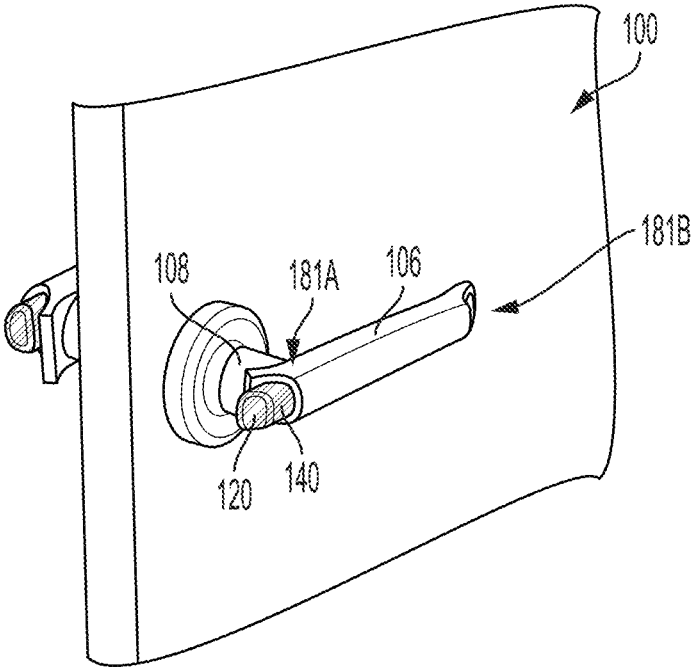
FIG. 4A shows a fourth embodiment of an indicator door lock in an unlocked state.
Figure 4B:
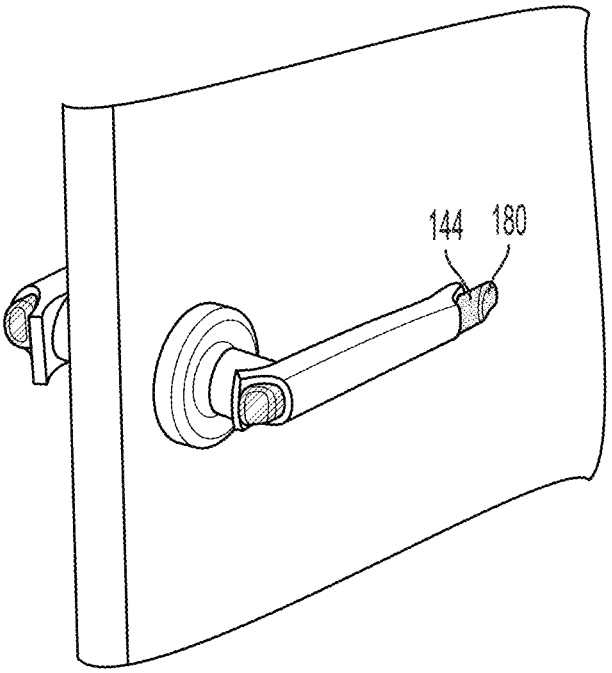
FIG. 4B shows the fourth embodiment of an indicator door lock in a locked state.
Figure 4C:
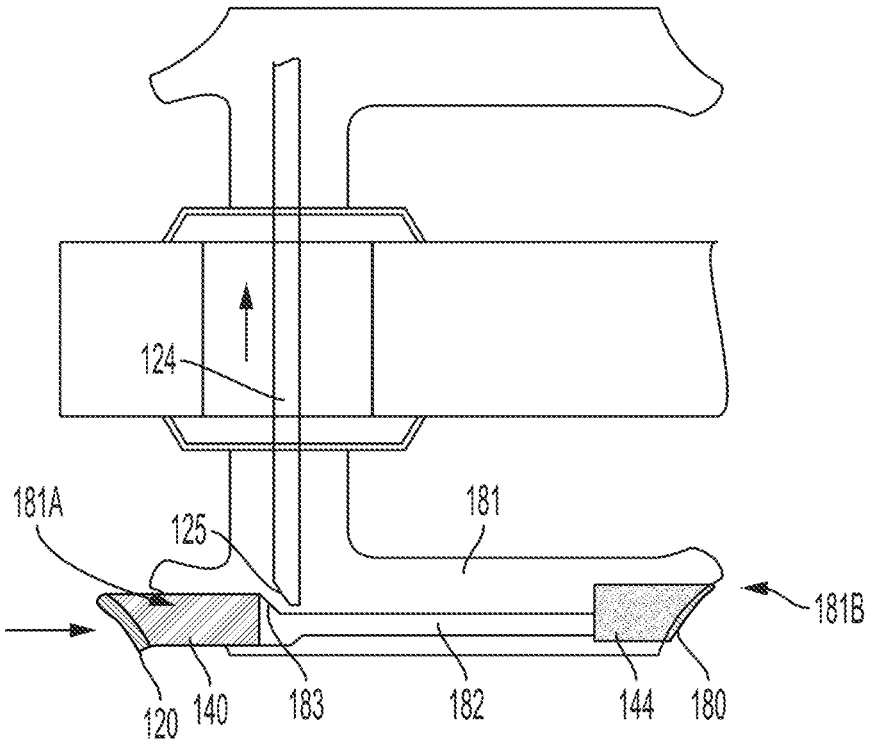
FIG. 4C shows a top section view of the fourth embodiment of an indicator door lock.

FIGS. 4A-4C show a fourth embodiment of an indicator door lock 100. Unlike previous embodiments, the fourth embodiment comprises two interconnected lock buttons, each of which is configured to visually indicated lock status. In the fourth embodiment, the interior door handle 106 comprises a cavity 181 that extends through the handle along a longitudinal axis from a proximal opening 181A to a distal opening 181B. When the door lock 100 is in an unlocked state, as shown in FIG. 4A, a portion of the lock button 120 extends outwards from the cavity 181 past an exterior surface of the interior door handle 106 at a proximal end of the handle. In this unlocked state, the side surface of the lock button 120, which, in this embodiment is configured as the unlocked indicator 140 is visible. As with the third embodiment, the lock button 120 additionally comprises an angled surface 183 which interfaces with a corresponding angled surface 125 of locking bar 124. Lock button 120 is coupled to the proximal end of a shaft 182, which extends through the cavity 181 as shown. An unlock button 180 is coupled to the distal end of the shaft 182. Referring again to FIG. 4A, when door lock 100 is in an unlocked state, the unlock button 120 is located within the cavity 181 such that side surface of the unlock button 180, which, in this embodiment is configured as the locked indicator 144, is hidden.

To lock the fourth embodiment of indicator door lock 100, the lock button is pressed along the longitudinal axis of interior door handle 106 as shown by the red arrow in FIG. 4C. As with the third embodiment, this linear motion along the longitudinal axis of the interior door handle 106 is transferred from the angled surface of the lock button 183 to the angled surface 125 of the locking bar 124, resulting in linear motion of the locking bar 124 along a longitudinal axis of shank 108. When pressed, the lock button also moves shaft 182 and unlock button 180 along the longitudinal axis of handle 106. Once door lock 100 has been fully transitioned to the locked state, as shown in FIG. 4B, the lock button 120 is located within the cavity 181 such that side surface of the lock button 120, which, in this embodiment is configured as the unlock indicator 140, is hidden, and the unlock button 180 extends outward from cavity 181 past an exterior surface of handle 106 such that side surface of the unlock button 180, which, in this embodiment is configured as the locked indicator 144, is visible. To unlock the door lock 102, the unlock button 180 is pressed back towards the proximal end of the handle 108, revealing the side surface of lock button 120 and enabling locking bar 124 to return to the unlocked position.

Figure 5A:
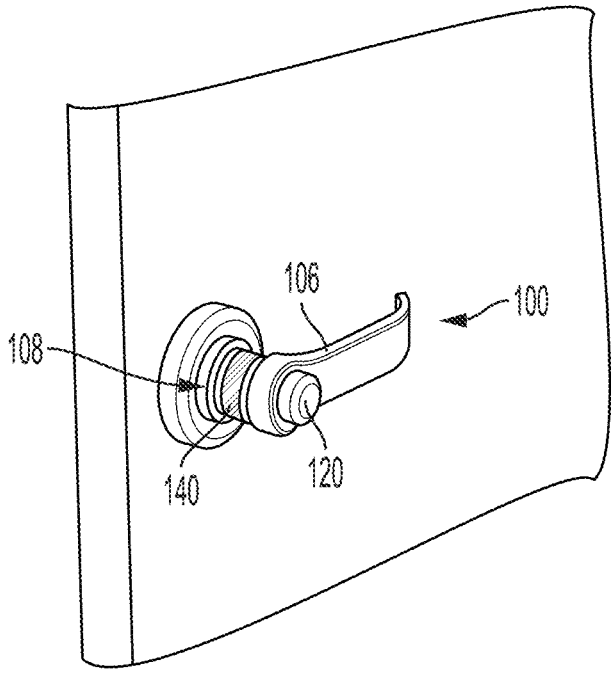
FIG. 5A shows a fifth embodiment of an indicator door lock in an unlocked state.
Figure 5B:
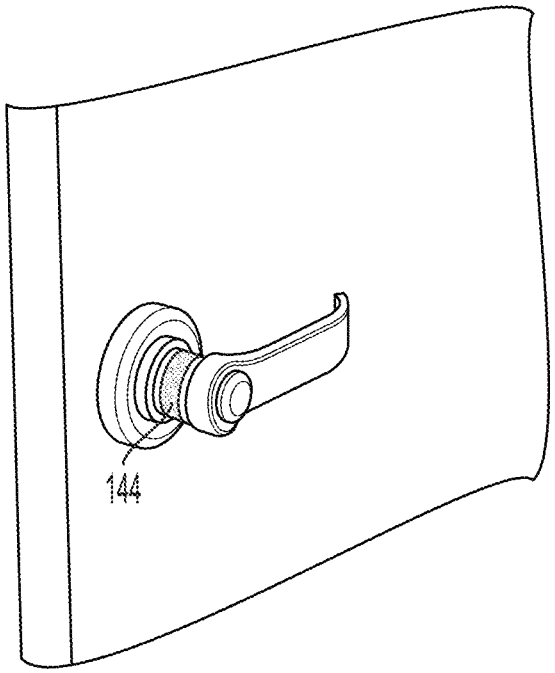
FIG. 5B shows the fifth embodiment of an indicator door lock in a locked state.
Figure 5C:
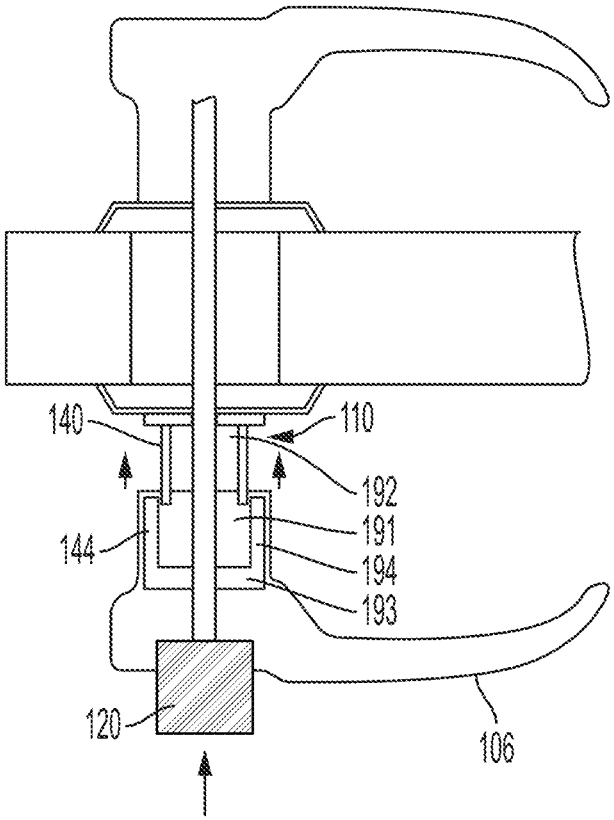
FIG. 5C shows a top section view of the fifth embodiment of an indicator door lock.

FIGS. 5A-5C show a fifth embodiment of an indicator door lock 100. Unlike previous embodiments, which were configured to displayed lock status on the interior door handle 106, this embodiment is configured to display lock status on the interior shank 108. In this embodiment, a lock button 120 is located at a proximal end of the interior door handle 106. The lock button is coupled to a locking bar 124, which extends through a first cavity 191 formed in the proximal portion of the interior door handle 106 and a second cavity 192 formed in the shank 108. Both cavities 191 and 192 are generally cylindrical and extend along a longitudinal axis of shank 108 towards door 102. In this embodiment, the exterior surface of shank 110 is configured as the unlocked indicator 140. A circular base 193 is coupled to locking bar 142 at a location within cavity 191. A cylindrical side wall 194 is coupled to the outer circumference of circular base 193 and extends inwards towards the door 102. The exterior surface of cylindrical sidewall 143 is configured as the locked indicator 144 and is colored red.

As best seen in FIGS. 5A and 5C, when indicator door lock 100 is in an unlocked state, lock button 120 extends outwardly from the door 102 past the outer surface of the interior handle 106 along a longitudinal axis of shank 108. Additionally, the cylindrical sidewall 194, comprising locked indicator 144, is located inside first cavity 191 of interior door handle 106. Thus, when in an unlocked state, the exterior surface of shank 110, here configured as unlocked indicator 140, is visible. To transition door lock 100 to a locked state, the lock button 120 is pressed inwards towards the door 102 along a longitudinal axis pf shank 108. When lock button 120 is pushed inwards, locking bar 124, circular base 193 and cylindrical sidewall 194 all translate inward towards the door along the same axis. As a result, cylindrical sidewall 194 exits the internal cavity 191 of the interior door handle 106 and covers shank 110. As such, the exterior surface of cylindrical sidewall 194, which is configured as the locked indicator 144, covers and eclipses the exterior surface of shank 110, which is configured as locked indicator 140. When the door is unlocked, the process is reversed. The lock button 120 returns to its extended state, and the locking bar 124 with circular base 193 and cylindrical sidewall 194 translate outwards such that cylindrical sidewall returns to its location within the first cavity 191, exposing the exterior surface of shank 110, which is configured as unlocked indicator 140.

FIGS. 6A-6D show a sixth embodiment of an indicator door lock 100. Similar with the fifth embodiment, the sixth embodiment is configured to display lock status on the shank 108 of the door lock 100, however the sixth embodiment includes a pen-click mechanism configured to rotate a hub 205 containing both the unlocked indicator 140 and locked indicator 144. In the sixth embodiment, the lock button 120 extends past the outer surface of the interior handle 106 along a longitudinal axis of shank 108 towards the interior face of door 102. The lock button is coupled to a first hub 202, which comprises a first set of teeth 203 at an inner end of the hub 202 opposite the lock button. These teeth act as cams and interface with a second set of teeth 205, which also act as cams, located on an outer end of a second hub 204. The second hub 204 is generally frustoconical and is configured to fit within a shroud portion 209 of interior handle 106. The second hub comprises alternating unlocked indicators 140 and locked indicators 144 along its angled exterior surface, which are selectively viewable through one or more windows 207 on shroud 206.

Figure 6A:
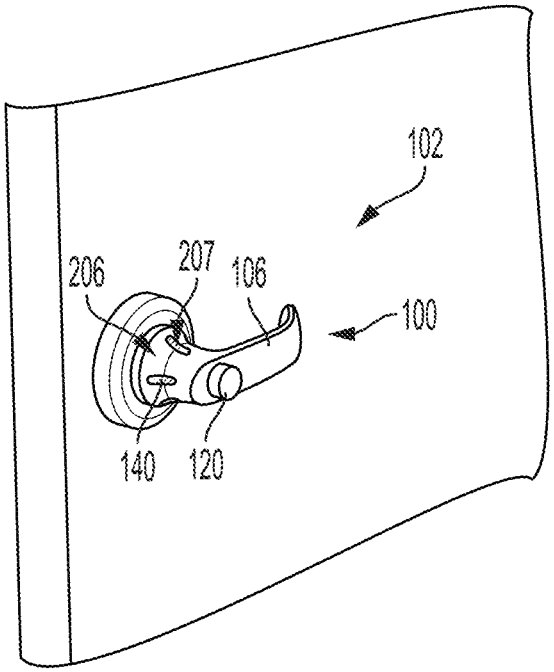
FIG. 6A shows a sixth embodiment of an indicator door lock in an unlocked state.
Figure 6B:
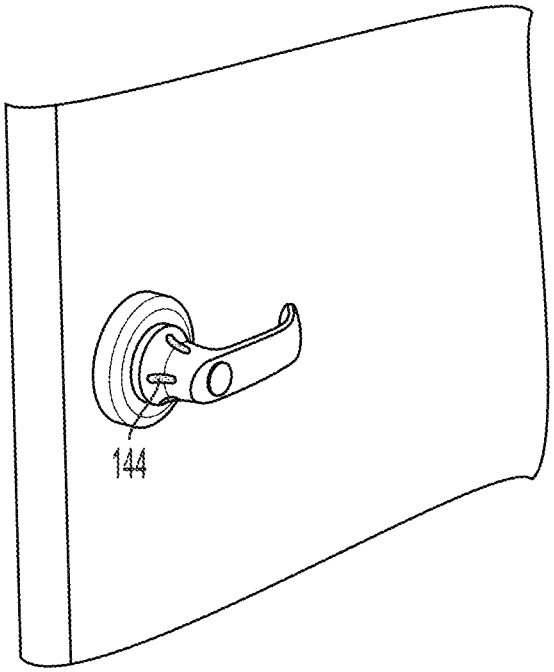
FIG. 6B shows the sixth embodiment of an indicator door lock in a locked state.
Figure 6C:
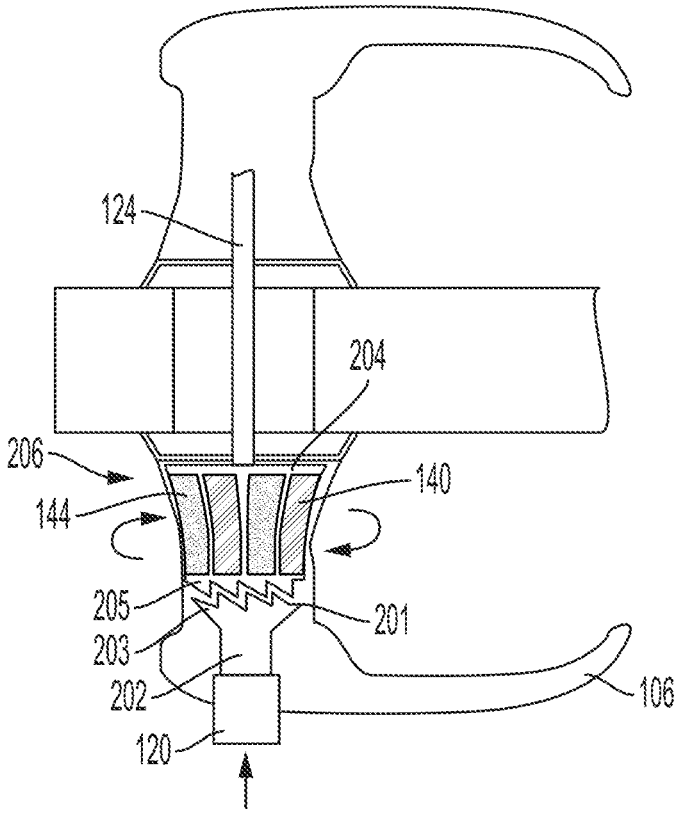
FIG. 6C shows a top section view of the sixth embodiment of an indicator door lock.
Figure 6D:
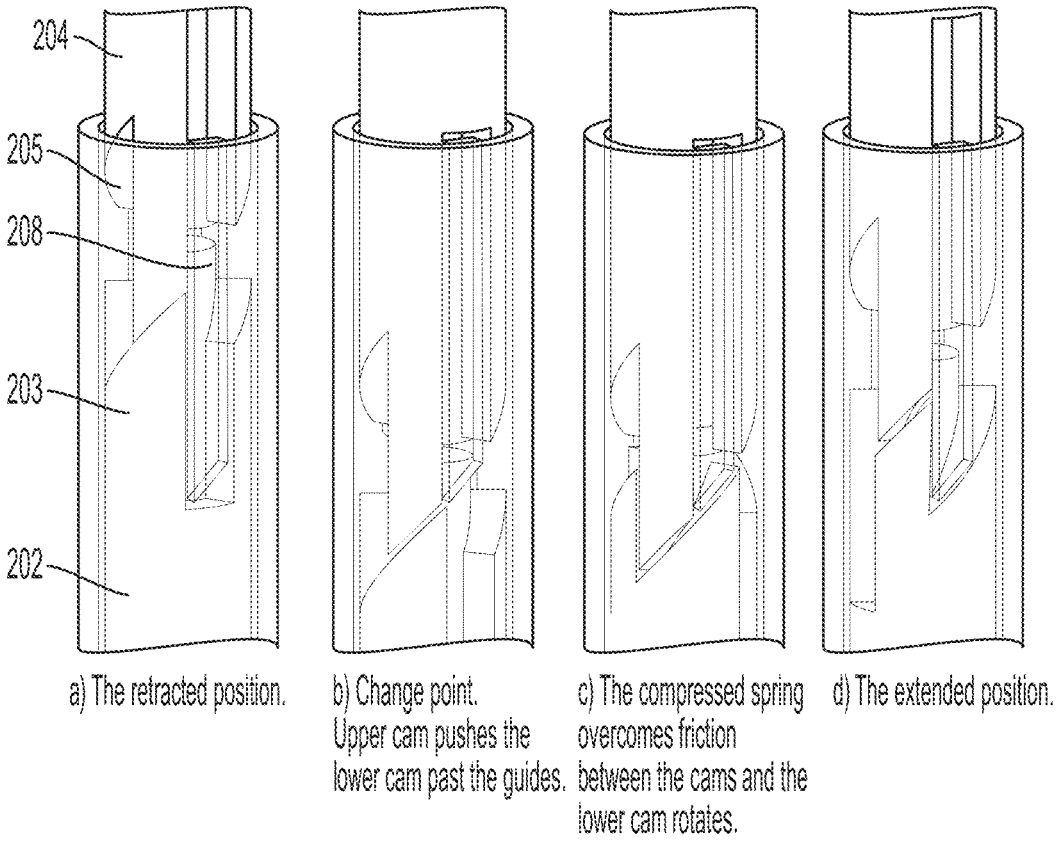
FIG. 6D shows the various stages of the pen-click mechanism used by the sixth embodiment of an indicator door lock.

Referring to FIG. 6A, when the door lock 100 is in an unlocked state, unlocked indicators 140 are visible through windows 207 of shroud 206. To transition door lock 100 to a locked state, lock button 120 is pressed inward along a longitudinal axis of shank 108 towards door 102. Locking bar 124 and first hub 202 also move inward along the same axis. As shown be in FIG. 6D, as the first set of teeth 203 of first hub 202 contact the second set of teeth 205 on the second hub 204 in a first position (e.g., retracted or "unlocked"), the first set of teeth 203 push the second set of teeth 204 inward past a series of guides 208. Once the second set of teeth 204 have translated pass the series of guides, a spring force overcomes a frictional force between the interfacing surfaces of the two sets of teeth, and the second set of teeth 205 and second hub 204 rotate and translate until the series of guides 208 are reengaged. At this point, the second set of teeth 205 and second hub 204 are in a second position (e.g., extended or "locked"). In the second position, the locked indicators 144 are visible through windows 207 of shroud 206. This process is akin to that of a clicking pen. To transition the door back to the locked position, the process is repeated resulting in the second teeth and hub rotating into a third position (e.g., retracted or "unlocked") wherein the unlocked indicators 140 again are visible through windows 207 of shroud 206.

FIGS. 7A-7D show a seventh embodiment of an indicator door lock 100. The seventh embodiment is also configured to display lock status at the interior shank 108 of the door lock 100. As with previous embodiments, a cavity 201 extends through a proximal portion of the interior door handle 106 and shank 108 along a longitudinal axis of shank 108. In the seventh embodiment, a first post 204 and a second post 208 are coupled to the locking bar 124, which extends along the longitudinal axis of shank 108 from the lock button 120 towards the exterior door handle 112. The first post 204 comprises a first angled surface 205 and the second post 208 comprises a second angled surface 209. The first angled surfaces 205 interfaces with a third angled surface 206, which is integrally formed with the locked indicator 144. The second angled surface 209 interfaces with a fourth angled surface 210, which is integrally formed with unlocked indicator 140. A slot 211 is formed into interior shank 108 above unlocked indicator 140 and locked indicator 144 such that each indicator is able to be raised upwards such that at least a portion of each indicator extends past and exterior surface of shank 108 and is visible.

Figure 7A:
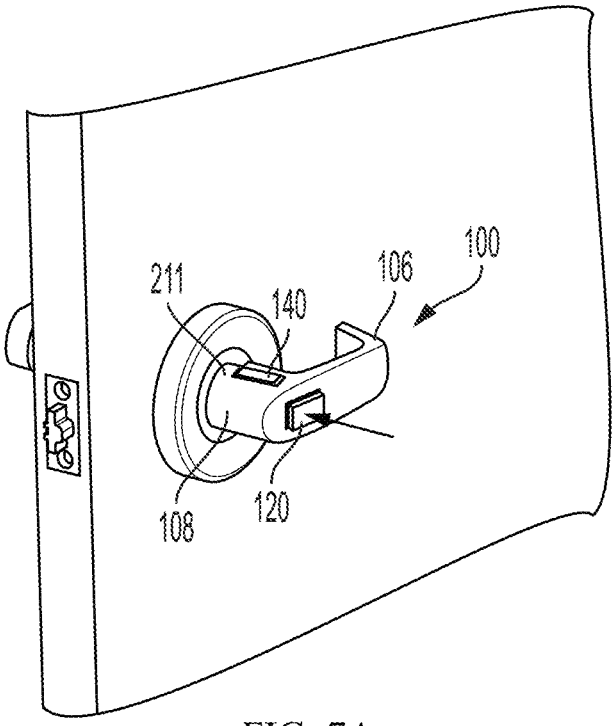
FIG. 7A shows a seventh embodiment of an indicator door lock in an unlocked state.
Figure 7B:
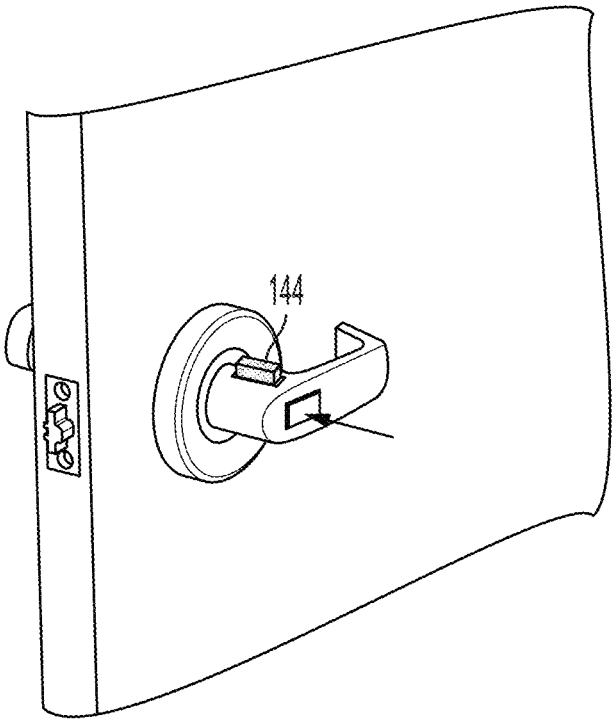
FIG. 7B shows the seventh embodiment of an indicator door lock in a locked state.
Figure 7C:
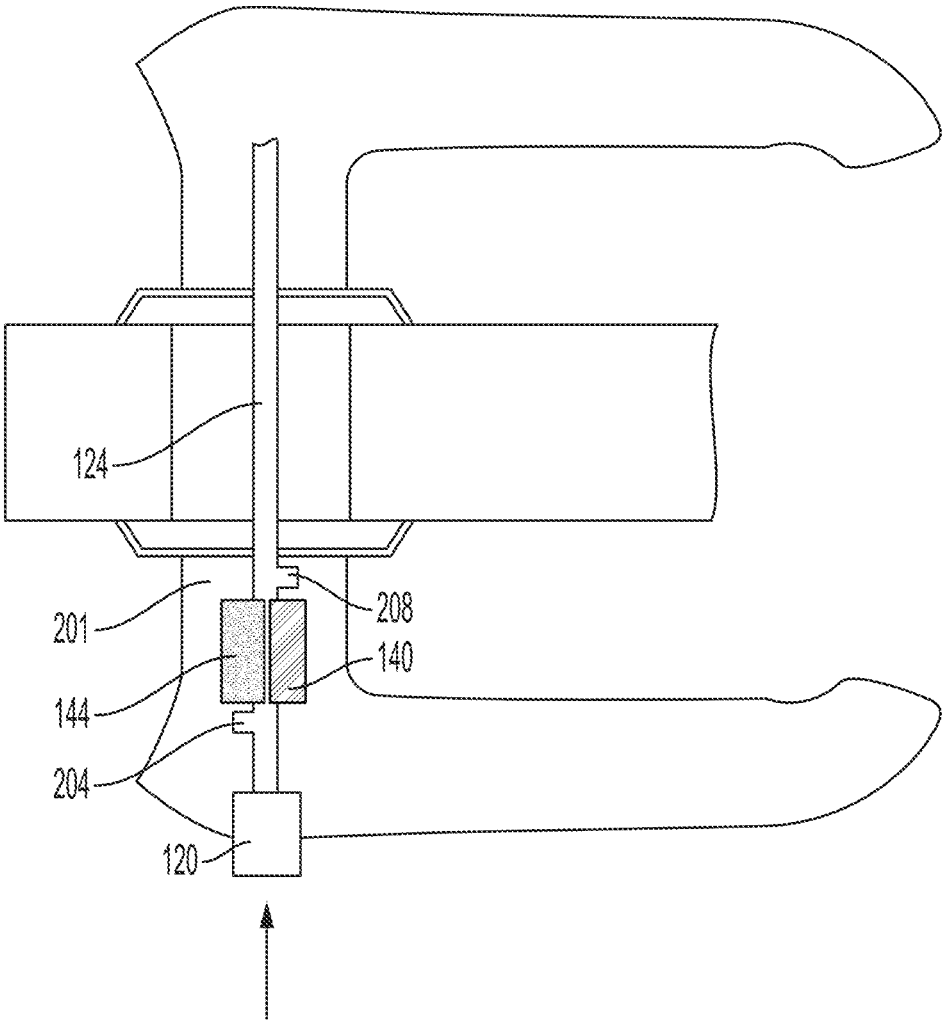
FIG. 7C shows a top section view of the seventh embodiment of an indicator door lock.
Figure 7D:
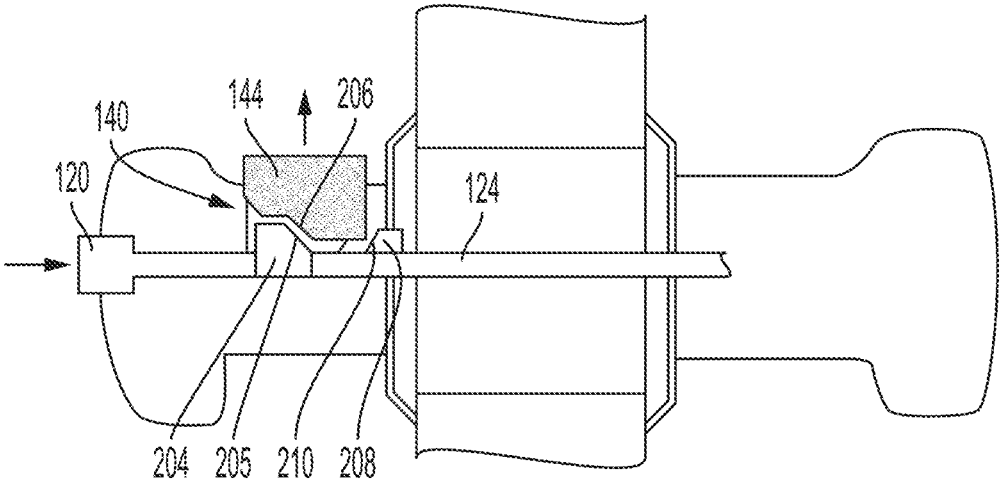
FIG. 7D shows a right-side section view of the seventh embodiment of an indicator door lock.

As shown in FIG. 7A, when the seventh embodiment of door lock 100 is in an unlocked position, a portion of the unlocked indicator 140 extends vertically through slot 211 of shank 108 such that the portion of the unlocked indicator 140 is visible from an exterior of the door lock 100. In this extended position, unlocked indicator 140 rests on and is held vertically up by the second post 208. To transition the door lock 100 from the locked state to the unlocked state, the lock button 120 is pressed inwards along the longitudinal axis of shank 108. When lock button 120 is pressed inwards, the locking bar 123, the first post 204, and the second post 208 also move inwards in a linear direction along a longitudinal axis of shank 108. The first angled surface 205 of first post 204 presses against the third angled surface of locked indicator 144. As a result, locked indicator 144 moves vertically upwards in a direction perpendicular to the longitudinal axis of shank 108 such that a portion of locked indicator 144 extends through slot 211 and becomes visible. Simultaneously, the second post 208 moves out from underneath the unlocked indicator 140 such that the second post 208 no longer vertically supports the unlocked indicator 140. As a result, unlocked indicator 140 is lowered through slot 211 into shank 108 and becomes hidden as best shown in FIG. 7B. To transition door lock 100 back to the unlocked state, the process is repeated. The lock button 120 moves outwards along the longitudinal axis of the shank 108. As a result, the second first post 204 moves out from underneath locked indicator 140, causing the locked indicator 144 to drop as described above. The second angled surface 209 of the second post 208 presses against the fourth angled surface 210 of the unlocked indicator 140, causing the locked indicator to rise as described above.

Figure 7E:
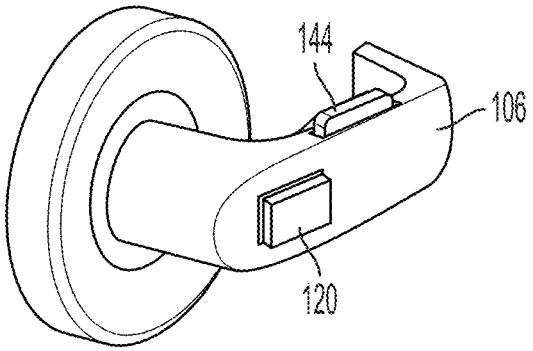
FIG. 7E shows a variant of the seventh embodiment of an indicator door lock.

FIG. 7E shows a variation of the seventh embodiment of a door lock 100 in which the unlocked indicator 140 and the locked indicator 144 are raised and lowered through a slot in interior handle 106. The operation of this variant is sufficiently similar to the operation described previously. When lock button 120 is actuated inwards towards the door, locking the door, a bar located within an internal cavity of handle 106 is translated in a first direction, lowering the unlocked indicator 140 and raising the locked indicator 144. When the lock button is actuated outwards away from the door, unlocking the door, the bar translates in a second direction opposite to the first direction, raising the unlocked indicator 140 and lowering the locked indicator 144.

FIG. 8A-8D show an eighth embodiment of an indicator door lock 100. This embodiment is configured to utilize a lock slide 122 instead of a lock button to transition the door lock 100 from an unlocked state to a locked state. The interior door handle 106 of the eighth embodiment of an indicating door lock 100 comprises an internal cavity 221. The cavity 221 extends through the handle 106 from a proximal end of the handle near the shank 108 to a distal end of the handle 106 opposite the proximal end. The handle 106 also includes an elongate opening 220 that extends through an exterior face of handle 106 such that it connects the internal cavity 201 to the exterior surface of the handle 106.

In the embodiment shown, the opening 220 is rectangular in shape and extends longitudinally along the handle 106, although it should be appreciated that the opening 220 can be configured in a desired shape. The lock slide 122 of the eighth embodiment comprises a main body 222 with a proximal arm 223 extending from a proximate side of the main body 222 and a distal arm 225 extending from a distal side of the main body 222. The proximal arm 223 is a vertical face, which, in this embodiment, is configured as the unlocked indicator 140. An angled surface 224 is coupled to a terminal end of the proximal arm 223. The distal arm 225 is also a vertical face, which, in this embodiment, is configured as the locked indicator 144. The lock slide 122 is located within cavity 221 of door handle 106, and includes a portion that extends into opening 200. In some embodiments, the portion that extends into opening 220 may include additional features to facilitate movement of the button slide as will be described later on. The angled face 224 at the terminal end of the proximal arm 223 interfaces with an angled face 125 of the locking bar 124, which extends through the shank 108 of door lock 100 along a longitudinal axis of the shank 108.

Figure 8A:
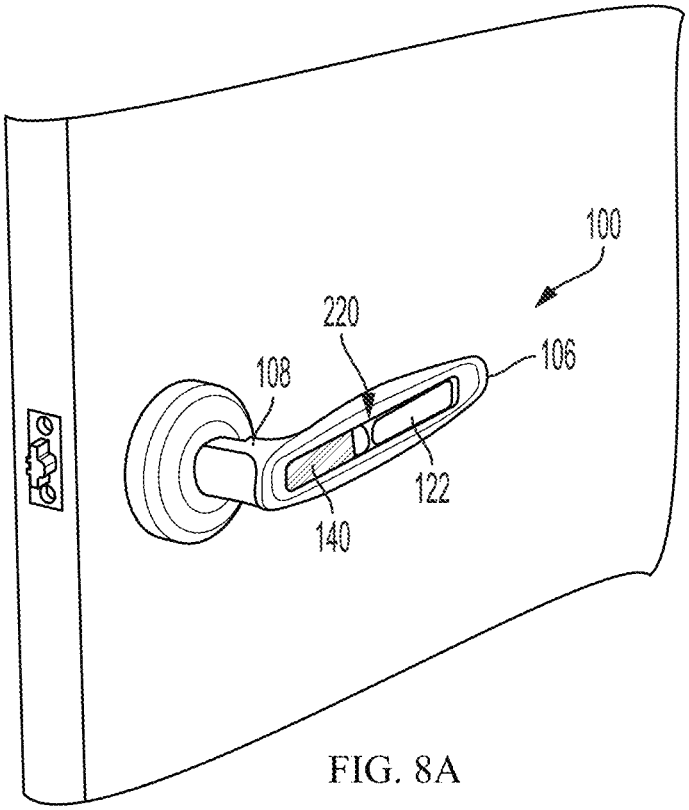
FIG. 8A shows an eighth embodiment of an indicator door lock in an unlocked state.
Figure 8B:
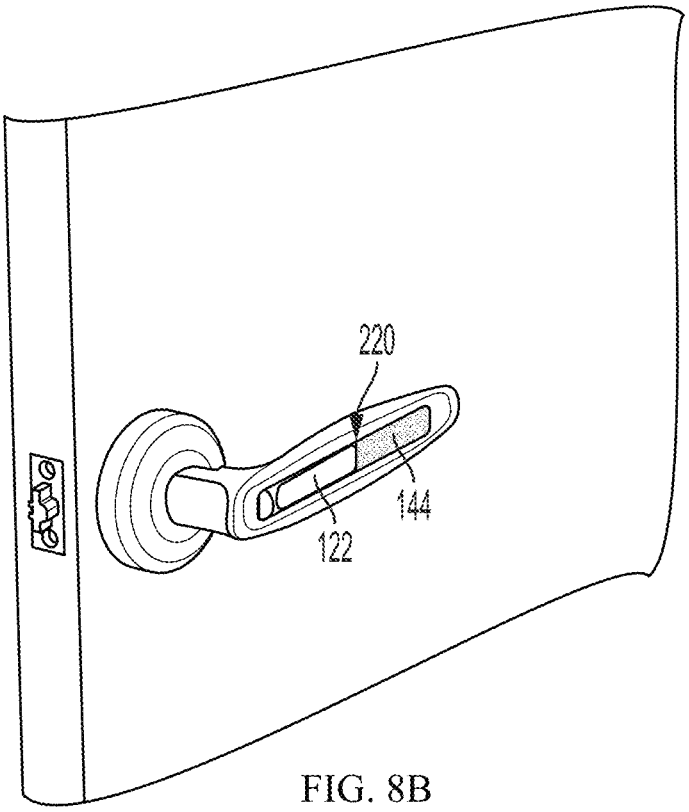
FIG. 8B shows the eighth embodiment of an indicator door lock in a locked state.
Figure 8C:
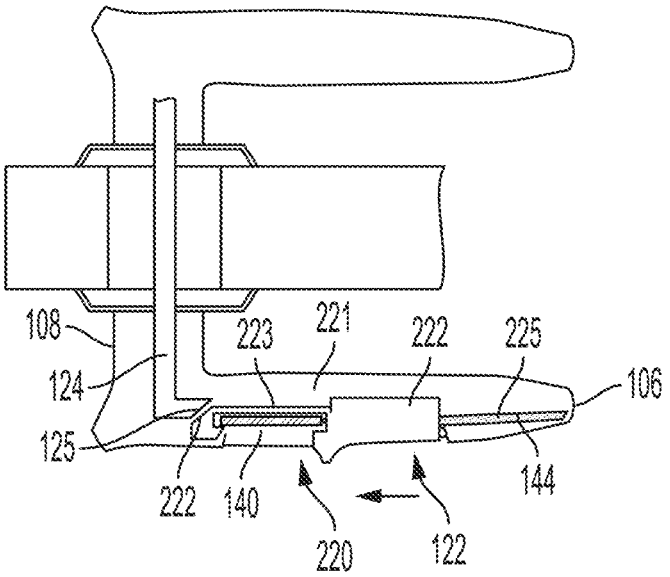
FIG. 8C shows a top section view of the eighth embodiment of an indicator door lock.
Figure 8D:
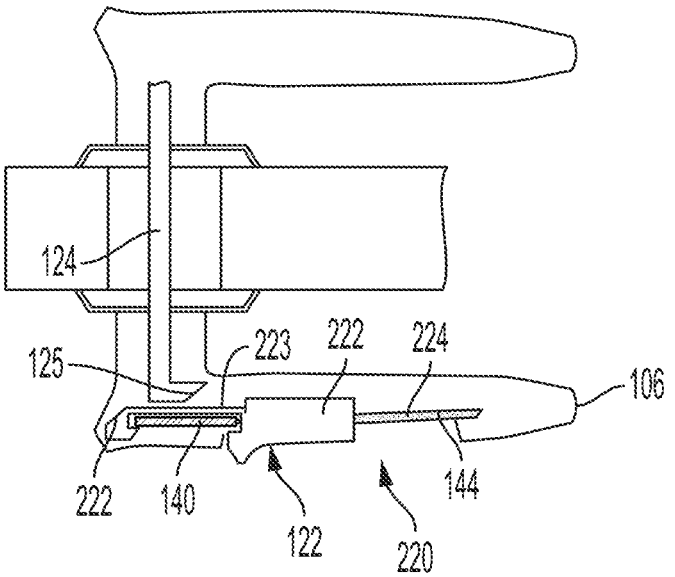
FIG. 8D shows a top section view of the eighth embodiment of an indicator door lock.

The lock slide 122 is configured for linear translation within cavity 221 and hole 220, and can translate from an unlocked position, as shown in FIGS. 8A and 8C, wherein the lock slide 122 is located at a relatively distal portion of the handle 106, and a locked position, as shown in FIGS. 8B and 8D, wherein the lock slide 122 is located at a relatively proximal portion of the handle 106. When in the unlocked position, the distal arm 225 of the lock slide 122, including locked indicator 144, is hidden inside a distal portion of cavity 221 such that it is not visible through opening 220. When unlocked, the proximal arm 223 of lock slide 122, including unlocked indicator 140, is visible through opening 220. To transition from the locked position to the unlocked position, lock slide 122 is slid in a proximal direction. When slid, the angled face 224 of the proximal arm 223 of the lock slide 122 exerts a force against the angled face 125 of the locking bar 124, causing the locking bar to translate along a longitudinal axis of the shank 108 towards the door. Moving the locking bar 124 as such transitions the door lock 100 to a locked state. When in the locked position, the proximal arm 223 of lock slide 122, including unlocked indicator 140 is hidden inside a proximal portion of cavity 221 such that it not visible through opening 220. When locked, the distal arm 225 of lock slide 122, including locked indicator 144 is visible through opening 220. To unlock the door, lock slide 120 is slid in a distal direction. While not pictured, it should be appreciated that translation of any of the aforementioned components, including lock slide 122 and locking bar 124 may be assisted and/or resisted by one or more springs in certain embodiments.

Figure 9A:
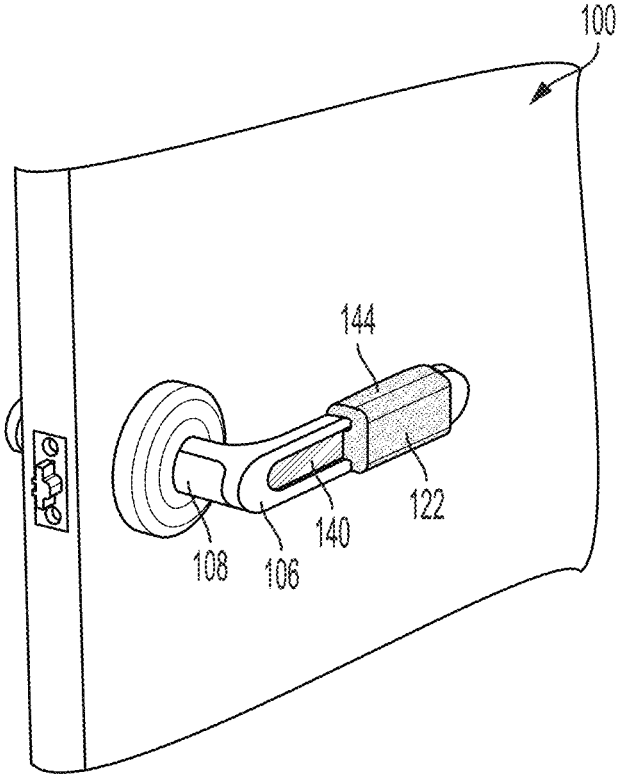
FIG. 9A shows a ninth embodiment of an indicator door lock.

FIG. 9A shows a ninth embodiment of an indictor door lock 100. The ninth embodiment also uses a lock slide 122, however in this embodiment, the lock slide 122 is configured as a rectangular tube arranged to wrap around the exterior surface interior door handle 106. The lock slide 122 may include indicia, such as the arrow shown, to guide users. The ninth embodiment lacks a window or similar opening through which movable locked and unlocked indicators are selectively exposed. Rather, the outward facing surface of handle 116 is configured to include unlocked indicator 140 and locked indicator 144

In an unlocked state, the lock slide is positioned on handle 106 such that unlocked indicator 140 is exposed and locked indicator 144 is covered and hidden. To transition the door lock 100 into a locked state, the lock slide 122 is translated along the handle 106 in a proximal direction towards the shank 108 until the lock slide covers and hides unlocked indicator 140 and exposes locked indicator 144 as shown in FIG. 9A. It should be appreciated that lock 100 comprises a suitable internal arrangement, such as that described in FIGS. 8A-8D, such that when the lock slide 122 is translated, the door lock 100 is transitioned to a locked state. To transition the door to an unlocked state, lock slide 120 translated along handle 106 in a distal direction away from the shank 108 exposing unlocked indicator 140 and covering and hiding locked indicator 144. It should be appreciated that translation of lock slide 122 may be assisted and/or resisted by one or more springs. Additionally, it should be appreciated that one or more detents or similar locking features may be present such that a user is made aware when the lock slide 122 has translated the complete distance from the locked and/or unlocked position. Additionally, such detents may prevent a user from inadvertently transitioning the lock from a locked to an unlocked state.

Figure 10A:
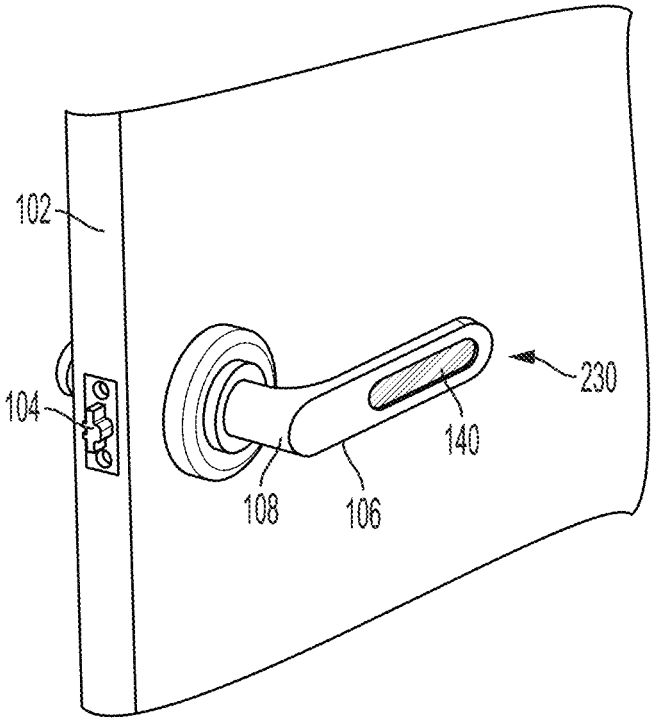
FIG. 10A shows a tenth embodiment of an indicator door lock in an unlocked state.
Figure 10B:
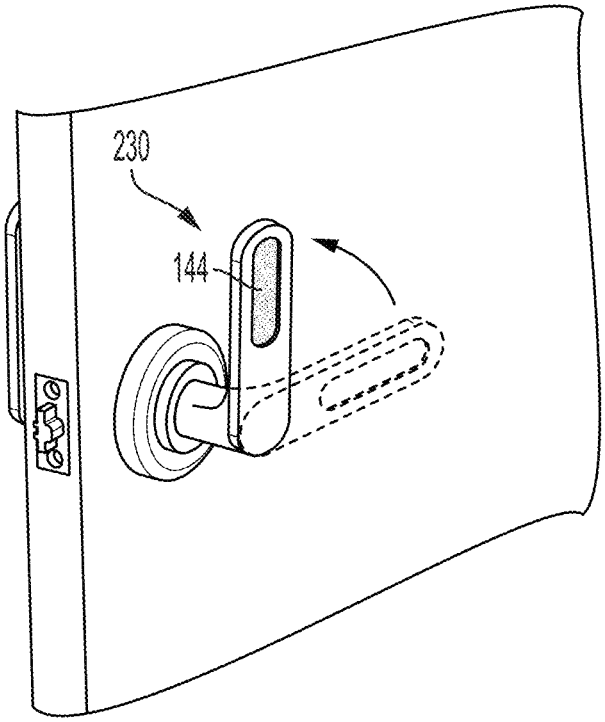
FIG. 10B shows the tenth embodiment of an indicator door lock in a locked state.
Figure 10C:
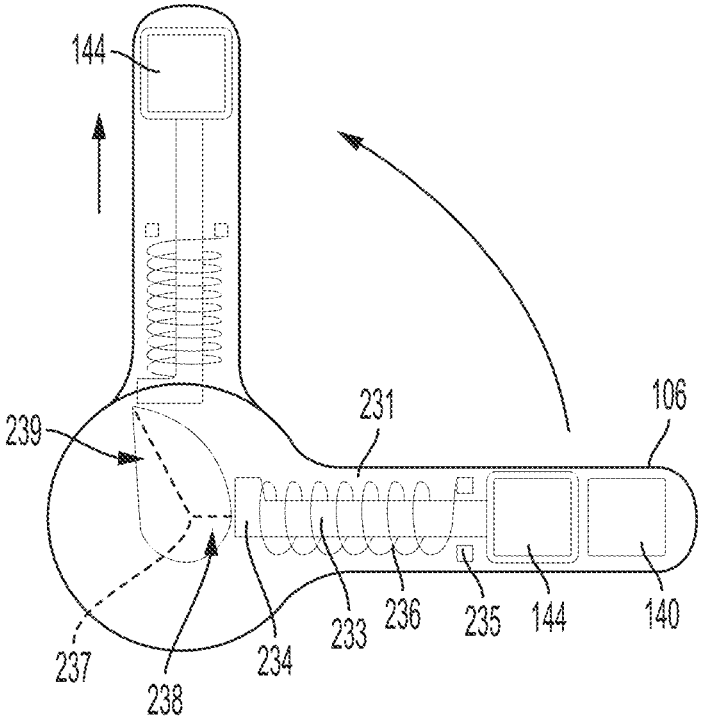
FIG. 10C shows a frontal section view of the tenth embodiment of an indicator door lock.

FIGS. 10A-10C show a tenth embodiment of an indicator door lock 100. As shown in FIG. 10C, interior door handle 106 comprises cavity 231 which extends through handle 106 along a longitudinal axis of handle 106 from a proximal end near shank 108 to a distal end opposite the proximal end. Stops 235, which may be configured as one or more plates, bars, or posts, extend into cavity 231 as shown. Unlocked indicator 140 is located in a distal end of cavity 231. Additionally, the distal end of handle 106 comprises a window 230. A cam 237 is located in the proximal portion of cavity 231. Cam is pear shaped, such that a first portion 238 of cam 237 has a shorter radius than a second portion 239 of cam 237. Cam 237 is mounted such that it does not rotate relative to door 102. An arm 233 is in contact with cam 236 at a base 234 of the arm 233. The arm 233 extends through cavity 231 along a longitudinal axis of handle 106 from the base 233 to a distal portion. A locked indicator 144 is coupled to the distal end of arm 233. A compression spring 236 is configured to coil around arm 233 between base 234 and stopping features 235. The compression spring 236 is configured to exert a force on the base 234 of arm 233 such that the base is biased away from stops 235.

As shown in FIG. 10A, door lock 100 is in an unlocked state when an interior door handle 106 is oriented such that a longitudinal axis of handle 106 is parallel to the ground. In the unlocked state, latch 104 is retracted, enabling door 102 to be opened, by rotating interior door handle 106 in a clockwise direction. Additionally, in the unlocked state compression spring 236 presses base 234 of arm 233 such that the base contacts the first portion of cam 238. When the base 234 of arm 233 is in contact with the first portion 238 of cam 237, locked indicator 144 is in a relatively proximal position. In this proximal position, locked indicator 144 is not visible through window. As a result, unlocked indicator 140 is visible through window 230. To transition indicator door lock 100 to a locked state, interior handle 106 is rotated in a relatively counterclockwise direction until the handle 106 is perpendicular to the ground. As the handle 100 is rotated in the counterclockwise direction, the base 234 of arm 233 travels from the first portion 238 of cam 237 to the second portion 239 of cam 237. The radius of the cam 237 at the contact point between the cam 237 and the base 234 gradually increases as the handle 106 is rotated counterclockwise, gradually pushing base 234, arm 233, and locked indicator 144 radially outwards against the force of spring 236 towards the distal end of handle 106. By the time the handle 106 arrives at the vertical position, 234, arm 233, and locked indicator 144 have moved far enough outwards that locked indicator 144 eclipses unlocked indicator 140. As a result, only locked indicator 144 is visible through window 230. To transition the indicator door lock 100 to an unlocked position, handle 106 is rotated clockwise from a position perpendicular to the ground to a position parallel with the ground. As the handle 100 is rotated in the clockwise direction, the base 234 of arm 233 travels from the second portion 239 of cam 237 to the first portion 238 of cam 237. The radius of the cam 237 at the contact point between the cam 237 and the base 234 gradually decreases as the handle 106 is rotated clockwise, gradually allowing spring 236 to push base 234, arm 233, and locked indicator 144 radially inwards towards the proximal end of the handle 106. When the handle is fully rotated to the unlocked position, locked indicator 144 moves out of alignment with window 230 such that it is hidden and unlocked indicator 140 is visible through window 230.

Figure 11A:
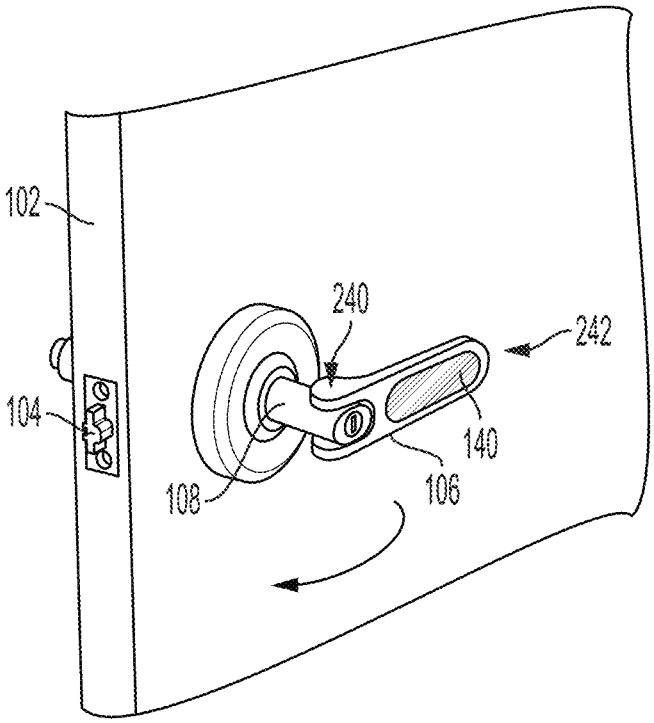
FIG. 11A shows an eleventh embodiment of an indicator door lock in an unlocked state.
Figure 11B:
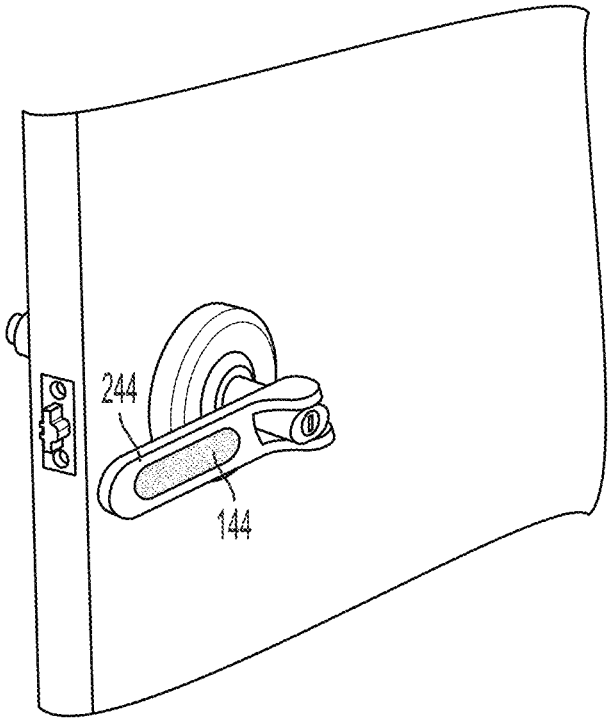
FIG. 11B shows the eleventh embodiment of an indicator door lock in a locked state.

FIGS. 11A-11B show an eleventh embodiment of an indicating door lock 100. The eleventh embodiment is configured such that the interior door handle 106 is pivotable about a vertical axis 240 formed in a distal end of the shank 108 opposite the door 102. FIG. 11A shows the door lock 100 in a first, unlocked state in which a first face 242 of the interior door handle 106 is oriented outwards away from the door 102. The first face 242 includes the unlocked indicator 140. FIG. 11B shows the door lock 100 in a second, locked state in which a second face 244 of the interior door handle 106 is oriented outwards away from the door 102. As the handle is pivoted 180 degrees about the axis 242 in a first direction to the second, locked state, the locking bar is translated inwards towards the door along a longitudinal axis of the shank 108, locking the door. As the handle is pivoted 180 degrees about the axis 242 in a second direction to the first, unlocked state, the locking bar is translated outwards away from the door along a longitudinal axis of the shank 108, unlocking the door. Similar with previous embodiments of door lock 100, the latch 104 is actuated, enabling the door to be opened, when the internal door handle 106 is rotated about an axis extending along a longitudinal axis of the shank 108.

Figure 12A:
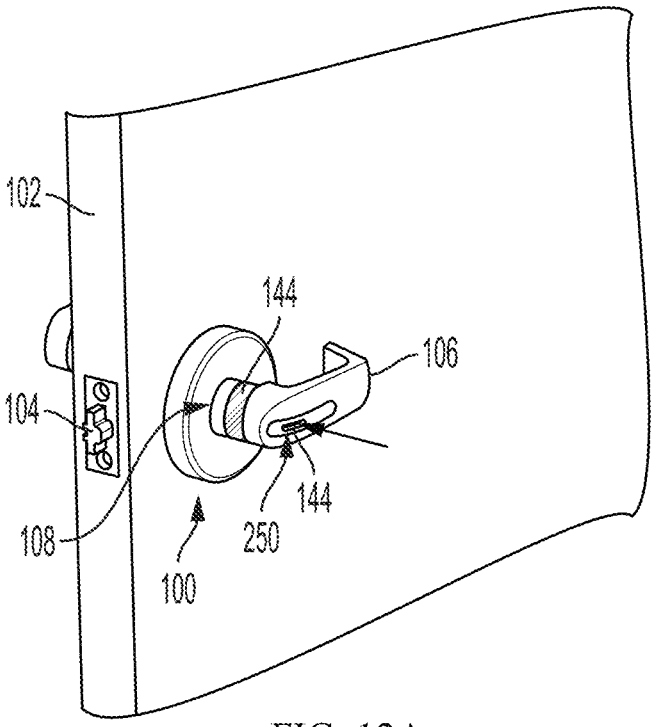
FIG. 12A shows a twelfth embodiment of an indicator door lock in an unlocked state.
Figure 12B:
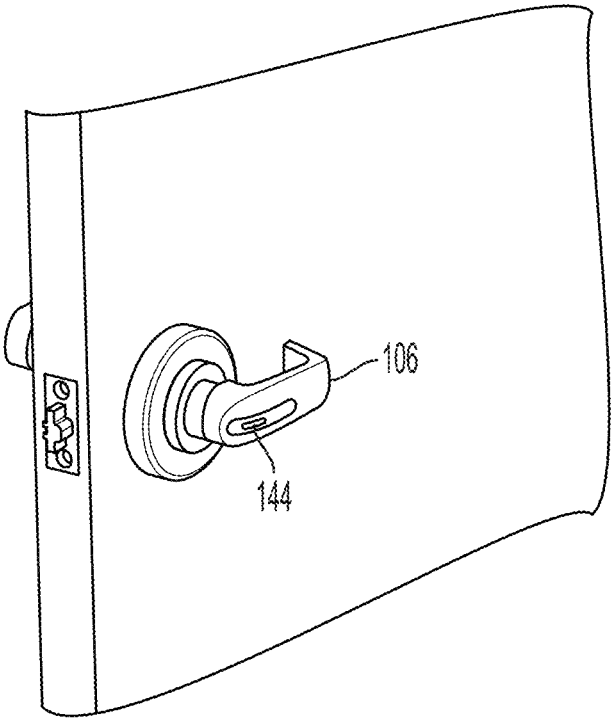
FIG. 12B shows the twelfth embodiment of an indicator door lock in a locked state.
Figure 12C:
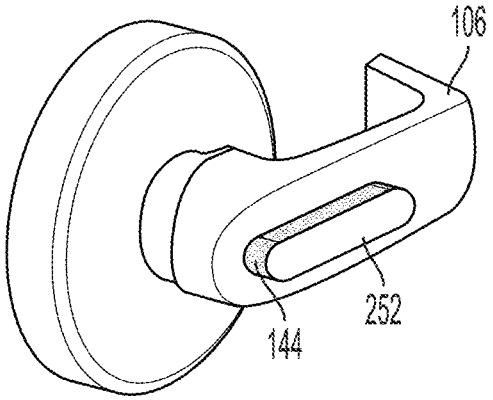
FIG. 12C shows a variant of the twelfth embodiment of an indicator door lock.

FIGS. 12A-12C show a twelfth embodiment on an indicating door lock 100. In the twelfth embodiment, the interior door handle 106 is configured to translate from an extended, unlocked position in which the handle 106 is relatively far from the door 102, to a retracted, locked position in which the handle 106 is relatively close to the door 102. In both positions, the longitudinal axis of the handle 106 remains parallel with the interior surface of door 102. The interior shank 108 comprises both the unlocked indicator 140 and the locked indicator 144. A distal portion of the exterior curved surface of interior shank 108 includes the unlocked indicator 140. The distal tip of the interior shank 108 includes the locked indicator 144. Additionally, the outward facing surface of handle 106 includes a window 250 located generally in front of the distal tip of shank 108 and locked indicator 144.

FIG. 12A shows the door lock 100 in the extended, unlocked position. In this position, the distal portion of shank 108 is exposed, revealing unlocked indicator 140. Additionally, in the extend, unlocked position, a sufficiently large gap exists between locked indicator 144 and the window 250 such that the locked indicator 144 is not visible. To transition the door lock 100 to the locked position, the interior door handle 106 is translated inward towards door 102 to the retracted, locked position. This translation also translates the locking bar, not pictured, inward, locking the door. In the inward, locked position, the interior door handle 106 covers a portion of the exterior surface of shank 108 such that the unlocked indicator 140 is not visible. Additionally, in this position, the gap between the locked indicator 144 and the window 250 is reduced such that the locked indicator 144 is visible through window 250. To unlock the door 100, the door handle 106 is translated outwards away from the door to the extended, unlocked position. This translation translates the locking bar, not pictured, outwards, unlocking the door. Additionally, the translation of handle 106 exposes unlocked indicator 106 and increases the gap between the locked indicator 144 and the window 250 such that the locked indicator is not visible. FIG. 12C shows an alternate embodiment wherein a button 252, the exterior curved surfaces of which are configured as the locked indicator 144, are exposed when door handle 106 is translated inwards towards the locked, retracted position.

Figure 13A:
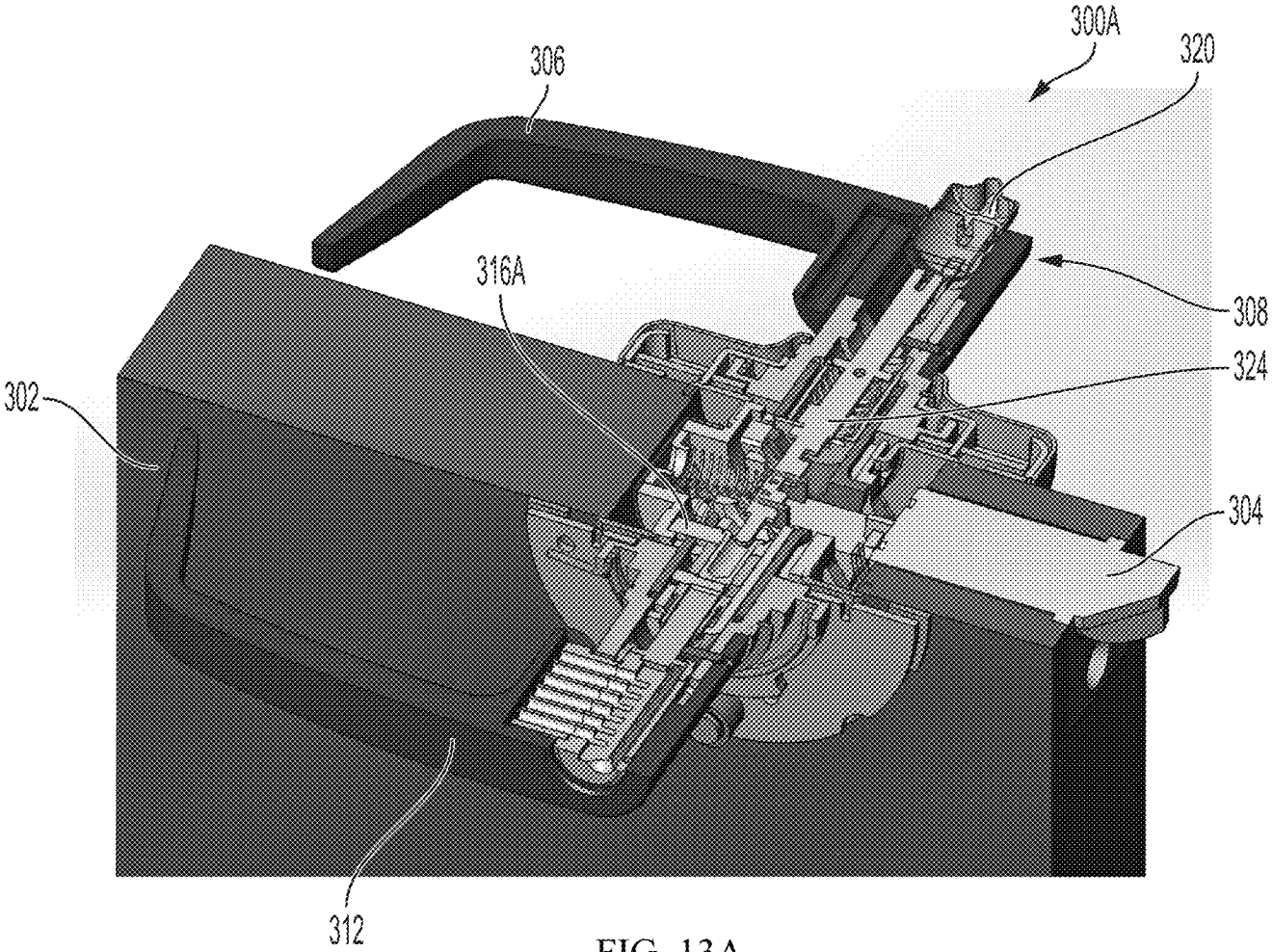
FIG. 13A shows a first embodiment of a non-indicator cylindrical door lock.
Figure 13B:
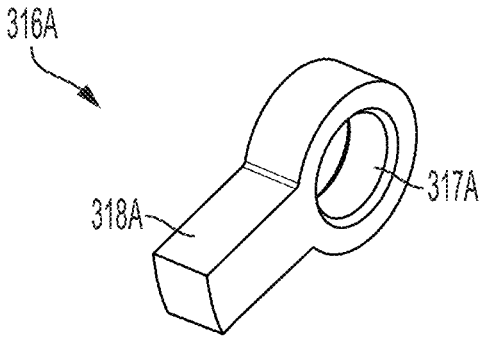
FIG. 13B shows a locking piece from the first embodiment of a non-indicator cylindrical door lock.

FIG. 13A shows one embodiment of a non-indicator cylindrical door lock 300A, which is not configured to indicate the lock status of the door lock 300A on the exterior surface of a door 302. The non-indicator door lock 300A comprises an interior handle 306 on an interior side of a door 302, and an exterior handle 312 on an exterior surface of the door 302. The interior handle 306 includes a lock button 320, which is operatively connected to a locking bar 324. Pressing the lock button 320 in a first direction towards the door 302 along a longitudinal axis of shank 308 causes locking bar 324 to move in the first direction along the same axis. The locking bar 324 is operatively connected to latch 304 such that when the locking bar moves a first distance in the first direction, it prevents the latch 304 from actuating, preventing the door 304 from being opened. The embodiment of a non-indicating door lock shown in FIG. 13A additionally includes locking piece 316A, which is highlighted in FIG. 13B. Locking piece 316A comprises a ring 317A, through which a portion of locking bar 324 extends. The locking piece 316A also comprises a first arm 318A that extends radially outwards from the ring 317A. The locking piece 316A is configured and arranged such that when the locking bar 324 moves in the first direction, the locking piece 316A also moves in the first direction.

Figure 14A:
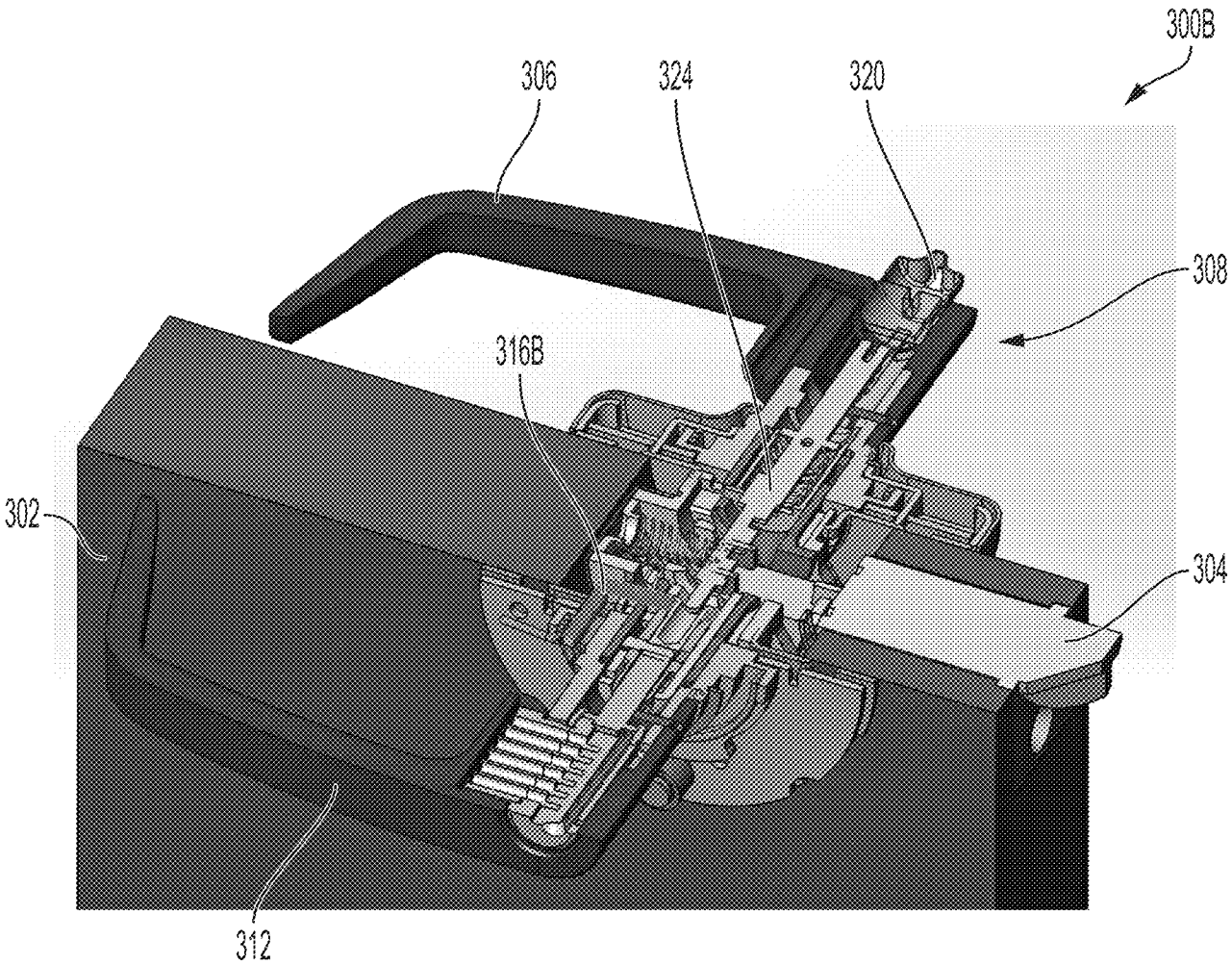
FIG. 14A shows a first embodiment of an indicator door lock configured to display lock status on an exterior surface of the door.

FIG. 14A shows one embodiment an indicating cylindrical door lock 300B, which is configured to indicate the lock status of the door lock 300B on the exterior side of a door 302. This indicator door lock 300B is similar to non-indicator door lock 300A, except for the locking piece 316B, which is configured to indicate the locks status on the exterior side of the door 302.

Figure 14B:
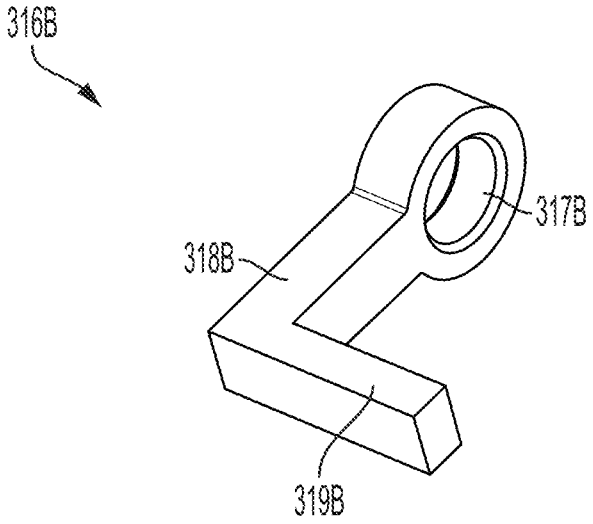
FIG. 14B shows a locking piece from the first embodiment of an indicator door lock configured to display lock status on an exterior surface of the door.
Figure 14C:
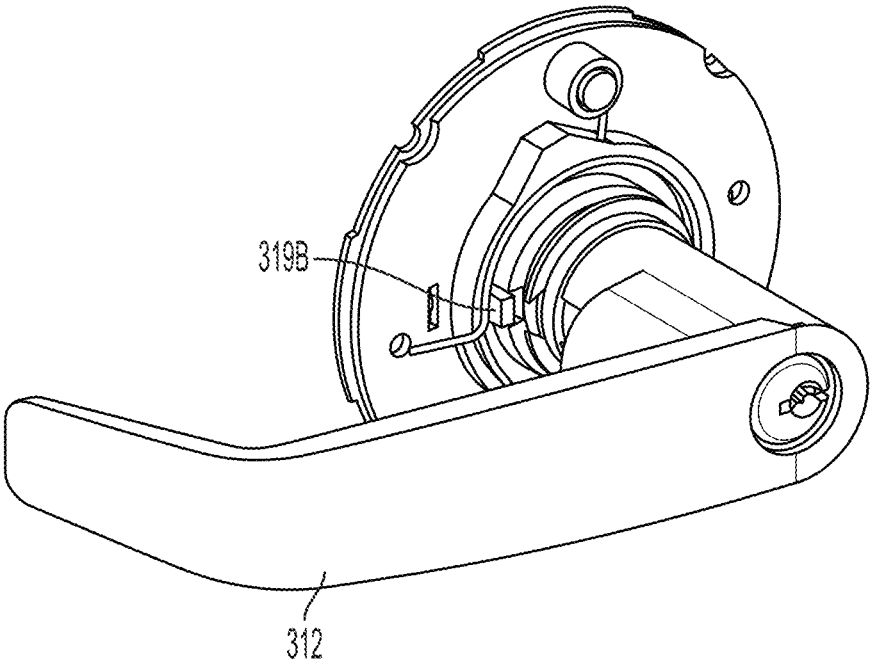
FIG. 14C shows the locking piece from the first embodiment of an indicator door lock as it would be visible from an exterior surface of the door.
Figure 14D:
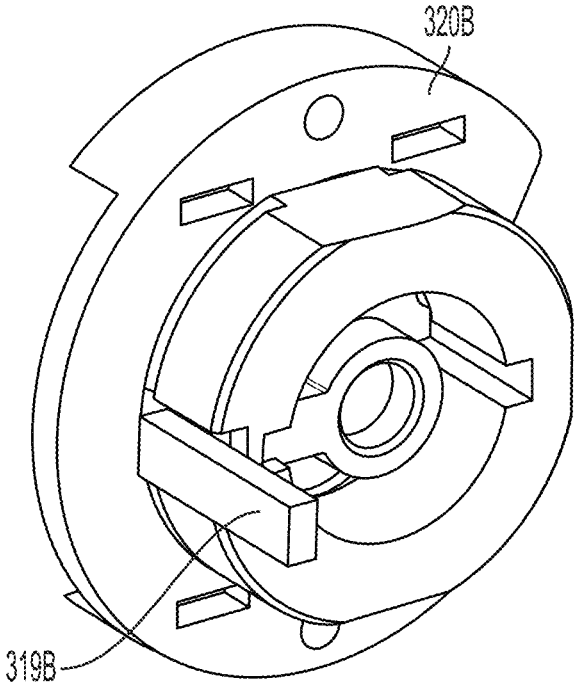
FIG. 14D shows an isolated view of the locking piece and locking ring from the first embodiment of an indicator lock.
Figure 14E:
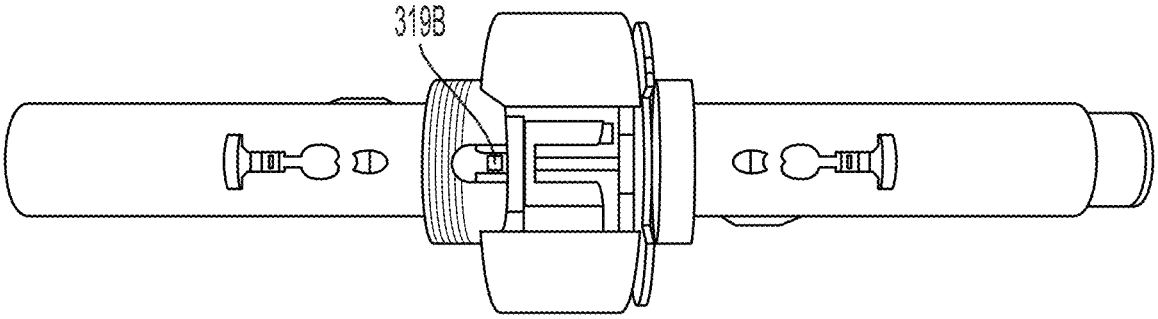
FIG. 14E shows modifications that may be made to the first embodiment to a non-indicator door lock such that it can become an indicator door lock.

Referring to FIG. 14B, a second arm 319B is coupled to the distal portion of the first arm 318B of lock piece 316B. The first arm 318B and second arm 319B are oriented perpendicular to each other, such that while the first arm 318B extends radially from ring 317B, the second arm extends in a direction parallel to the locking bar 324. As described earlier, the locking piece 316B is configured and arranged such that when the locking bar 324 moves in the first direction towards the locked state, the locking piece 316B and also moves in the first direction. This movement causes the distal tip of second arm 319B to move such that at least a portion of the distal end of the second arm 319B becomes visible at an exterior side of door 301 as shown in FIG. 14C. FIG. 14D shows an isolated view of the distal end of the second arm 319B as it protrudes from a locking ring 320B. This provides a visual indication to a use that the lock is in the locked state. Additionally, when the locking bar 324 moves in the second direction towards the unlocked state, the locking piece 316B moves in the second direction such that it is withdrawn and hidden at an exterior side of door 302. In some instances, the addition of second arm 319B may require additional modifications to be made to door lock 300B. For example, in some instances it may be necessary to remove material from other components to accommodate the second arm 319B as shown in FIG. 14E.

FIG. 15 shows a variety of door prep options for an indicator door lock 100. The embodiments depicted in FIGS. 1A-14E are configured such that no modifications to the door are required to install and operate the indicator lock. Thus, the embodiments of FIGS. 1A-12C would utilize the prep configuration shown in the first view, 1) Standard Door Prep.

FIGS. 16A-21C show multiple embodiments of dual indicator door locks. Each lock is configured such that the lock status is indicated to the interior and the exterior of the door to which they are mounted. In some embodiments, the transmission configured to mechanically communicate lock status from the interior of the door to the exterior of the door requires additional door modifications (e.g., the boring of additional holes, arcs, slots, channels, or other modifications). In such embodiments, the appropriate door prep configuration from FIG. 15 will be noted.

Figure 16A:
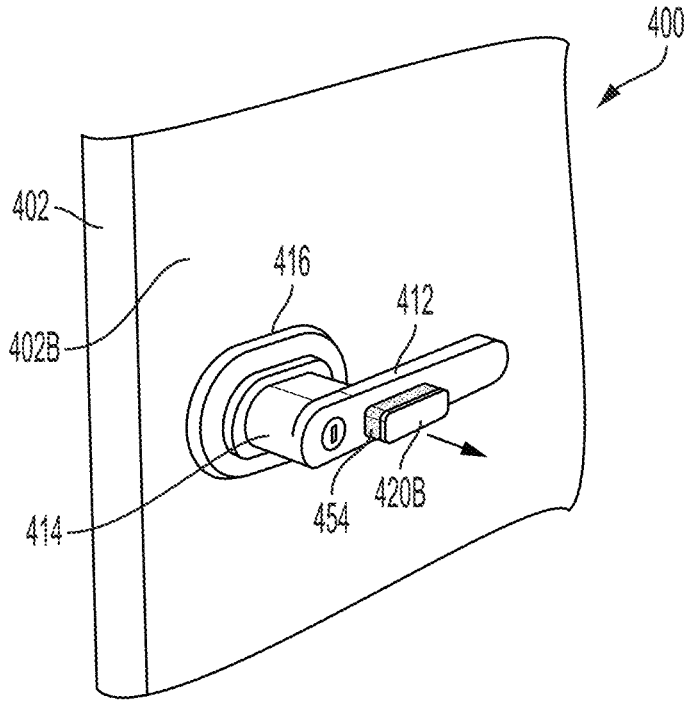
FIG. 16A shows the exterior handle of a first embodiment of a dual indicator door lock.

FIG. 16A-16D show a first embodiment of a dual indicator door lock 400. The dual indicator door lock 400 is configured to indicate the lock status of the lock 400 on an interior side 402A and an exterior side 402B of door 402. This embodiment is configured to use the second door prep configuration, 2) Single Drilled Hole, from FIG. 15. FIG. 16A shows the exterior side 402B of door 402. The lock 400, comprising an exterior handle 412, an exterior shank 414, and an exterior rose 416 is shown in the locked position as indicated by the exterior lock button 420B. In the locked position, the exterior lock button 420B extends outwards past the exterior surface of the exterior handle 412 such that a circumferential surface of the button 420B, configured as exterior locked indicator 454, is visible as shown.

Figure 16B:
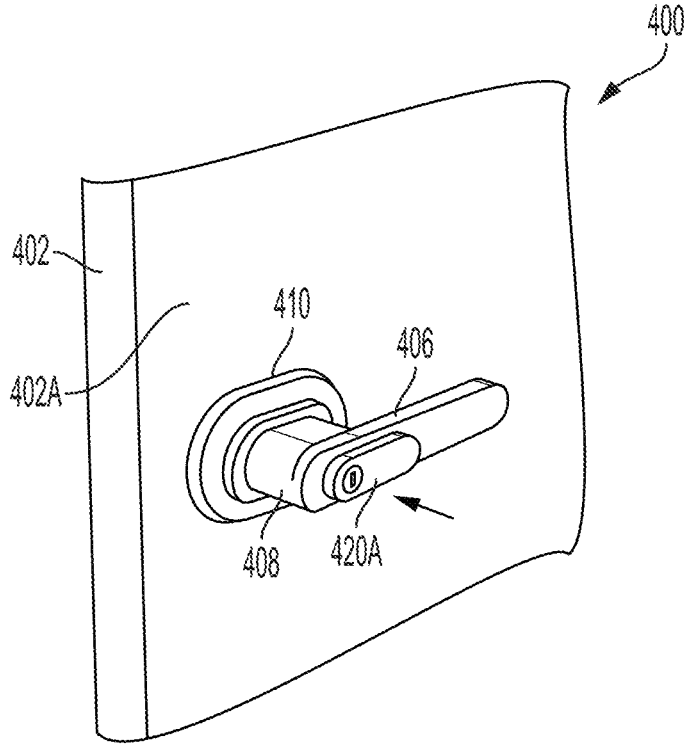
FIG. 16B shows the interior handle of the first embodiment of a dual indicator door lock.

FIG. 16B shows the interior side 402A of door 402. Lock 400, comprising an interior handle 406, an interior shank 408, and an interior rose 410 is shown in the unlocked position as indicated by the interior lock button 420A. In the unlocked position, the interior button 420A extends outwards past the exterior surface of the interior handle 406 such that a circumferential surface of the button 420A is visible. While not shown in this depiction, a circumferential surface of the internal lock button 420A may be configured as an internal unlocked 440 or an internal locked indicator 444 in some embodiments.

Figure 16C:
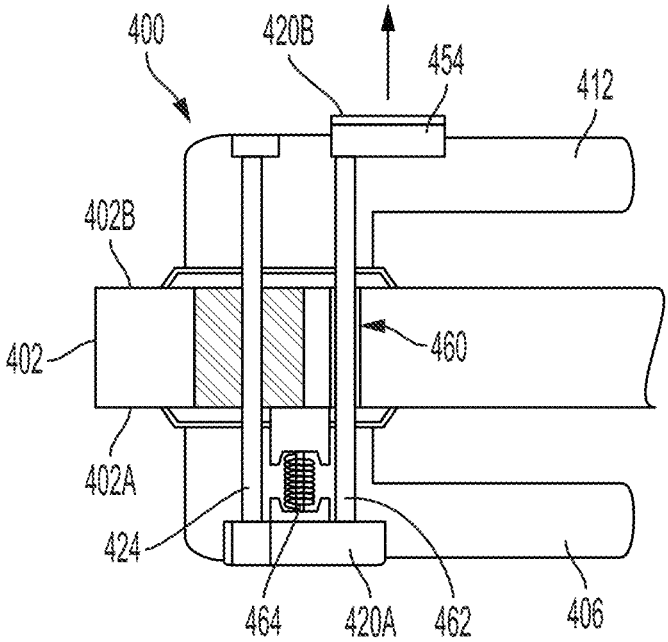
FIG. 16C shows a top section view of the first embodiment of a dual indicator door lock in a locked state.

FIG. 16C shows a section view of the first embodiment of a dual indicator lock 400 in the locked position. When in the locked position, interior button 420A is recessed within interior handle 420A such that the circumferential surface of the button 420A is hidden from view, and the terminal face of the button 420A is generally flush with the exterior surface of interior handle 406. When the interior button 420A is pressed inwards against the force of compression spring 464 to the recessed position, locking the door, the first locking bar 424 is translated inwards along a longitudinal axis of shank 408 such that the door latch (not pictured) is prevented from being actuated. Additionally, the second locking bar 462 is translated inwards along a longitudinal axis of the additional single drilled bore hole 460 such that it pushes exterior locking button 420 to the extended position such that exterior locked indicator 454 is visible. Thus, in the locked position, the lock status of door lock 400 is visible from the interior and exterior of door 402.

Figure 16D:
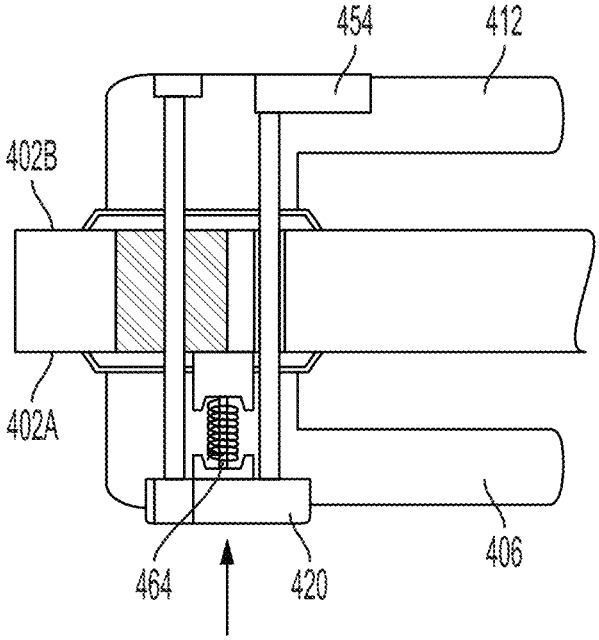
FIG. 16D shows a top section view of the first embodiment of a dual indicator door lock in an unlocked state.

FIG. 16D shows a section view of the first embodiment of a dual indicator lock 400 in the unlocked position. When in the unlocked position, exterior button 420B is recessed within exterior handle 412 such that the circumferential surface of the button 420B, configured as exterior locked indicator 454, is hidden from view, and the terminal face if the button 420B is flush with the exterior handle 412. Additionally, internal button 420 is in the extended position such that the circumferential surface of the button 420 is visible. As described earlier, it may be desirable for the door lock 400 to prevent exterior access when the door lock 400 is in the locked state. As such, the exterior handle 412 comprises an exterior keyway 466 operatively connected to locking bar 424. To transition the door lock 400 to an unlocked position, an appropriate key may be inserted into the keyway 466 and rotated. When the keyway 466 is rotated, internal mechanisms enable the spring 464 to expand, pressing the interior lock button 420 back into the extended position such that the locking bar 424 is translated outwards along a longitudinal axis of the interior door shank 408 such that the latch can be actuated. Additionally, the second locking bar 462 is translated along a longitudinal axis of the bore hole 460 such that the exterior lock button 420B returns to the recessed position.

Figure 17A:
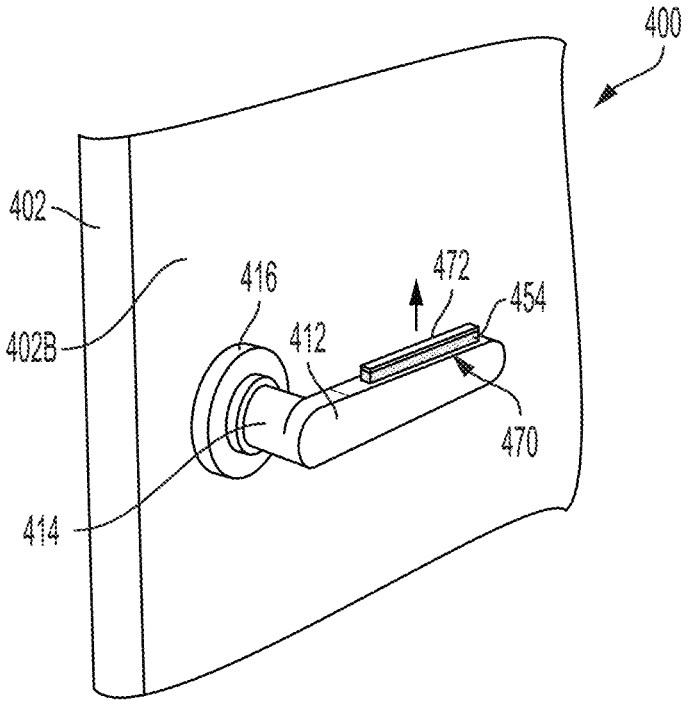
FIG. 17A shows the exterior handle of a second embodiment of a dual indicator door lock in a locked state.
Figure 17B:
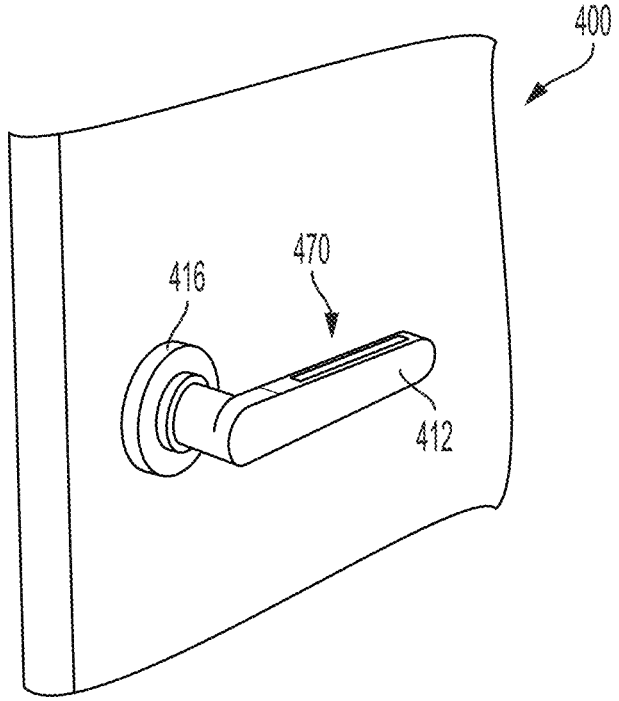
FIG. 17B shows the interior handle of the second embodiment of a dual indicator door lock in an unlocked state.

FIG. 17A-17D show a second embodiment of a dual indicating door lock 400. The second embodiment is configured to use the second door prep configuration, 2) Single Drilled Hole, from FIG. 15. FIG. 17A shows the exterior side 402B of door 402. The lock 400, comprises an exterior handle 412 with a slot 470 extending along an upper surface of the exterior handle 412 along a longitudinal axis of the handle 412. FIG. 17A shows the dual indicator lock 400 in the locked position. In this position, the indicator 472 is in a raised position such that the indicator 472 extends outwards through slot 470 past the upper exterior surface of the exterior handle 412. In this raised position, the side surface of the indicator 472, which is configured as the exterior locked indicator 454, is visible as shown. FIG. 17B shows the second embodiment of a dual indicating door lock 400 in the unlocked configuration. FIG. 17B shows the dual indicator lock 400 in the unlocked position. In this position, the indicator 472 is in a lowered position such that the indicator 472 is retracted into in the slot 470 of the exterior door handle 412. In this lowered position, the side surface of the indicator 472, which is configured as the exterior locked indicator 454, is hidden as shown.

Figure 17C:
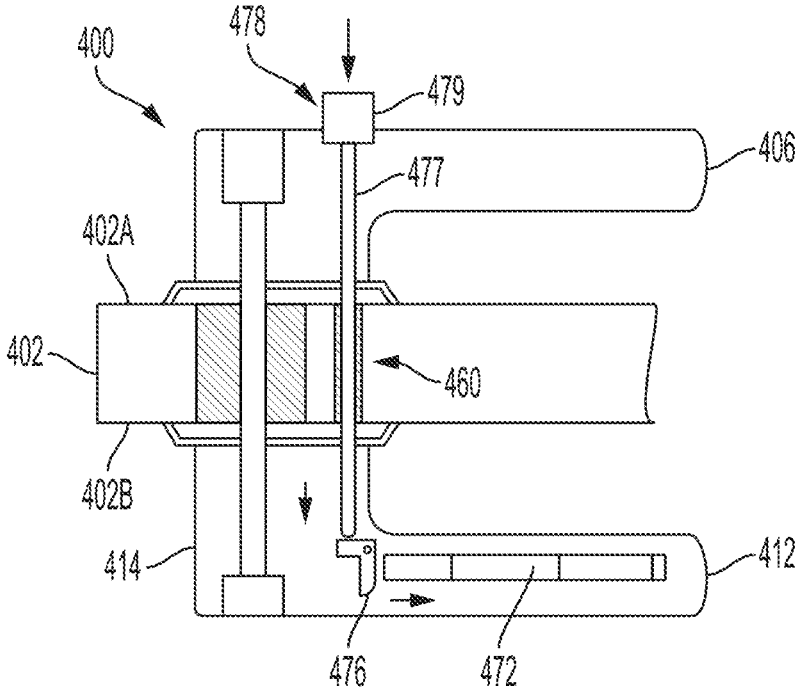
FIG. 17C shows a top section view of the second embodiment of a dual indicator door lock.
Figure 17D:
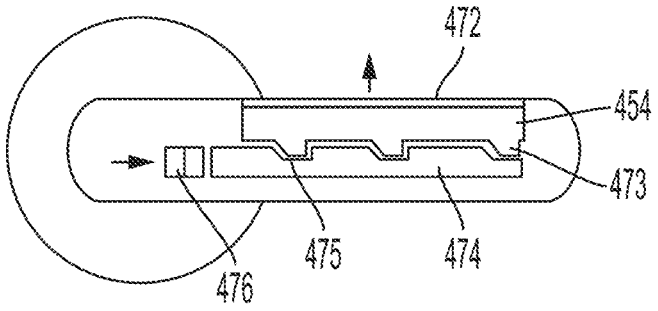
FIG. 17D shows a front section view of the second embodiment of a dual indicator door lock.

FIG. 17C shows a top cross-sectional view of the dual indicator door lock 400, and FIG. 17D shows a front cross-sectional view of the dual indicator door lock 400. In both embodiments, the lock 400 is in the unlocked state as shown by the retracted position of the indicator 472. As seen best in FIG. 17D, the lower portion of indicator 472 is configured to include one or more teeth 473. In this embodiment, the lower portion of indicator 472 includes three teeth 473, but it should be appreciated that any suitable number of teeth may be used. Each of the teeth 473 comprises an angled face which interfaces with a corresponding angled face on the one or more channels 475 of the translating riser 474. The translating riser 474 extends longitudinally through the interior of exterior handle 412 and is configured such that to translate along the longitudinal axis of the handle 412. At pivoting member 476 pivotably mounted to the interior of the exterior handle 412 at a proximal end of the handle near the exterior shank 414 and operatively connects the translating riser 474 to the indicating locking bar 477. The indicating locking bar 477 extends through the single drilled hole 460 in door 402. On a first side, the indicating locking bar 477 interfaces with the pivoting member 476, and on a second side, the indicating locking bar 477 is coupled to button 478. When door lock 400 is in the unlocked position as shown, button 487 is in the extended position such that a circumferential surface 479 of the button is viable.

To translate the dual indicator door lock 400 from an unlocked to a locked state, button 478 is pressed inwards towards door 402. As the button 478 is pressed inwards, it translates the indicating locking bar 477 inwards towards the exterior handle 412 along the axis of the single drilled hole 460. The linear motion of the indicating lock bar 477 is redirected and transitioned to the translating riser 474 by the pivoting member 476. The indicating locking bar 477 presses a first arm of the pivoting member 476, rotating the pivoting member 476 from a first position to a second position. This rotation causes a second arm of the pivoting member 476 to press the translating riser 474. As the translating riser 474 is translated towards the distal end of the exterior door handle 412, the angled surfaces of the slots 475 of the translating riser 474 press against the angled surfaces of the teeth 473 of the indicator 472. This motion causes the indictor 472 to rise vertically through slot 470 such that the exterior locked indicator 454 is visible. When the lock 400 is transitioned from the locked to the unlocked state, the process is reversed. The button is extended outwards, causing the indicating locking bar 477 to translated outwards away from the exterior handle 412 such that it does not apply a force to the first arm of the pivoting member 476. This allows the pivoting member 476 to rotate back from the second position to the first position. This allows the translating riser 474 to translate towards the proximal end of the exterior handle 412, allowing indicator 472 to be lowered into the retracted position such that the exterior locked indicator 454 is not viable. In come embodiments, pivoting member 476 may be configured with a torque spring such that it is biased towards the first position. Additionally, a compression spring or similar resilient member may be configured to bias the translating riser 474 towards the proximal end of the handle.

Figure 18A:
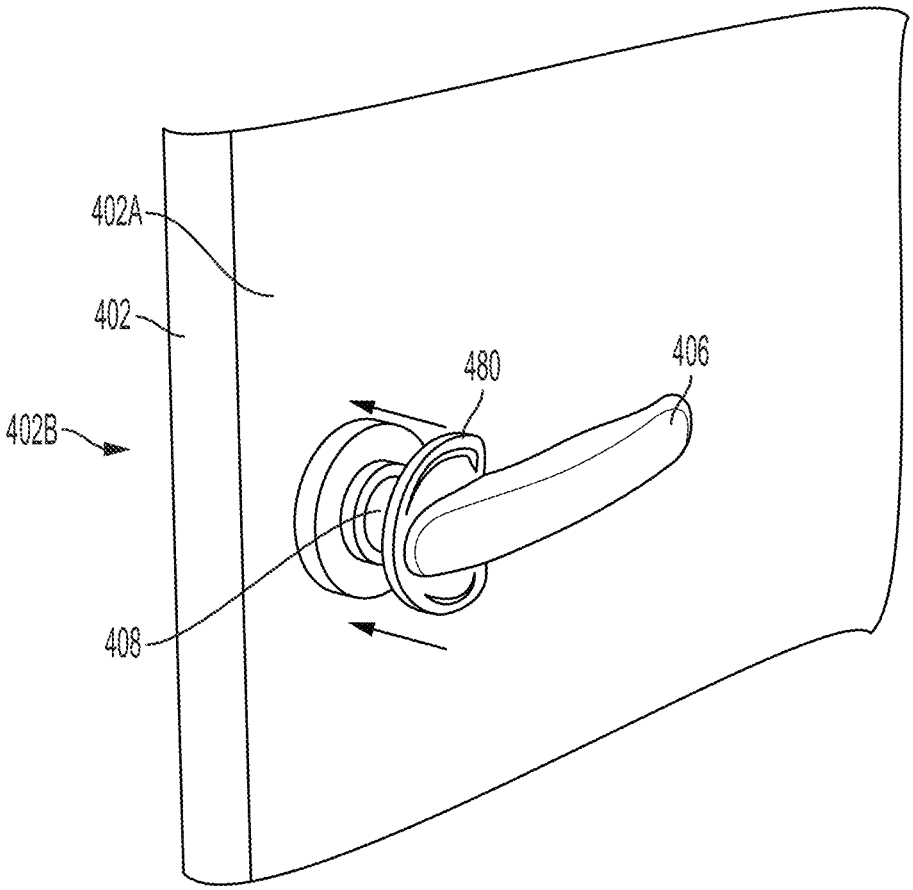
FIG. 18A shows a third embodiment of a dual indicator door lock.
Figure 18B:
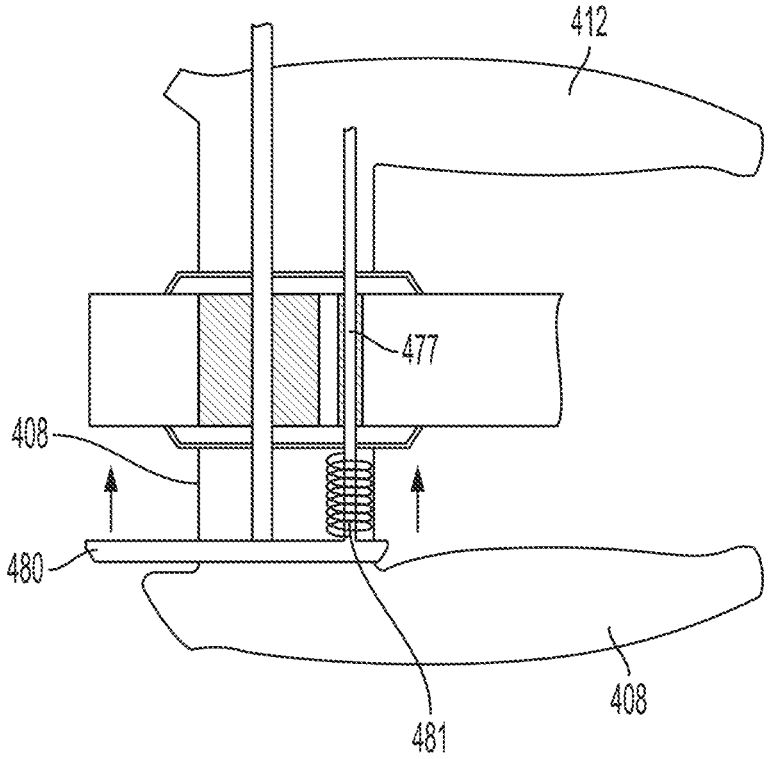
FIG. 18B shows a top section view of the third embodiment of a dual indicator door lock.

FIG. 18A-18B show a third embodiment of a dual indicator lock 400. The third embodiment is configured to use the second door prep configuration, 2) Single Drilled Hole, from FIG. 15. The indication mechanism and operation of the third embodiment is sufficiently similar to that of the second embodiment shown and described in FIGS. 17A-17B with the except that the button 478 has been replaced by a collar 480. The collar 480 is configured to wrap around the interior shank 408 of the door lock 400. Additionally, the collar 480 is configured to translate inwards towards the door 402 along the longitudinal axis of the interior shank 408. A spring 481 is located within the interior shank 408 and is configured to bias the collar 480 in the extended position. The lock 400 is translated to a locked state by pressing the collar 480 inwards towards the door 402 against the force of spring 481 translates an indicating locking bar 477 inwards through the single drilled hole 460. As with the previous embodiment, this motion is ultimately transferred to an indicator which displays the lock status on the exterior side 402B of door 400. When the door is unlocked, the collar is translated outwards away from the door 402.

Figure 19A:
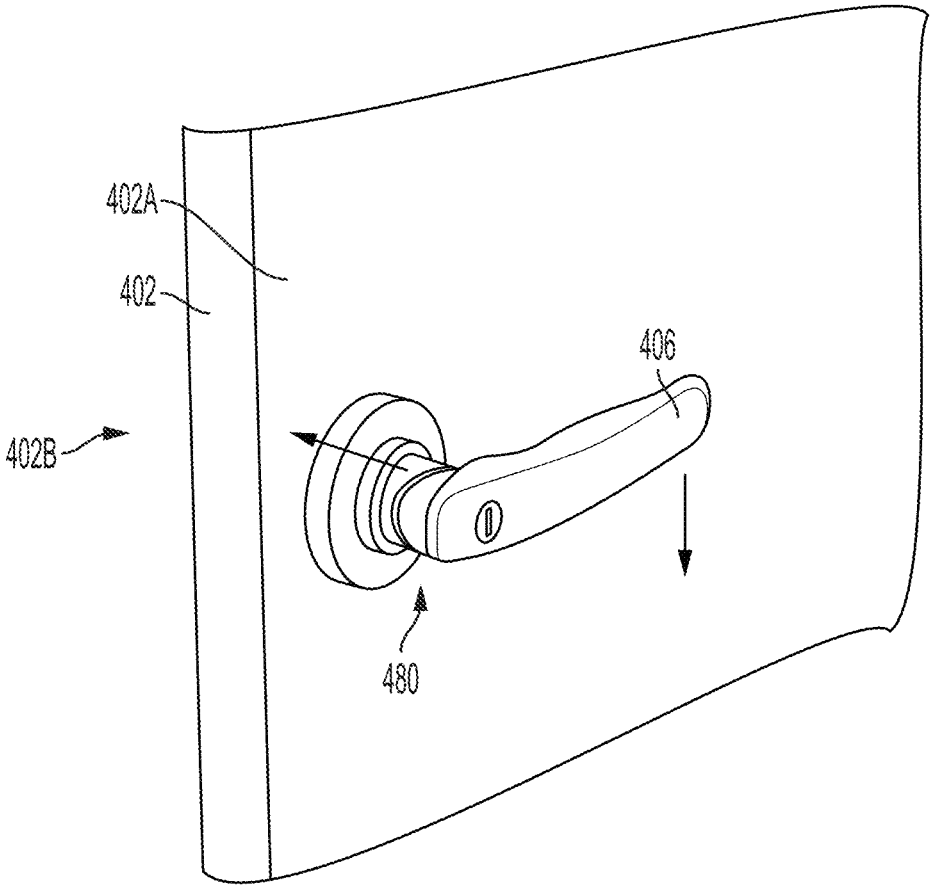
FIG. 19A shows a fourth embodiment of a dual indicator door lock.
Figure 19B:
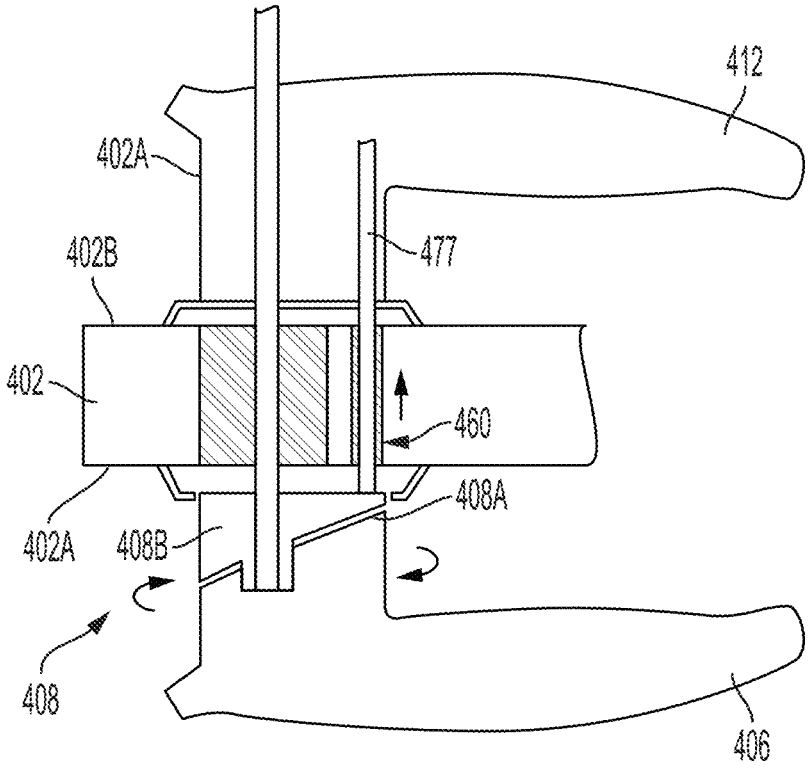
FIG. 19B shows a top section view of the fourth embodiment of a dual indicator door lock.

FIGS. 19A and 19B show a fourth embodiment of a dual indicator door lock 400. The fourth embodiment is configured to use the second door prep configuration, 2) Single Drilled Hole, from FIG. 15. The indication mechanism and operation of the fourth embodiment is sufficiently similar to previous embodiments, with the exception of how the indicating locking bar 477 is translated. In the fourth embodiment, the indicating locking bar is 477 is translated inwards through the single drilled hole 470 towards the door 402 along the longitudinal axis of the single drilled hole 470 when the interior handle 406 is rotated in the clockwise direction. As shown best in FIG. 19B, the interior shank 408 of the door lock comprises two sections. The first shank section 408A is coupled to the interior door handle 406. In the embodiment shown, the first shank section 408A is shown to be unitary with the interior door handle 406, however in other embodiments, the first shank section 408A may be a separate component coupled to the interior door handle 406. as shown, the portion of the first shank section arranged to face the door 402 has a sufficiently flat face that is not parallel with the interior face 402A of door 402, such that a first portion of the first shank section 408A is closer to the door 402 than a second portion of the first shank section 408A. The second shank section 408B comprises a sufficiently flat face that is also a not parallel to the interior face 402A of door 402, such that a first portion of the second shank section 408B is closer to the door 402 than a second portion of the second shank section 408B. The first and second shank sections 408A and 408B are co-axial and configured and arranged such that the two faces are parallel and in surface-to-surface contact when the handle is in the default orientation as shown. The second shank and additionally coupled to indicator locking bar 477, which, as with previous embodiments, is operatively coupled to one or more indicating mechanisms.

To lock the door lock 400, the interior door handle 106 is rotated in a clockwise direction. As a result, the first shank section 408A, which is coupled to the interior handle 106, also rotates in a clockwise direction. As it does, the angled face of the first shank section 408A rotates clockwise relative to the second shank section 408B, which does not rotate, while the two remaining co-axial. As a result, the flat angled face of the rotating first shank section 408A presses the flat angled face of the second shank 408B, causing the second shank section 408B to translate inwards towards door 402 along axis of the two shank sections 408A and 408B. As a result, the indicator locking bar 477 is translated inwards, eventually causing an indicating mechanism located on the exterior side of the door to indicate the door has entered a locked state. To unlock the door, the interior door handle 406 is rotated in a counterclockwise direction. As a result, the first shank section 408A rotates relative to the second shank section 408B such that the second shank section 408B is able to translate outwards away from door 402. While not shown in FIG. 19B, it should be appreciated that one or more compression springs or other biasing members may be included such that the second shank section 408B is biased towards the outer position.

Figure 20A:
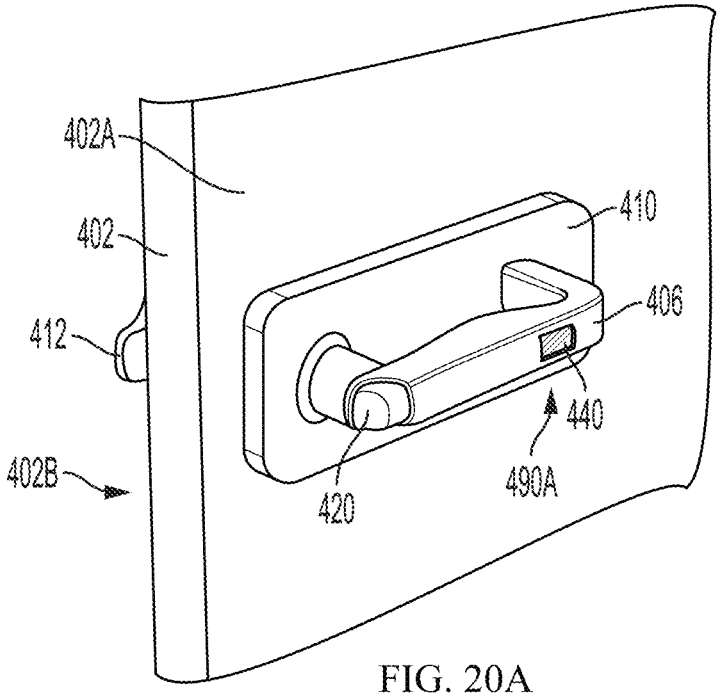
FIG. 20A shows a fifth embodiment of a dual indicator door lock in an unlocked state.
Figure 20B:
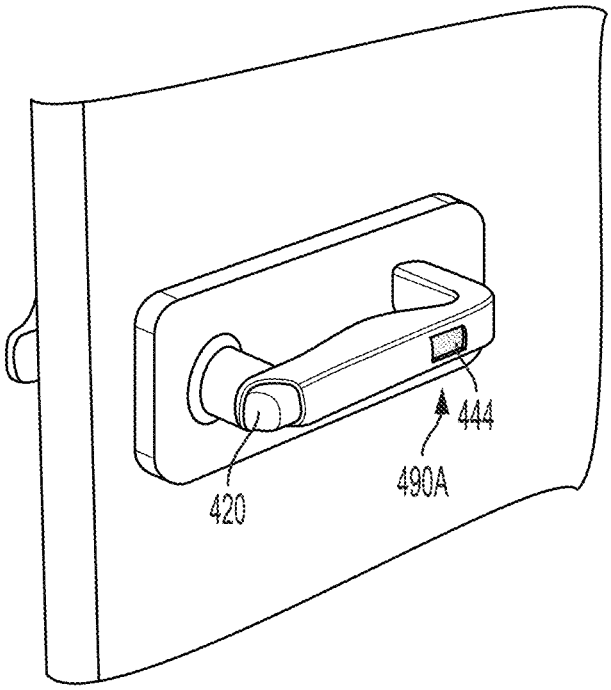
FIG. 20B shows the fifth embodiment of a dual indicator door lock in a locked state.
Figure 20C:
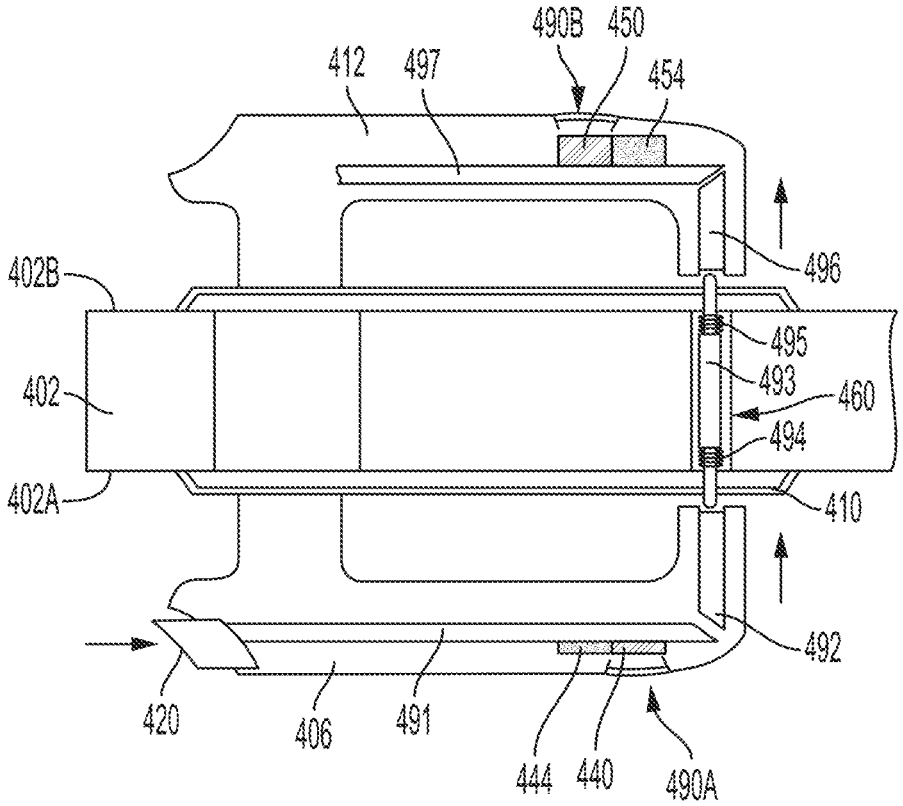
FIG. 20C shows a top section view of the fifth embodiment of a dual indicator door lock.

FIGS. 20A-20C show a fifth embodiment of a dual indicator door lock 400. The fifth embodiment is configured to use the second door prep configuration, 2) Single Drilled Hole, from FIG. 15. The fifth embodiment of the dual indicator door lock 400 is configured much like the fourth embodiment of the door indicator lock 100 shown in FIGS. 4A-4C. The interior door handle 406 comprises a lock button 420 located at a proximal end of the handle 406 close to the interior shank 408. The lock button 420 is configured to be actuated along the longitudinal axis of handle 406. The lock button 420 is coupled to a first interior locking shaft 491 which extends through a cavity in the interior handle along a longitudinal axis of the handle. The first interior locking shaft 491 comprises interior unlocked indicator 440 and interior locked indicator 444, which are both located on a relatively distal end of the first interior locking shaft 491. Both the locked and unlocked indicators 440 and 444 face outwards such that they are selectively viewable through the interior handle window 490A, formed in the outward facing surface of interior handle 406. The distalmost portion of the interior locking shaft 491 is angled, and interfaces with a corresponding angled interface of the second interior locking shaft 492. A door locking shaft 492 extends through the single drilled hole 460 in door 402. The door locking shaft 493 is coupled to an interior spring 494 and an exterior spring 495, which are configured to bias the door locking shaft 493 to a relatively central position within the single drilled hole 460. The exterior door handle 412 additionally comprises a first exterior locking shaft 497, which extends through a cavity in the exterior handle 412 along a longitudinal axis of the handle 412. The first exterior locking shaft 497 comprises exterior unlocked indicator 450 and interior locked indicator 454, which are both located on a relatively distal end of the first exterior locking shaft 497. Both the locked and unlocked indicators 450 and 454 face outwards such that they are selectively viewable through the exterior handle window 490B, formed in the outward facing surface of exterior handle 412. The distalmost portion of the first exterior locking shaft 497 is angled, and interfaces with a corresponding angled interface of the second exterior locking shaft 496.

When the dual indicator door lock 424 is in the unlocked state the interior lock button 420 is in a relatively extended state such that at least a portion of the lock button extends past the exterior surface of interior door handle 406. Additionally, when in the unlocked state, the interior unlocked indicator 440 is visible through the interior door handle window 490A, and the exterior unlocked indicator 450 is visible through the exterior door handle window 490B. To transition the door lock 400 to a locked state, the door lock button 430 is pressed towards the distal end of the interior door handle 406 along the longitudinal axis of the interior door handle 406. As a result, the first interior locking shaft 491 is also translated towards the distal end of the interior door handle 406 along the longitudinal axis of the interior door handle 406. The translation of the first interior locking shaft 491 shifts the indicator visible through interior handle window 490A from the unlocked indicator 440 to the locked indicator 444. Additionally, the motion is transferred to the second interior locking shaft 492. The second interior locking indicator 492 then transfers motion to the door locking shaft 492, which transfers the motion to the second exterior locking shaft 496. The first and second springs 494 and 495 of the door locking shaft 492 are configured such that after the motion has been transferred, the door locking shaft 492 returns to its relatively central position in the door 402 such that it does not interfere with the rotation of either the internal or the external door handles 408 and 412. The second exterior locking shaft 496 transfers the motion to the first exterior locking shaft 497, which translates along a longitudinal axis of the exterior handle 412 towards a proximal end of the handle. The translation of the first exterior locking shaft 497 shifts the indicator visible through exterior handle window 490B from the unlocked indicator 450 to the locked indicator 454. To transfer the lock back to the unlocked position, the process is reversed, and the interior and exterior unlocked indicators 440 and 450 again become visible through the interior and exterior door handle windows 490A and 490B.

Figure 21A:
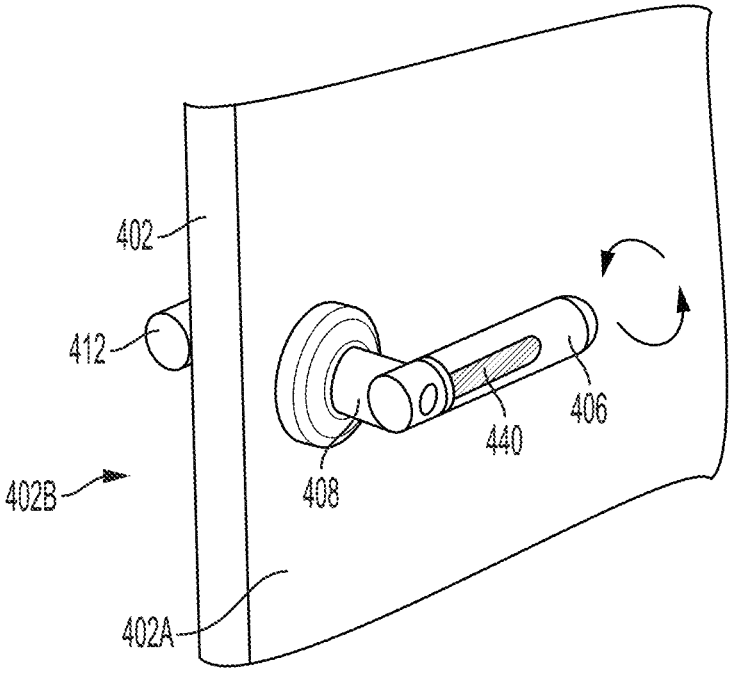
FIG. 21A shows a sixth embodiment of a dual indicator door lock in an unlocked state.
Figure 21B:
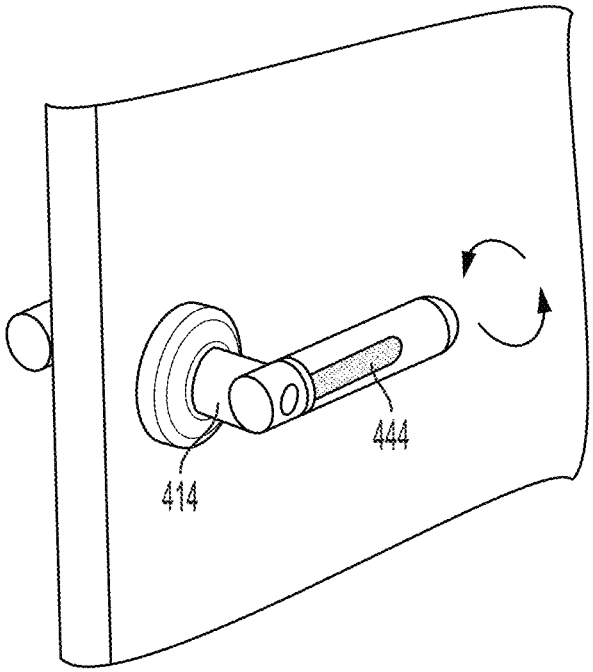
FIG. 21B shows the sixth embodiment of a dual indicator door lock in a locked state.
Figure 21C:
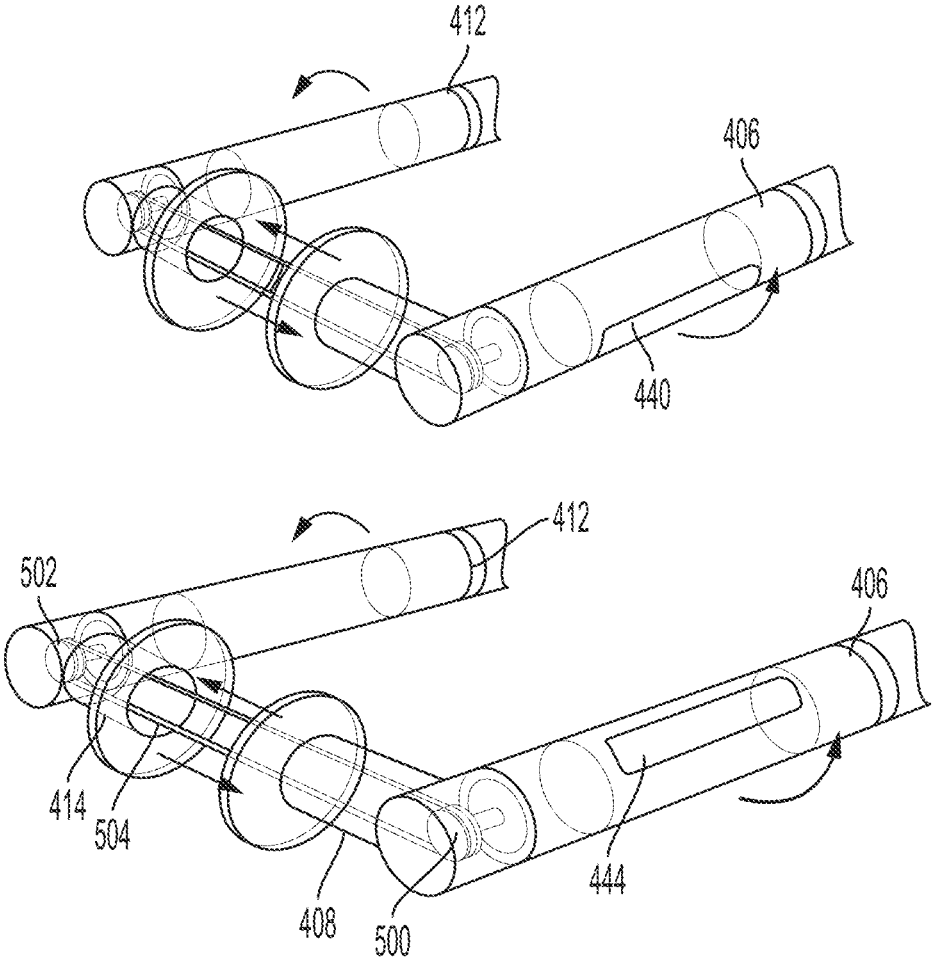
FIG. 21C shows an isometric section view of the sixth embodiment of a dual indicator door lock.

FIGS. 21A-21C show a sixth embodiment of a dual indicating door lock 400. The sixth embodiment is configured such that the door lock 400 is transitioned from a locked to an unlocked state by rotating the interior door handle 406 about the longitudinal axis of the handle. FIG. 21A shows the door lock 400 in the unlocked state. In an unlocked state, the interior door handle 406 is rotated such that the interior unlocked indicator 440 faces outwards from the door 402 and is visible and the interior locked indicator 444 faces inwards towards the door such that it is hidden. Similarly, in the unlocked state, the exterior door handle 412 is rotated such that the exterior unlocked indicator 450 faces outwards from the door 402 and is visible and the exterior locked indicator 454 faces inwards towards the door such that it is hidden. FIG. 21B shows the door lock 400 in the locked state. In the locked state, the interior door handle 406 is rotated such that the interior locked indicator 444 faces outwards from the door 402 and is visible and the interior unlocked indicator 440 faces inwards towards the door 402 such that it is hidden. Similarly, in the locked state, the exterior door handle 412 is rotated such that the exterior locked indicator 454 faces outwards from the door 402 and is visible and the exterior unlocked indicator 450 faces inwards towards the door 402 such that it is hidden.

Referring to FIG. 21C, the interior door handle 406 is coupled to an interior ring 500 such that the interior ring 500 rotates with the interior door handle 406. Similarly, the exterior door handle 412 is coupled to an exterior ring 502 such that the exterior ring 502 rotates with the exterior door handle 406. A belt running through the interior shank 408, door 402, and exterior shank 414 rotatably couples the interior and exterior rings 500 and 502. To transition the door lock 400 from an unlocked state to a locked state, the interior door handle 406 is rotated along a longitudinal axis of the handle 406 such that the interior unlocked indicator 440 is hidden and the interior locked indicator 444 becomes visible. As a result, the interior ring 500 rotates. The interior ring 500 causes the belt 504 to rotate, causing the exterior ring 502 and the exterior handle 412 to rotate such that the exterior unlocked indicator 450 is hidden and the exterior locked indicator 454 is visible. To unlock the door, the process is repeated in reverse. The interior handle 406 is rotated until the interior unlocked indicator 440 is visible and the interior locked indicator 444 is hiding. This rotation is transferred to the external handle via the internal ring 500, the belt 504, and the external ring 502. In some embodiments the interior and exterior handles 406 and 412 are configured to rotate in a single direction. In other embodiments, the interior and exterior handles 406 and 412 are configured to rotate in both directions. In some embodiments, one or more detents are included such that the handle resists rotating in certain positions, for example, the interior and exterior handles 406 and 412 may resist motion when they are in the locked and/or the unlocked positions.

Figure 22A:
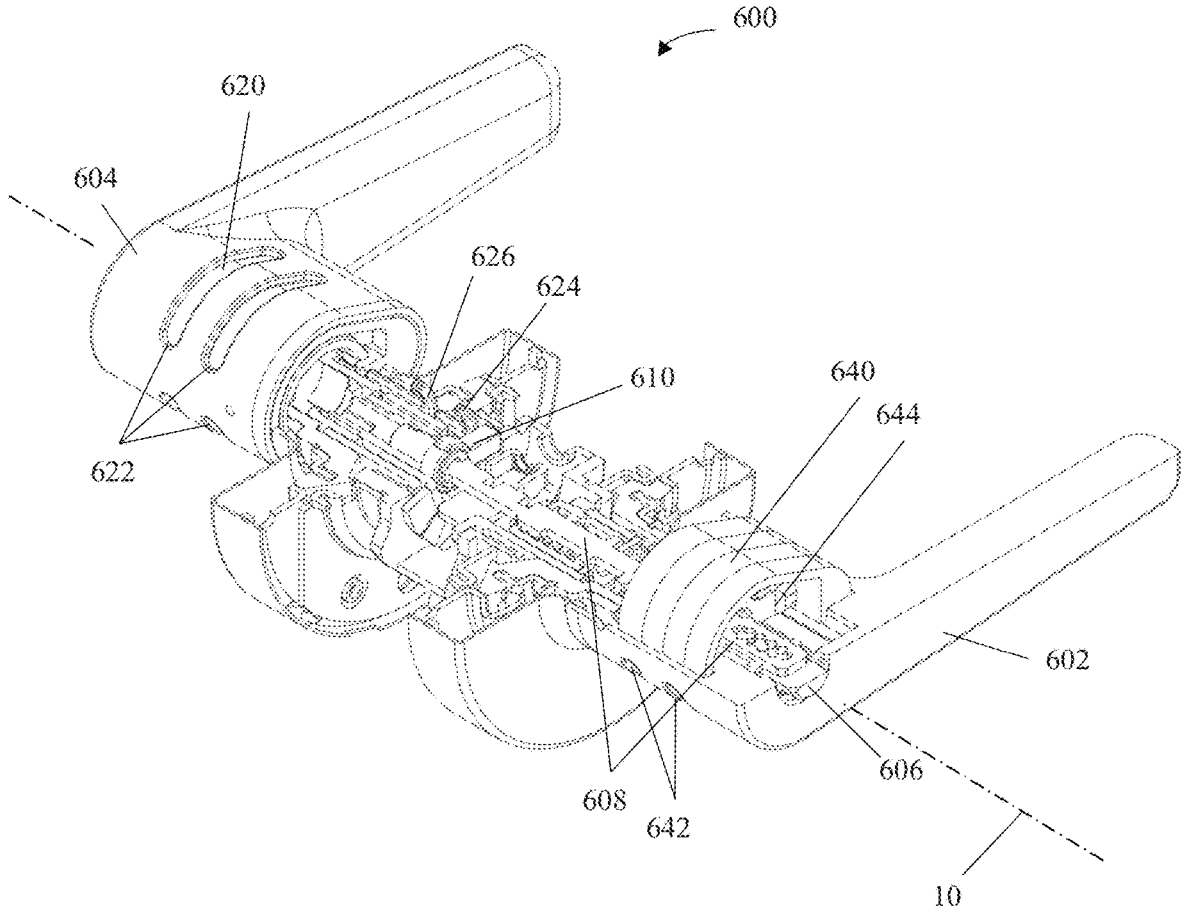
FIG. 22A shows an embodiment of indicator cylindrical door lock.
Figure 22B:
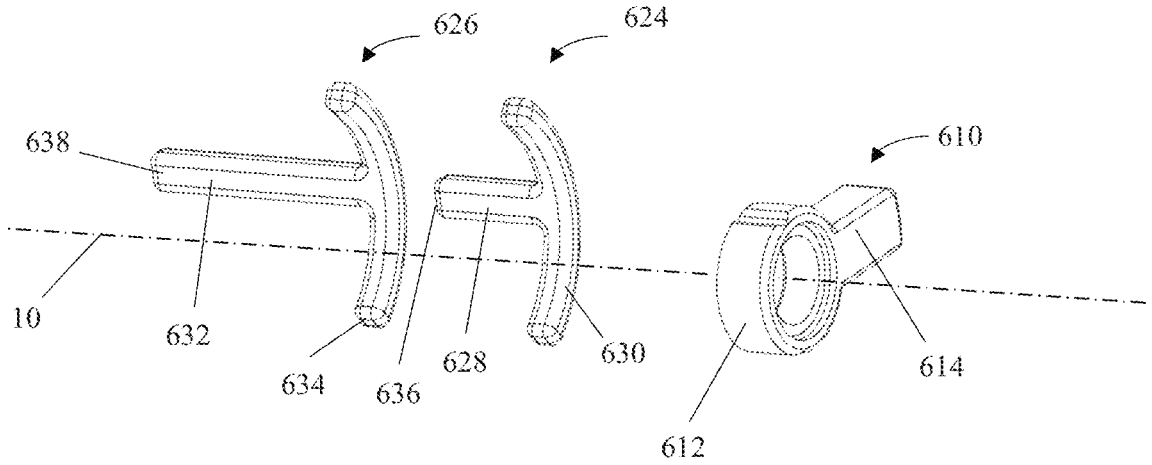
FIG. 22B shows components of the indicator cylindrical door lock of FIG. 22A.
Figure 22C:
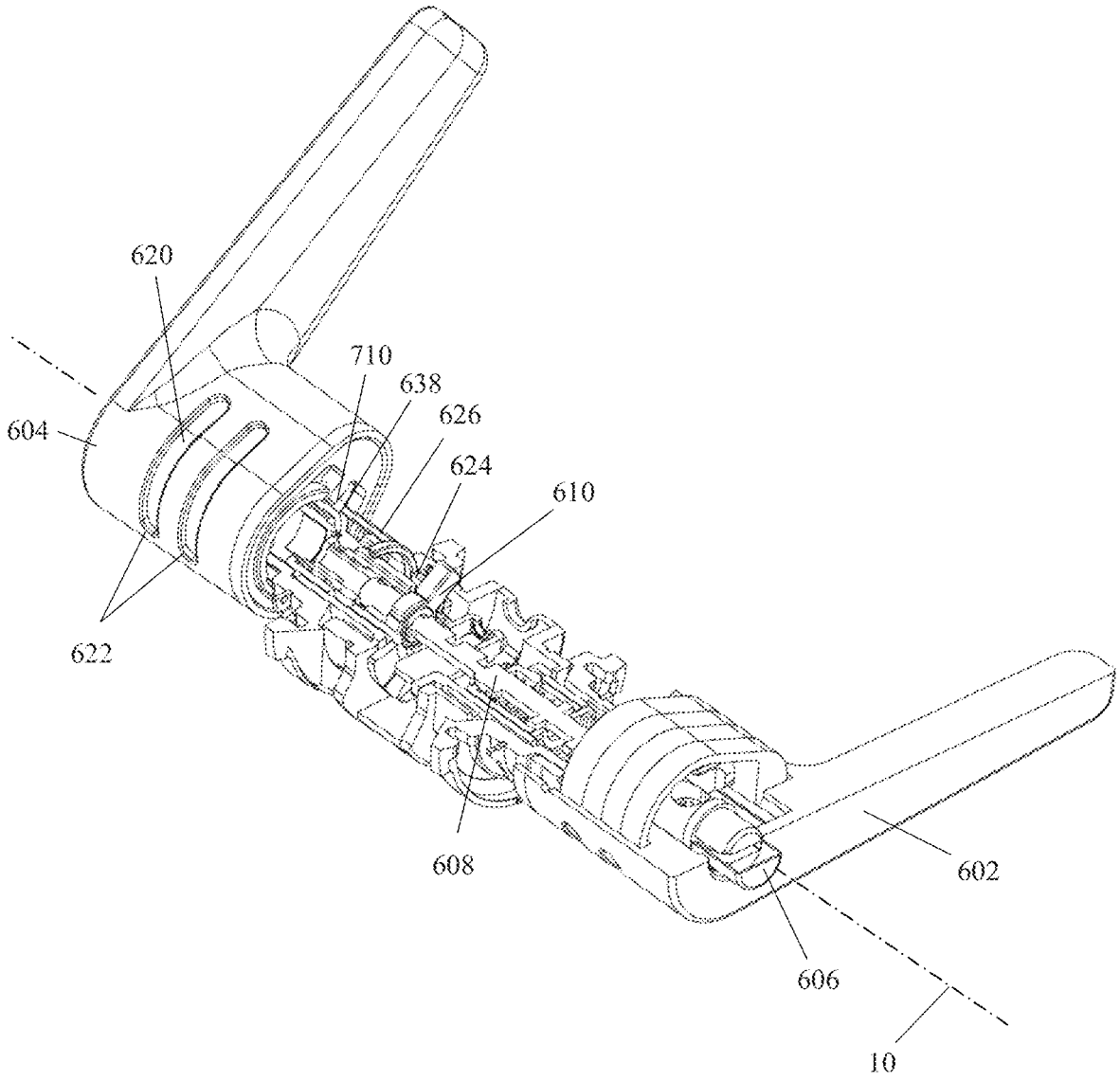
FIG. 22C shows the indicator cylindrical door lock of FIG. 22A in an unlocked state and the locking piece and the exterior handle rotated.
Figure 22D:
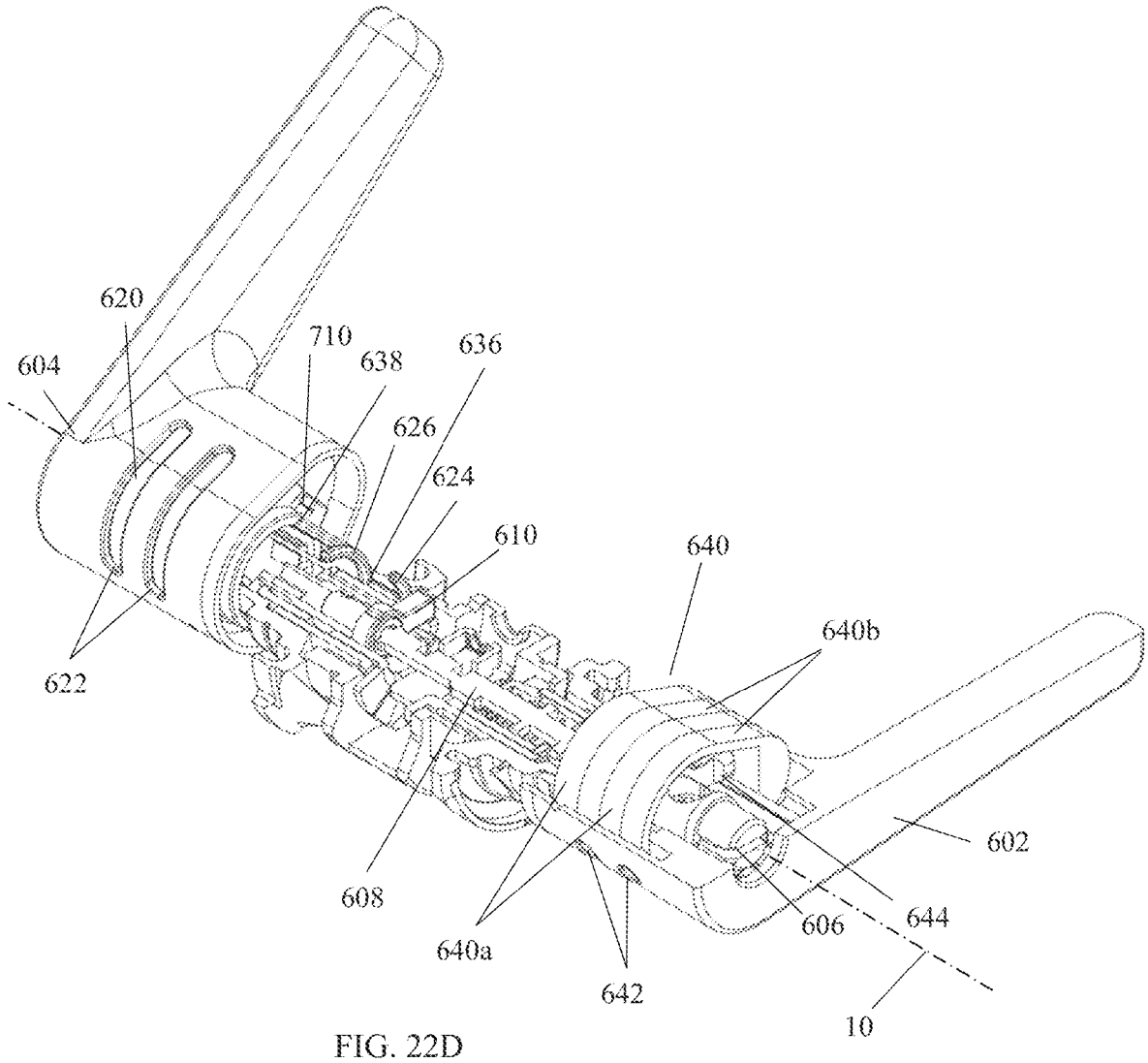
FIG. 22D shows the indicator cylindrical door lock of FIG. 22A in a locked state and the exterior handle rotated.
Figure 22E:
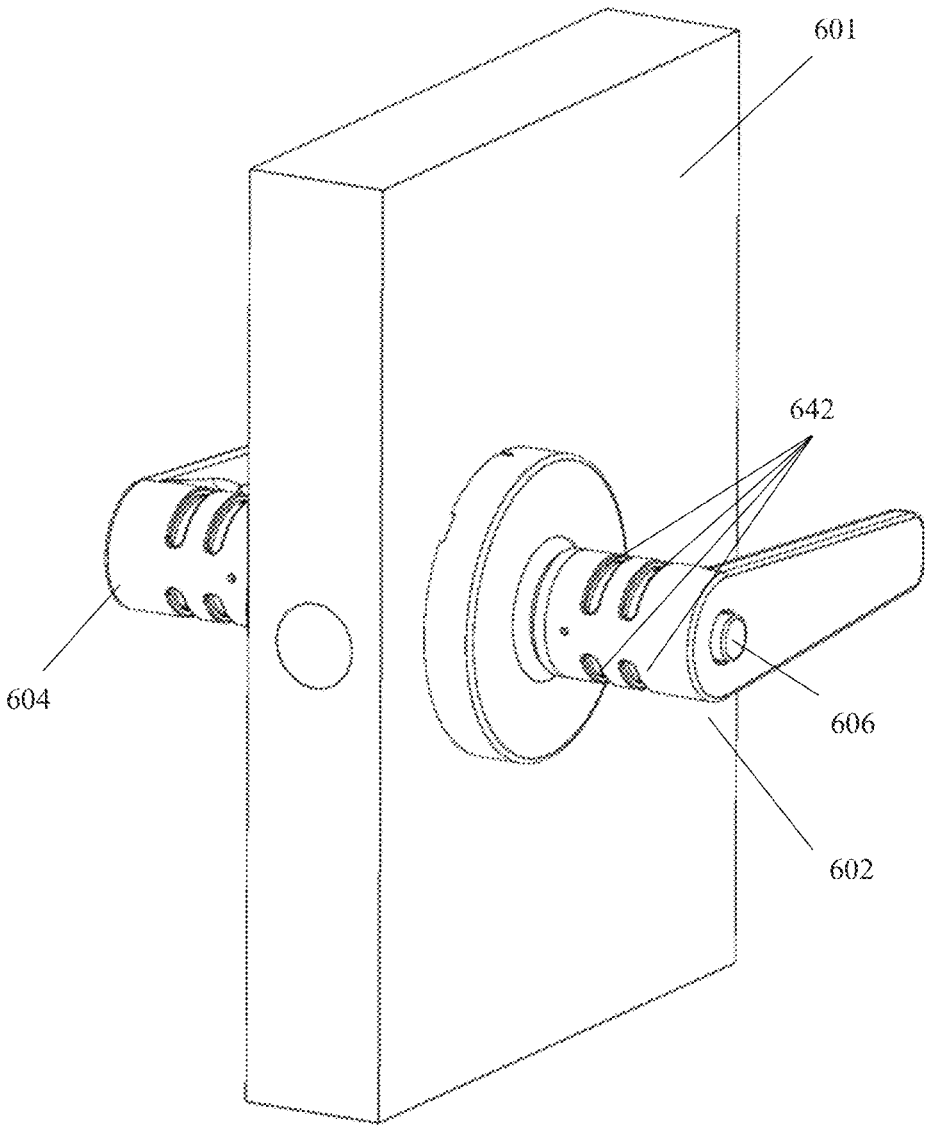
FIG. 22E shows the embodiment of FIG. 22A as a dual indicator cylindrical door lock.

FIG. 22A shows one embodiment of an indicator cylindrical door lock 600 which is configured to indicate the lock status of the door lock 600 on the exterior surface of a door 601 (see FIG. 22E). The indicator door lock 600 includes an interior handle 602 and an exterior handle 604. It should be noted that although a lever is shown, the disclosure is not so limited, and the interior handle or exterior handle may include other door hardware such as a knob in some embodiments. As such, as used herein, handle includes any hardware for grasping and manipulating the door lock to retract the door latch. A lock button 606 is disposed within the interior handle 602 and is operatively coupled to a locking bar 608 that is aligned along a lock axis 10 extending between the interior handle and the exterior handle. Pressing the lock button 606 in a first direction towards the exterior handle 604 along the lock axis 10 causes locking bar 608 to move in the first direction along the lock axis 10.

The indicator cylindrical door lock embodiment of FIG. 22A may also include a locking piece 610 rotationally coupled to the locking bar 608, which is shown in an enlarged view in FIG. 22B. As shown in FIG. 22B, the locking piece 610 includes a ring 612, through which a portion of locking bar 608 extends. The locking piece 610 also includes a first arm 614 that extends radially outwards from the ring 612. The locking piece 610 is configured and arranged such that when the locking bar 608 moves in the first direction, the locking piece 610 also moves in the first direction. The locking piece 610 is operatively coupled to a latch (not shown) such that when the locking bar moves a first distance in the first direction, the locking piece prevents the latch from retracting, preventing the door from being opened. It should be noted that the indicator door lock may be either a free-wheeling lock assembly, which allows the exterior handle to rotate when the door lock is in a locked position, or a rigid lock assembly, which prevents the exterior handle from rotating when the door lock is in a locked position.

Turning back to FIG. 22A, the exterior handle 604 may include an indicator 620 that displays a status of the door lock through at least one opening 622 in a surface of the exterior handle 604. For example, the indicator may display different colors through the opening, such as red to indicate a locked status and green to indicate an unlocked status, as will be discussed below. The lock button 606 may be operatively coupled to the indicator 620 such that axial motion of the lock button 606 causes the indicator 620 to move (e.g., axially or rotationally) to display a different color through the opening upon a change in the lock status.

To transfer the axial motion of the lock button 606 to the indicator 620 to cause the indicator to move, the door lock 600 may include a first bar 624 and a second bar 626, which are highlighted in FIG. 22B. The first bar 624 may be formed generally as a t-shaped bar with a straight portion 628 attached to a curved portion 630. The first bar 624 may be configured and arranged in the door lock 600 such that the straight portion 628 is aligned along an axis offset and parallel to the lock axis 10 and the curved portion 630 engages a surface of the first arm 614 of locking piece 610. In some embodiments, the curved portion 630 may have a sufficient radial extent about the lock axis 10 such that the first arm 614 of locking piece may engage the curved portion 630 regardless of whether it is in a home or rotated position, as explained above. For example, as shown in FIG. 22C, the locking piece is rotated upwards about the lock axis 10. Even in this rotated position, the first arm 614 engages the curved portion 630 of the first bar 624. As such, when the locking piece 610 moves axially toward the exterior handle 604, the locking piece 610 presses against the curved portion 630 of the first bar 624, causing the first bar to move axially with the locking piece 610.

Figure 23A:
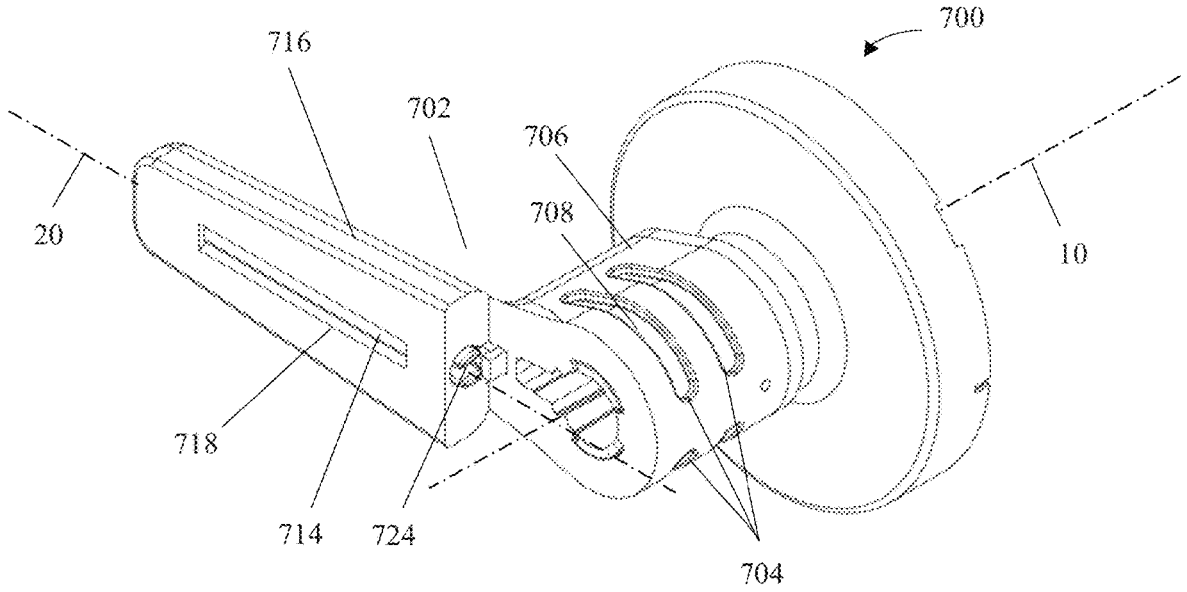
FIG. 23A shows another embodiment of an indicator door lock with a lever partially cut away.
Figure 23B:
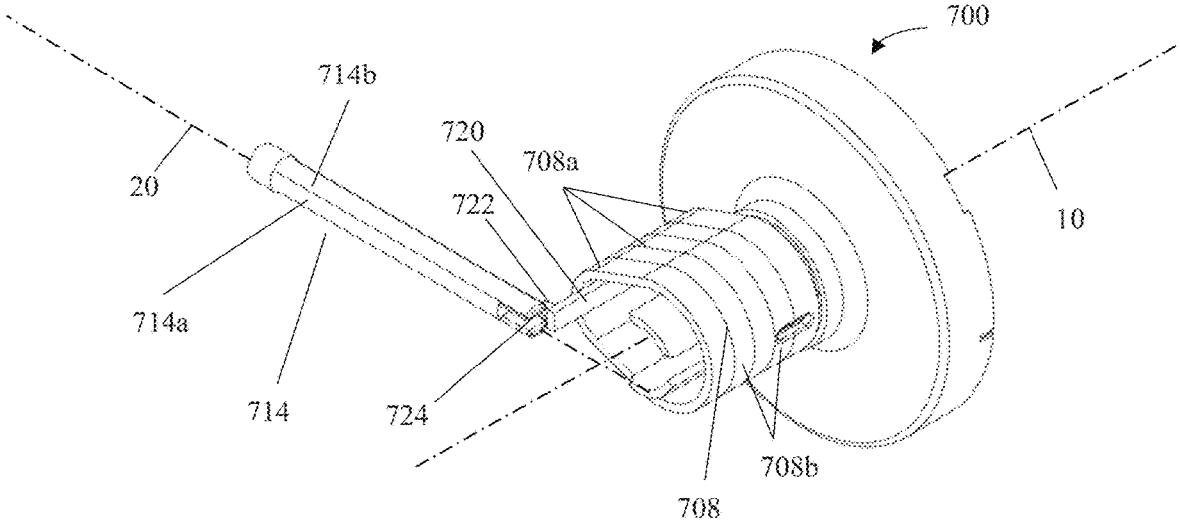
FIG. 23B shows the indicator door lock of FIG. 23A with the lever removed.

Similar to the first bar 624, as shown in FIG. 23B, the second bar 626 may be formed generally as a t-shaped bar with a straight portion 632 attached to a curved portion 634. The second bar 626 may be configured and arranged in the door lock 600 such that the straight portion 632 is aligned along an axis offset and parallel to the lock axis 10 and the curved portion 630 engages an exterior end 636 of straight portion 628 of the first bar 624. Upon axial motion of the first bar 624 toward the exterior handle 604, the end surface 636 presses against the curved portion 634 to cause the second bar 626 to move axially with the first bar toward the exterior handle. Accordingly, axial motion of the lock button 606 is transferred to the second bar 626 through the locking bar 608, the locking piece 610, and the first bar 624.

In some embodiments, an end surface 638 of the second bar 626 may be operatively coupled to the indicator disposed within the exterior handle 604. Axial motion of the second bar 626 may cause the indicator 620 to move to display a change in status of the door lock. For example, end surface 638 may press against a surface of the indicator to overcome a spring force to move the indicator from a first position to a second position. When the end surface 638 is not pressing against the surface of the indicator, the spring may bias the indicator into the first position. The end surface 638 rotates with exterior handle 604, regardless of the status of the door lock (e.g., locked or unlocked), to maintain the indicator in the proper position to display the correct door lock status. In some embodiments, the second bar 626, arranged in the shank of the exterior handle, rotates with the exterior handle about the lock axis 10, whereas the first bar 624 does not rotate.

As shown in FIG. 22A-22B, when the exterior handle 604 is in a neutral position (i.e., not rotated), the first bar 624 and the second bar 626 are aligned such that the straight portions 628, 632 extend along the same axis. FIG. 22D shows the door lock 600 in a locked configuration (i.e., lock button is pressed in a direction toward the exterior handle) and the exterior handle 604 and second bar 626 are in a rotated position. To ensure that the lock button 606 is still operatively coupled to the indicator in the exterior handle, the curved portion 634 may have a sufficient radial extent about the lock axis 10 such that the end surface 636 of the first bar 624 may engage the curved portion 634 regardless of whether or the second bar is in a rotated state. The second bar may be rotated up or down while still engaging the end surface 636. Thus, the end surface 638 of the second bar 626 may maintain the indicator in a position to display the locked status of the door lock.

FIGS. 22A-22E also show an embodiment of a dual indicator door lock that indicates the status of the door lock on exterior handle 604 as well as on the interior handle 602. It should be noted that the exterior handle of the dual indicator lock is not limited to the embodiment shown in FIGS. 22A-22F and therefore any of the exterior indicators described herein may be used. The interior handle 602 may include an interior indicator 640 that displays the door lock status through one or more openings 642 in the interior handle (see FIG. 22E). The interior indicator 640 may have alternating colors (e.g., green portions 640*a* and red portions 640*b* indicate the unlocked and locked states, respectively) that display through the openings to indicate a locked or unlocked status of the lock. The interior indicator 640 may be coupled to the lock button 606 such that when the lock button 606 moves axial, the second indicator moves axially with the lock button.

Figure 22F:
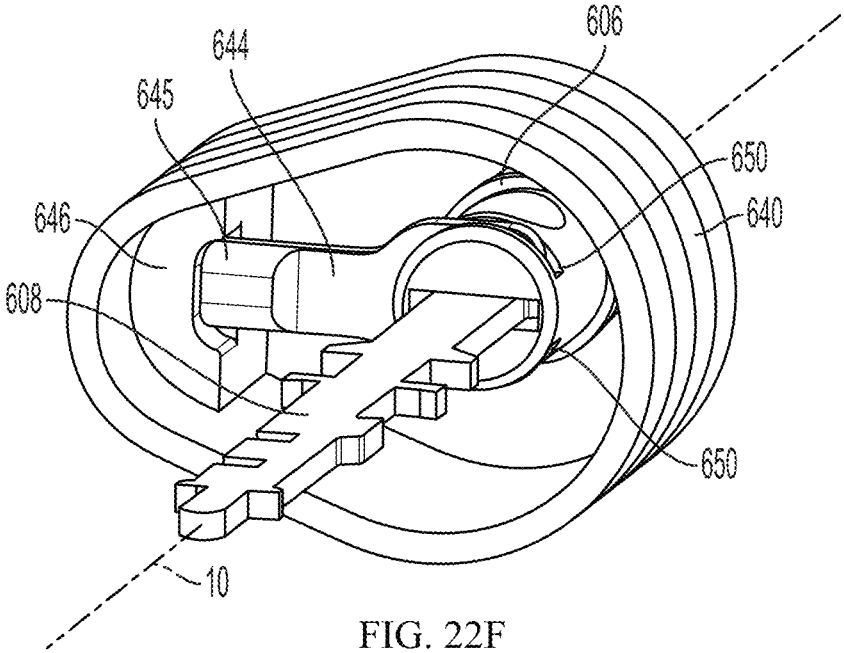
FIG. 22F shows components of the dual indicator cylindrical door lock of FIG. 22E.
Figure 22G:
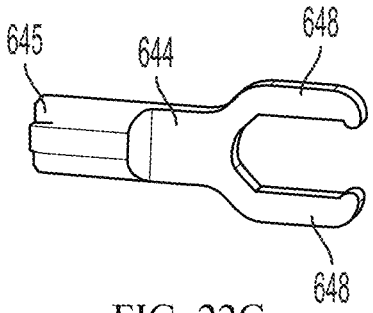
FIG. 22G shows a component of the dual indicator cylindrical door lock of FIG. 22E.

In some embodiments, as shown in FIGS. 22F-22G, a pin 644 connects the interior indicator 640 to the locking bar 608 to couple to the interior indicator 640 to the lock button 606. Thus, when the lock button is pressed in a direction toward the exterior handle to put the door lock in a locked state, the second indicator moves axially with the lock button to display a color indicating the locked status through the openings. A first end 645 of the pin 644 may be attached to a ledge 646 on an interior surface of the indicator 640. A second end of pin 644 may include grippers 648 that engage groove 650 on opposite sides of the lock button 606. Accordingly, the interior indicator 640 is coupled to the lock button 606 via the pin 644 and will move axially with the lock button 606.

FIGS. 23A-23G show another embodiment of an indicator door lock 700. As shown in FIG. 23A, in this embodiment, the exterior handle 702 includes one or more openings 704 that extend through a surface on a first portion 706 of the exterior handle. The first portion 706 extends along a direction of the lock axis 10. In some embodiments, the openings 704 are elongated openings that extend partially around a perimeter of the first portion and may be viewed from more than one vantage point. The indicator door lock 700 also includes a first indicator 708 disposed in the first portion 706 that displays a lock status through the openings. As shown in FIG. 23B, the first indicator 708 may have alternating color portions 708*a*, 708*b* that correspond to the openings 707 on the first portion 706. The first indicator may move from a first position (FIG. 23B) at which one set of color portions 708*a* may be visible through the openings 704 to a second position (FIG. 23C) at which the other set of color portions 708*b* may be visible through the openings. As a non-limiting example, the first set of color portions 708*a* may be green to indicate an unlocked state of the door lock and the second set of color portions 708*b* may be red to indicate a locked state of the door lock 700. The openings 704 may have a transparent or translucent material covering that allow the first indicator 708 to be visible through the openings 704.

In some embodiments, the first indicator 708 is operatively coupled to a lock button disposed in the interior handle and includes the same internal mechanisms as the embodiment described with reference to FIGS. 22A-22D to translate axial motion of the lock in the interior handle to the first indicator 708. The first indicator 708 moves axially along the lock axis 10 from a first position (e.g., unlocked) to a second position (e.g., locked) when a lock such as the lock button 606 (FIG. 22A) is pressed in a direction along the lock axis 10 toward the external handle. As described above, an end surface of a second bar may press against the first indicator 708 to cause it to move axially.

Figure 23C:
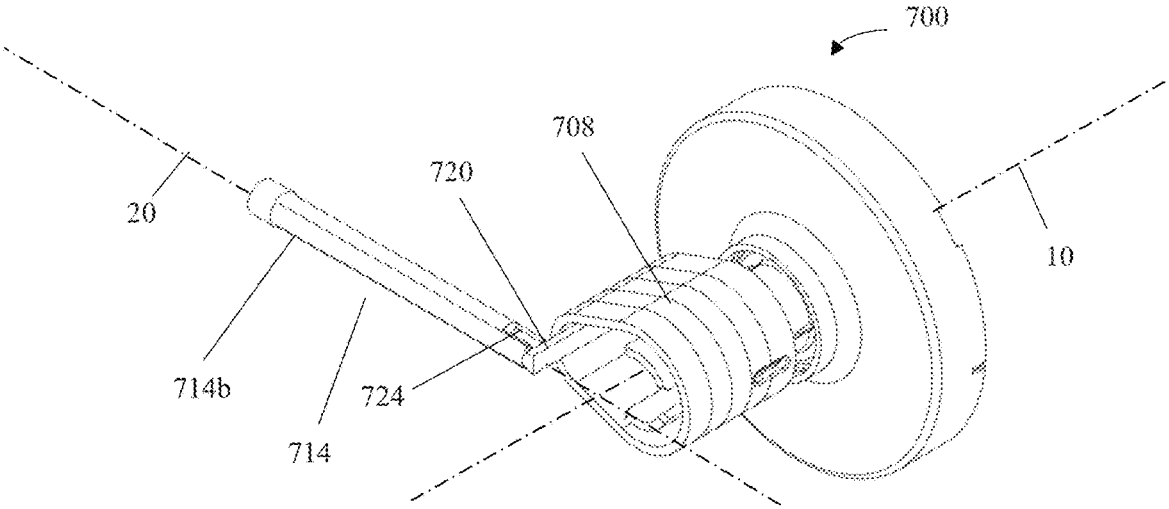
FIG. 23C shows the indicator door lock of FIG. 23A in a locked state.
Figure 23D:
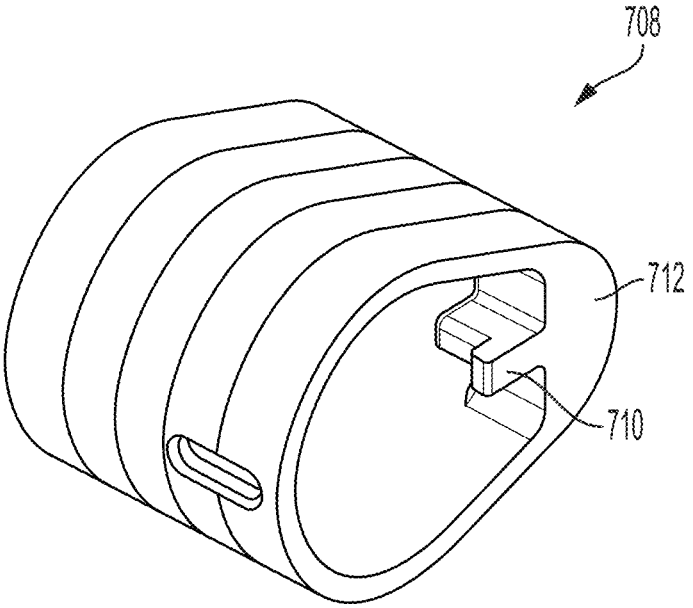
FIG. 23D shows the indicator in the exterior handle of the indicator door lock of FIG. 23A.

FIG. 23D shows a rear perspective view of the first indicator 708 according to one embodiment. The first indicator may include a protrusion 710 that extends from an inner surface at an end 712 of the first indicator facing the interior side of the door lock 700. The end surface 638 of the second bar 626 may press against the protrusion 710 when the lock is pressed into the locked position (see also FIGS. 22C-22D) to move the first indicator from the first position to the second position. In some embodiments, the first indicator 708 may be spring loaded such that when the lock is released to the unlocked state and moves axially in a direction away from the external handle, the first indicator will be biased back to the first position.

As shown in the embodiment of FIGS. 23A-23C, when the handle is formed as a lever, the indicator door lock 700 may include a second indicator 714 in a second portion 716 of the exterior handle 702. The second portion 716 may extend radially from the first portion 706 along a second axis 20 perpendicular to the lock axis 10. The second indicator 716 may be rotationally mounted within the second portion 716 along the second axis 20. The second portion 716 may have at least one opening 718 that extends through a surface of the second portion 716 such that the second indicator is visible through the opening. The second indicator may have two different color portions 714*a*, 714*b* along the length of the second indicator to indicate a status of the door lock (FIGS. 23B-23C).

The second indicator 714 may be operationally coupled to the first indicator 708 such that when the first indicator 708 moves axially from a first position to a second position, the second indicator moves rotationally from a first position to a second position. In the first position (e.g., unlocked state shown in FIGS. 23A-23B), the portion 714*a* may be visible through the opening 718. Portion 714*a* may be the same color as portion 708*a* on the first indicator 708. In the second position (e.g., locked state shown in FIG. 23C), the second indicator may be rotated such that portion 714*b* is visible through the opening 718. The color of portion 714*b* may be the same color as portions 708*b* on the second indicator.

Figure 23E:
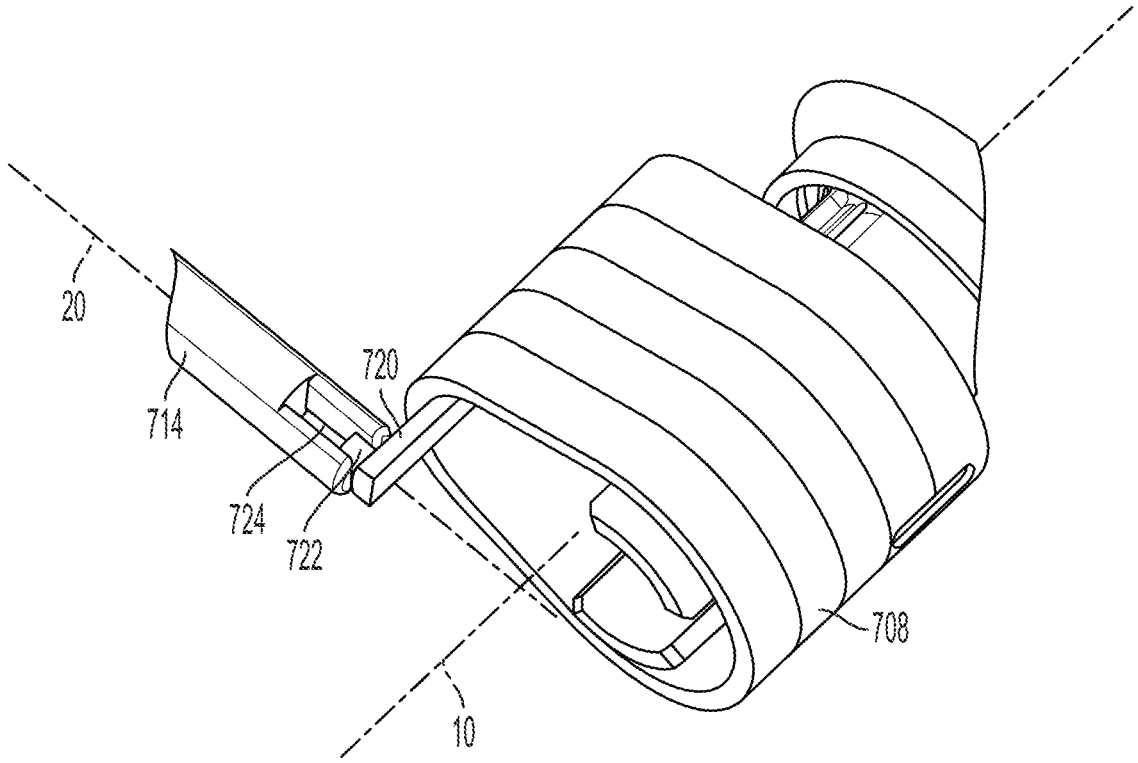
FIG. 23E shows an enlarged view of the indicator door lock of FIG. 23C.

In some embodiments, the first indicator 708 includes a rod 720 that extends from an end of the first indicator 708 in a direction parallel to the lock axis 10. As shown in FIG. 23E, the rod 720 may include a pin 722 that extends in a direction parallel to the second axis toward the second indicator 714. The pin 722 may engage a groove 724 at and end of the second indicator 714. FIG. 23E shows the door lock in a locked state and the first indicator and the second indicator in the second position.

Figure 23F:
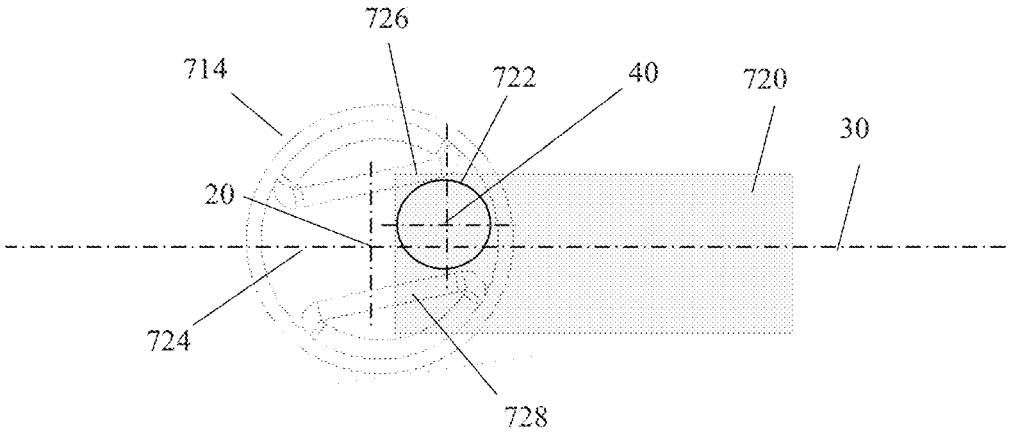
FIG. 23F shows a schematic of the indicator door lock of FIG. 23A in a first position.
Figure 23G:
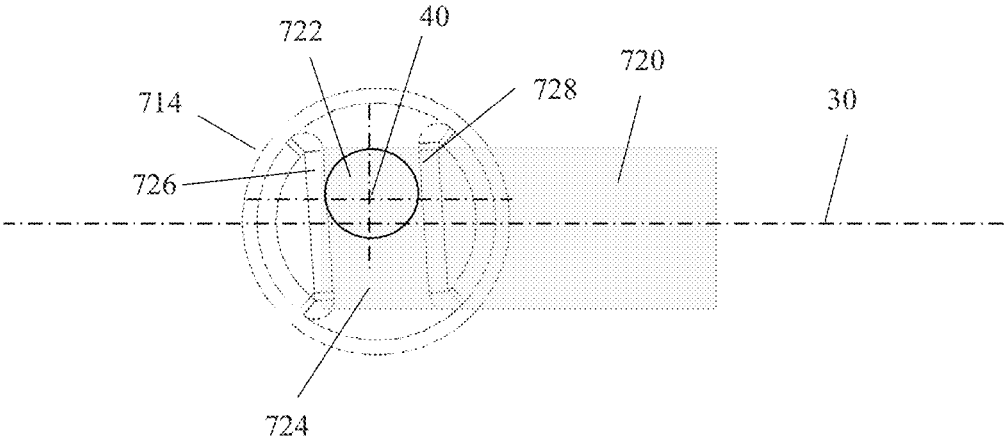
FIG. 23G shows a schematic of the indicator door lock of FIG. 23A in a second position.

FIGS. 23F and 23G are schematic views showing the pin 722 in groove 724 when the door lock is in the unlocked state and the locked state, respectively. In these FIGS. 23F-23G, the rod 720 is shown in phantom to reveal the pin 722. As shown in FIGS. 23F-23G, the pin 722 is eccentric relative to the longitudinal axis 30 of the rod 720 such that the pin 722 is offset from a center of the groove 724 and the second axis 20 about which the second indicator rotates. In FIG. 23F (the unlocked state), the rod 720 is retracted (positioned to the right) and the center 40 of pin 722 is positioned above the longitudinal axis 30 and the second axis 20. Thus, as rod 720 and pin 722 move axially toward the left, the pin 722 presses against wall 726 of the groove 724 to cause the second indicator 714 to rotate (e.g., in a counterclockwise direction as in FIG. 23F) to the second position (FIG. 23G). It should be noted that surface 726 is angled relative to the axis 30 in FIG. 23F to facilitate pushing of the pin 722 on surface 726 and that surface 728 is angled relative to the axis 30 in FIG. 23*g* to facilitate pulling of the pin 722 on surface 728 as the rod 720 translates.

FIG. 23G is a view showing the pin 722 in groove 724 when the door lock is in the locked state and the second indicator is in the second position. The rod 720 is advanced (positioned to the left) and the pin 722 is positioned above the axis 30 and a center of the groove 724. Thus, as rod 720 and pin 722 move axially toward the right, the pin 722 presses against wall 728 of the groove 724 to cause the second indicator 714 to rotate (e.g., in a clockwise direction) back to the first position (FIG. 23F).

Figure 24A:
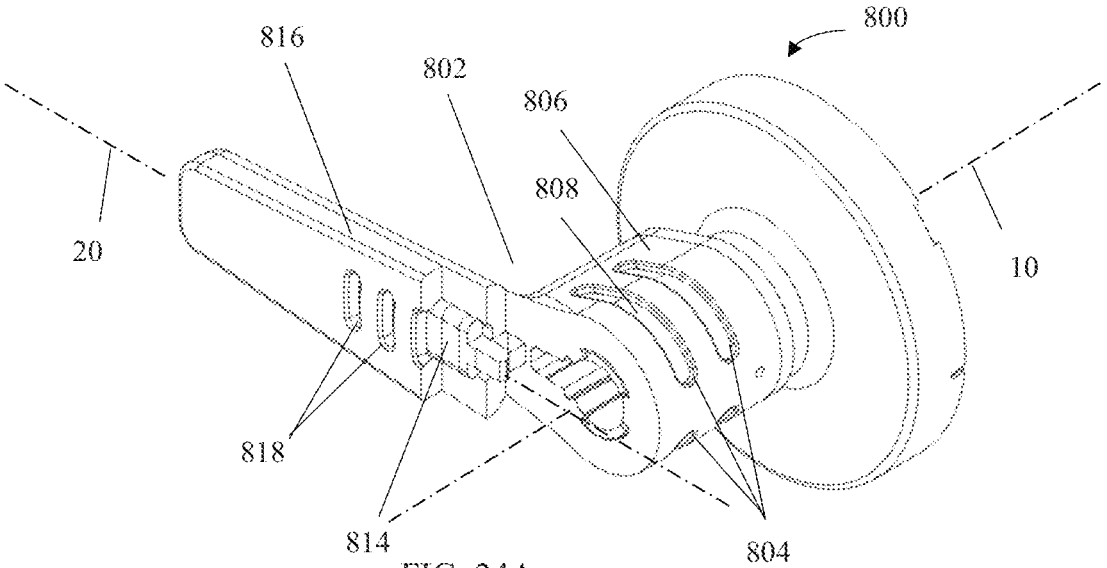
FIG. 24A shows another embodiment of an indicator door lock with a lever partially cut away.
Figure 24B:
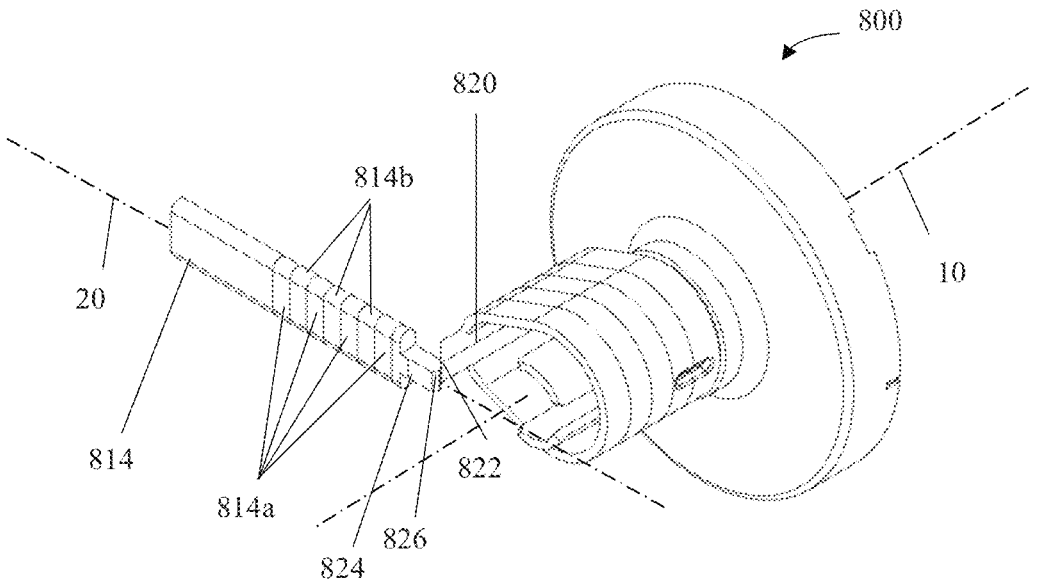
FIG. 24B shows the indicator door lock of FIG. 24A with the lever removed.
Figure 24C:
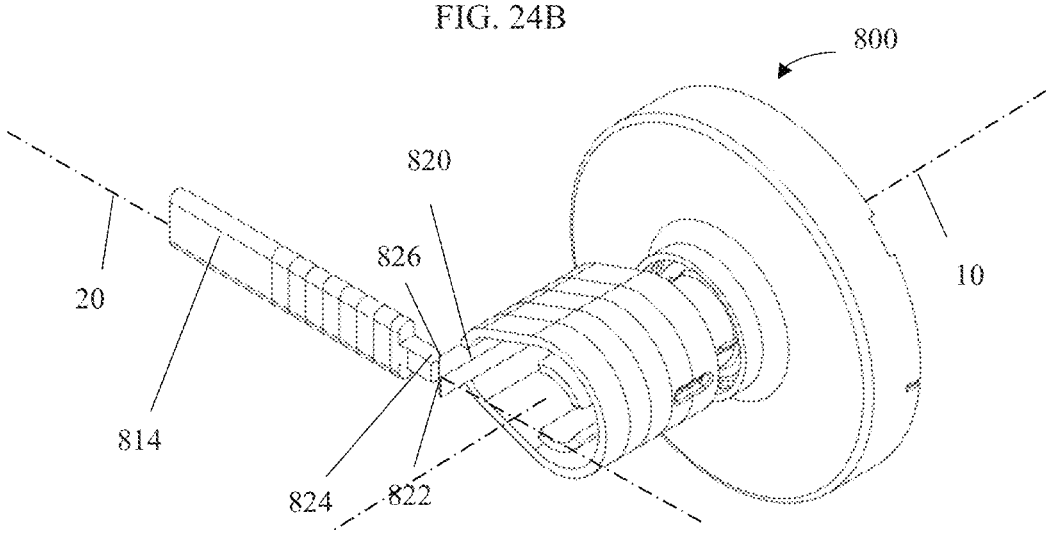
FIG. 24C shows the indicator door lock of FIG. 24A in a locked state.

FIGS. 24A-24C show another embodiment of an indicator door lock 800. This embodiment of the indicator door lock 800 is similar to the embodiment described with reference to FIGS. 23A-23E. For example, the first portion 810 includes a first indicator 808 that displays a status of the door lock through openings 804. The first indicator 808 is the same as the first indictor 708 in FIGS. 23A-23E and moves axially by the same means described for the first indicator 708. Indicator door lock 800, however, includes a different second indicator 814 in the second portion 816 of the exterior handle 802 than what was disclosed in the door lock 700 in FIGS. 23A-23E.

As shown in FIG. 24A, the second indicator is translationally mounted in the second portion 816 along the second axis 20. In some embodiments, the exterior handle 802 includes one or more openings 818 through a surface of the second portion 816 that extend in a direction perpendicular to the second axis. As shown in FIGS. 24B-24C, the second indicator 814 includes alternating indicia portions 814*a*, 814*b*, such as colors to indicate different statuses of the door lock. Either portion 814*a* or portion 814*b* are arranged to align with the openings 818 depending on the door lock status (e.g., unlocked or locked). The second indicator is configured to move axially along the second axis 20 to change the portions that are viewable through the openings 818. The colors of the portions viewable through openings 818 match with the colors of portions on the first indicator viewable through openings 808.

FIGS. 24B and 24C show the first indicator 808 and the second indicator 814 in an unlocked state and the locked state, respectfully. The second indicator 814 may be coupled to the first indicator 808 via a rod 820 that extends from the first indicator 808 and that is axially fixed to the first indicator such that the rod moves axially with the first indicator. In the locked state of FIG. 24C, the first indicator 808 and rod 820 have been axially moved to a second position in a direction along the lock axis 10 away from the door lock. Axial motion of the first indicator 808 along the lock axis 10 is translated into axial motion of the second indicator along the second axis 20. This is accomplished by an angled surface 822 on an end of rod 820 that is arranged to engage a complementary angled surface 826 of a protrusion 824 that extends from an end of the second indicator 814 in a direction along the second axis. As the angled surface 822 advances axially toward the angled surface 826, the angled surface 822 presses against angled surface 826 and acts like a cam to translate the axial motion of the rod 820 to axial motion of the second indicator 814 in a direction along the second axis. In some embodiments, the second indicator 814 may be spring loaded such that when the rod 820 moves axially in a direction away from angled surface 826, the second actuator is biased back into the first position (FIG. 24B).

Figure 25A:
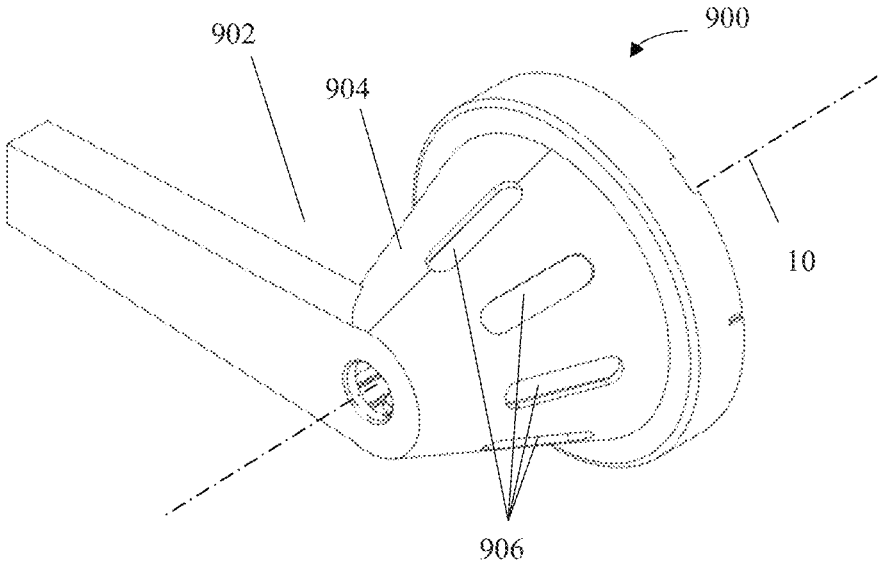
FIG. 25A shows another embodiment of an indicator door lock.
Figure 25B:
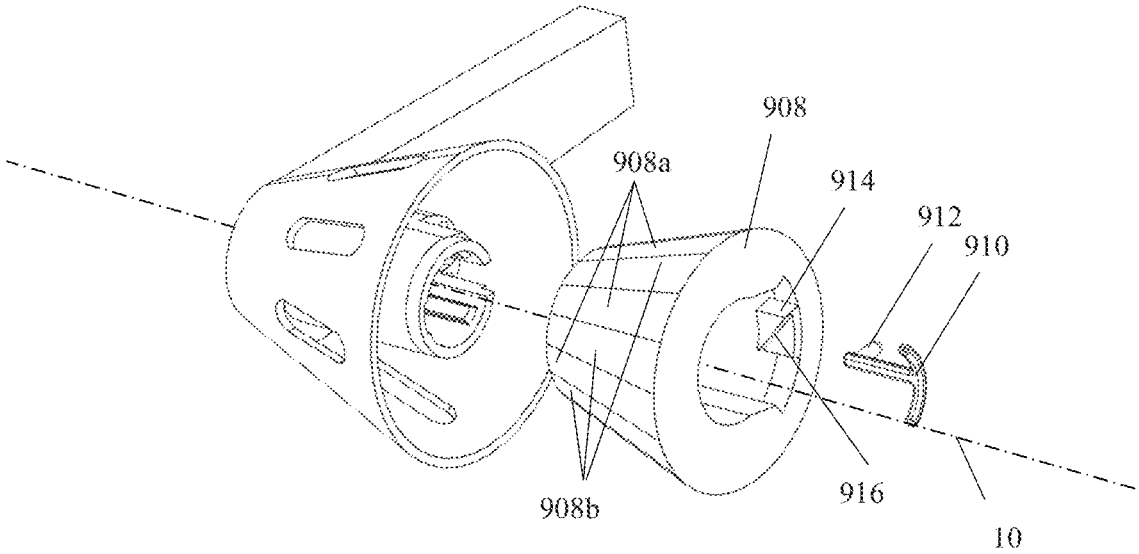
FIG. 25B shows components of the indicator door lock of FIG. 25A.

FIGS. 25A-25B show another embodiment of an indicator door lock 900. The indicator door lock includes an exterior handle 902 with a housing 904 aligned along the lock axis 10. The housing 904 may include one or more openings 906 radially spaced about the housing that extend through a surface of the housing. The indicator door lock 900 also includes an indicator 908 disposed within and rotationally supported by the housing 904. The housing 904 and corresponding indicator 908 may be cylindrical or conical as the present disclosure is not limited in this respect. As shown in the embodiment of FIGS. 25A-25B, the housing 904 and indicator 908 are conical. As with a conical indicator, a cylindrical indicator is also mounted for rotation to provide the corresponding lock status, as will become apparent below.

The indicator 908 may include portions of alternating colors such that portions 908*a* are red and portions 908*b* are green. The indicator may rotate or pivot about the lock axis 10 to position either the green portions 908*a* or the red portions 908*b* to be viewable through the openings 906 to indicate the lock status.

The indicator 908 may be spring-loaded to be biased to a first position when the door lock 900 is in an unlocked position. In this position, the green portions 908*a* are viewable through openings 906. The indicator 908 may be operatively coupled to a lock in the interior side of the door lock such that when the lock is pressed axially in a direction along toward the exterior handle, the indicator 908 rotates about the lock axis 10 to a second position at which the red portions 908*b* are viewable through openings 906. To operatively couple the indicator to the interior lock, the door lock 900 may use the same internal mechanisms as the door lock embodiment described with reference to FIGS. 22A-22D. For example, in FIG. 25B, bar 910 is similar to the second bar 626 in FIGS. 22A-22D such that it moves along an axis parallel to the lock axis 10 in a direction toward the exterior handle when the lock is moved axially to a locked state. In one embodiment, the end of the bar 920 acts on the ramp 916 to cause the indicator to rotate as the bar translates. Alternatively, as shown in FIG. 25B, bar 910 includes a pin 912 that extends radially from the end surface of the bar 910. The pin 912 is configured to engage the angled ramp surface 916 on a protrusion 910 extending from an inner surface of the indicator. As the bar moves axially toward the indicator, the pin 912 presses against the ramp and acts like a pushrod against a cam surface to cause rotational motion of the indicator 908 to a second position. The indicator remains in the second position until the bar 910 moves axially away from the indicator and the spring biases the indicator back to the first position. In one embodiment, the spring (not shown) may be configured as torsional spring.

Although red and green portions may be used to indicate the status of the door lock, it should be appreciated that any colors may be used in the embodiments described herein as the disclosure is not so limited in this respect. Furthermore, additional visual indicators including symbols, text, patterns, electronics (e.g., lights, LEDs, displays, etc.) or any other arrangement of visually communicating lock status may be used.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A cylindrical door lock comprising:

an exterior handle including an indicator configured to display a locked status of the door lock;

an interior handle including a lock;

a locking bar aligned along a lock axis extending between the interior handle and the exterior handle, wherein the locking bar is coupled to the lock such that axial motion of the lock causes the locking bar to move axially;

a locking piece configured to rotate about the locking bar and to move axially with the locking bar, wherein the locking piece includes a locking arm that extends radially from the lock axis;

a first bar operatively coupled to the locking piece, the first bar being configured to engage the locking arm of the locking piece such that axial motion of the locking arm causes the first bar to move axially; and a second bar operatively coupled to the first bar, the second bar configured to engage the first bar such that axial motion of the first bar causes the second bar to move axially, and wherein the second bar is operatively coupled to the indicator in the exterior handle and wherein axial motion of the second bar causes the indicator to move.

2. The cylindrical door lock of claim 1, wherein the first bar is formed generally as a t-shaped bar and the second bar is formed generally as a t-shaped bar.

3. The cylindrical door lock of claim 1, wherein the indicator is configured to move axially upon axial motion of the second bar.

4. The cylindrical door lock of claim 1, wherein the indicator is configured to move rotationally upon axial motion of the second bar.

5. A cylindrical door lock configured to display a lock status on an exterior handle, the cylindrical door lock comprising:

an exterior handle having a first portion extending in a direction of a lock axis, wherein the first portion includes at least one opening that extends through a surface of the first portion;

a first indicator disposed within the first portion and configured to display a status of the door lock through the at least one opening, wherein the first indicator is configured to move axially along the lock axis upon a change in the status; and a lock on an interior side of the door lock and operatively coupled to the first indicator, wherein the first indicator is configured to move axially upon motion of the lock.

6. The cylindrical door lock of claim 5, wherein the exterior handle further comprises a second portion that extends radially from the first portion along a second axis perpendicular to the lock axis, and wherein the second portion comprises: at least one opening through a surface in the second portion; and a second indicator disposed within the second portion and configured to display the status of the door lock through the at least one opening in the surface of the second portion, wherein the second actuator is configured to move upon axial motion of the first indicator.

7. The cylindrical door lock of claim 6, wherein the second indicator is rotationally mounted within the external handle, and wherein the second indicator is configured to rotate upon axial motion of the first indicator.

8. The cylindrical door lock of claim 6, wherein the second indicator is mounted for translation within the external handle and along the second axis, and wherein the second indicator is configured to translate upon axial motion of the first indicator.

9. A cylindrical door lock comprising:

an external handle having a housing disposed along a lock axis;

at least one opening in a surface of the housing;

an indicator disposed within the housing and configured to indicate a status of the door lock through the at least one opening, wherein the indicator is configured to move rotationally about the lock axis upon a change in the status; and a lock on an interior side of the door lock and operatively coupled to the indicator, wherein the indicator is configured to rotate about the lock axis upon axial motion of the lock.

10. The cylindrical door lock of claim 9, where the at least one opening in a surface of the housing comprises a plurality of openings radially dispersed about the housing.

11. The cylindrical door lock of claim 9, wherein the indicator is spring loaded to bias the indicator to display a first status of the door lock through the at least one opening.

12. The cylindrical door lock of claim 11, further comprising a bar operatively coupled to the lock and configured to move axially upon axial motion of the lock, and wherein the bar is configured to engage an angled protrusion extending from an inside surface of the indicator such that axial motion of the bar cams the angled protrusion to cause the indicator to rotate about the lock axis to display a second status through the at least one opening.

13. The cylindrical door lock of claim 12, wherein the bar is offset from the lock axis.

14. The cylindrical door lock of claim 9, wherein the housing comprises a conical housing and the indicator comprises a conical indicator.

* * * * *